US006328409B1

(12) United States Patent
Peeters et al.

(10) Patent No.: US 6,328,409 B1
(45) Date of Patent: Dec. 11, 2001

(54) BALLISTIC AEROSOL MAKING APPARATUS FOR MARKING WITH A LIQUID MATERIAL

(75) Inventors: Eric Peeters, Fremont; Jaan Noolandi, Mountain View; Raj B. Apte, Palo Alto; Philip D. Floyd, Sunnyvale; Jonathan A. Small, Los Altos, all of CA (US); Gregory J. Kovacs, Mississauga (CA); Meng H. Lean, Briarcliff Manor, NY (US); Armin R. Volkel, Palo Alto, CA (US); Steven B. Bolte, Rochester, NY (US); An-Chang Shi, Hamilton (CA); Frederick J. Endicott, San Carlos; Gregory B. Anderson, Woodside, both of CA (US); Dan A. Hays, Fairport; Joel A. Kubby, Rochester, both of NY (US); Warren B. Jackson, San Francisco, CA (US); Andrew A. Berlin, San Jose, CA (US); G. A. Neville Connell, Cupertino, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/163,954

(22) Filed: Sep. 30, 1998

(51) Int. Cl.[7] ..... B41J 2/17; B41J 2/21; B41J 2/015

(52) U.S. Cl. ..... 347/21; 347/43; 347/97

(58) Field of Search ..... 347/43, 40, 41, 347/97, 73, 21

(56) References Cited

U.S. PATENT DOCUMENTS

| | | | |
|---|---|---|---|
| 3,152,858 | 10/1964 | Wadey | 346/75 |
| 3,997,113 | 12/1976 | Pennebaker, Jr. | 239/15 |
| 4,113,598 | 9/1978 | Jozwiak, Jr. et al. | 204/181 R |

(List continued on next page.)

FOREIGN PATENT DOCUMENTS

| | | |
|---|---|---|
| 0 655 337 A2 | 5/1995 | (EP) . |
| 0 726 158 A1 | 8/1996 | (EP) . |
| 353035539A | 4/1978 | (JP) . |
| 53035539 A | 4/1978 | (JP) . |
| 55 019556 | 2/1980 | (JP) . |
| 55 028819 | 2/1980 | (JP) . |
| 56 146773 | 11/1981 | (JP) . |
| 57-192027 A | 11/1982 | (JP) . |
| 58-224760 | 12/1983 | (JP) . |
| 60 229764 | 11/1985 | (JP) . |
| 362035847A | 2/1987 | (JP) . |
| 02 293151 | 12/1990 | (JP) . |
| 4-158044 | 6/1992 | (JP) . |
| 4-182138 | 6/1992 | (JP) . |

(List continued on next page.)

OTHER PUBLICATIONS

U.S. application No. 08/670,734, Flexible Donor Belt Employing A DC Traveling Wave, filed Jun. 24, 1996.

U.S. application No. 09/407,908, Ballistic Aerosol Marking Apparatus With Stacked Electrode Structure, Filed Sep. 29, 1999.

U.S. application No. 09/410,371, Ballistic Aerosol Marking Apparatus With Non–Wetting Coating, Filed Sep. 30, 1999.

*Primary Examiner*—Thinh Nguyen

(57) ABSTRACT

A marking apparatus is disclosed in which a propellant stream is passed through a channel and directed toward a substrate. A liquid marking material, such as ink, is controllably introduced into the propellant stream and imparted with sufficient kinetic energy thereby to be made incident upon a substrate. A multiplicity of channels for directing the propellant and marking material allow for high throughput, high resolution marking. Multiple marking materials may be introduced into the channel and mixed therein prior to being made incident on the substrate, or mixed or superimposed on the substrate without registration. One example is a single-pass, full-color printer.

46 Claims, 38 Drawing Sheets

U.S. PATENT DOCUMENTS

| | | | |
|---|---|---|---|
| 4,146,900 | 3/1979 | Arnold | 346/75 |
| 4,196,437 | 4/1980 | Hertz | 346/1.1 |
| 4,223,324 | 9/1980 | Yamamori et al. | 346/140 R |
| 4,265,990 | 5/1981 | Stolka et al. | 430/59 |
| 4,403,228 | 9/1983 | Miura et al. | 346/75 |
| 4,403,234 | 9/1983 | Miura et al. | 346/140 R |
| 4,480,259 | 10/1984 | Kruger et al. | 346/140 R |
| 4,514,742 | 4/1985 | Suga et al. | 346/140 R |
| 4,523,202 | 6/1985 | Gamblin | 346/75 |
| 4,544,617 | 10/1985 | Mort et al. | 430/58 |
| 4,607,267 | 8/1986 | Yamamuro | 346/140 R |
| 4,614,953 | 9/1986 | Lapeyre | 346/140 R |
| 4,634,647 | 1/1987 | Jansen et al. | 430/84 |
| 4,647,179 | 3/1987 | Schmidlin | 355/3 DD |
| 4,663,258 | 5/1987 | Pai et al. | 430/57 |
| 4,666,806 | 5/1987 | Pai et al. | 430/57 |
| 4,720,444 | 1/1988 | Chen | 430/58 |
| 4,760,005 | 7/1988 | Pai | 430/65 |
| 4,770,963 | 9/1988 | Pai et al. | 430/64 |
| 4,791,046 | 12/1988 | Ogura | 430/296 |
| 4,839,232 | 6/1989 | Morita et al. | 428/473.5 |
| 4,839,666 | 6/1989 | Jayne | 346/75 |
| 4,929,968 | 5/1990 | Ishikawa | 346/140 R |
| 4,982,200 | 1/1991 | Ramsay | 346/75 |
| 5,030,536 | 7/1991 | Pai et al. | 430/127 |
| 5,045,870 | 9/1991 | Lamey et al. | 346/140 R |
| 5,063,655 | 11/1991 | Lamey et al. | 29/611 |
| 5,113,198 | 5/1992 | Nishikawa et al. | 346/1.1 |
| 5,190,817 | 3/1993 | Terrell et al. | 428/343 |
| 5,294,946 | 3/1994 | Gandy et al. | 346/140 R |
| 5,300,339 | 4/1994 | Hays et al. | 428/36.9 |
| 5,363,131 | 11/1994 | Momose et al. | 347/46 |
| 5,397,664 | 3/1995 | Noelscher et al. | 430/5 |
| 5,403,617 | 4/1995 | Haaland | 427/180 |
| 5,426,458 | 6/1995 | Wenzel et al. | 347/45 |
| 5,428,381 | 6/1995 | Hadimioglu et al. | 347/46 |
| 5,482,587 | 1/1996 | McAleavey | 156/243 |
| 5,491,047 | 2/1996 | Kim et al. | 430/329 |
| 5,510,817 | 4/1996 | Sohn | 347/21 |
| 5,512,712 | 4/1996 | Iwata et al. | 174/258 |
| 5,535,494 | 7/1996 | Plesinger et al. | 29/25.35 |
| 5,604,519 * | 2/1997 | Keefe et al. | 347/13 |
| 5,635,969 | 6/1997 | Allen | 347/96 |
| 5,640,187 | 6/1997 | Kashiwazaki et al. | 347/101 |
| 5,646,656 * | 7/1997 | Leonhardt et al. | 347/43 |
| 5,682,190 | 10/1997 | Hirosawa et al. | 347/94 |
| 5,731,048 | 3/1998 | Ashe et al. | 427/585 |
| 5,756,190 | 5/1998 | Hosomi et al. | 428/209 |
| 5,761,783 | 6/1998 | Osawa et al. | 29/25.35 |
| 5,777,636 | 7/1998 | Naganuma et al. | 347/10 |
| 5,780,187 | 7/1998 | Pierrat | 430/5 |
| 5,787,558 | 8/1998 | Murphy | 29/25.35 |
| 5,818,477 | 10/1998 | Fullmer et al. | 347/43 |
| 5,828,388 | 10/1998 | Cleary et al. | 347/21 |
| 5,853,906 | 12/1998 | Hsieh | 428/690 |
| 5,882,830 | 3/1999 | Visser et al. | 430/59 |
| 5,893,015 | 4/1999 | Mojarradi et al. | 399/291 |
| 5,900,898 | 5/1999 | Shimizu et al. | 347/93 |
| 5,958,122 | 9/1999 | Fukuda et al. | 106/31.57 |
| 5,967,044 * | 10/1999 | Marschke | 101/363 |
| 5,968,674 | 10/1999 | Hsieh et al. | 428/690 |
| 5,969,733 | 10/1999 | Sheinman | 347/75 |
| 5,981,043 | 11/1999 | Murakami et al. | 428/209 |
| 5,982,404 | 11/1999 | Iga et al. | 347/173 |
| 5,990,197 | 11/1999 | Escano et al. | 523/160 |
| 5,992,978 * | 11/1999 | Fujii et al. | 347/54 |
| 6,019,466 | 2/2000 | Hermanson | 347/104 |
| 6,036,295 | 3/2000 | Ando et al. | 347/7 |
| 6,081,281 | 6/2000 | Cleary et al. | 347/21 |
| 6,116,718 | 9/2000 | Peeters et al. | 347/21 |

FOREIGN PATENT DOCUMENTS

| | | |
|---|---|---|
| 5-4348 | 1/1993 | (JP) . |
| 5-193140 | 8/1993 | (JP) . |
| 5-269995 | 10/1993 | (JP) . |
| WO 93/11866 | 6/1993 | (WO) . |
| WO 94/18011 | 8/1994 | (WO) . |
| WO 97/01449 | 1/1997 | (WO) . |

* cited by examiner

BALLISTIC AEROSOL MAKING APPARATUS FOR MARKING WITH A LIQUID MATERIAL

CROSS-REFERENCE TO RELATED APPLICATIONS

The present invention is related to U.S. patent application Ser. Nos. 09/163,893,09/164,124, 09/164,250,09/163,808, 09/163,765,09/163,839, 09/163,924,09/163,904, 09/163, 799,09/163,664 09/163,518, 09/164,104,09/163,825, issued U.S. patent Ser. No. 5,717,986, and U.S. patent applications Ser. Nos. 08/128,160, 08/670,734, 08/950,300, and 08/950, 303, each of the above being incorporated herein by reference.

BACKGROUND

The present invention relates generally to the field of marking devices, and more particularly to a device capable of applying a marking material to a substrate by introducing the marking material into a high-velocity propellant stream.

Ink jet is currently a common printing technology. There are a variety of types of ink jet printing, including thermal ink jet (TIJ), piezo-electric ink jet, etc. In general, liquid ink droplets are ejected from an orifice located at a one terminus of a channel. In a TIJ printer, for example, a droplet is ejected by the explosive formation of a vapor bubble within an ink-bearing channel. The vapor bubble is formed by means of a heater, in the form of a resistor, located on one surface of the channel.

We have identified several disadvantages with TIJ (and other ink jet) systems known in the art. For a 300 spot-per-inch (spi) TIJ system, the exit orifice from which an ink droplet is ejected is typically on the order of about 64 $\mu$m in width, with a channel-to-channel spacing (pitch) of about 84 $\mu$m, and for a 600 dpi system width is about 35 $\mu$m and pitch of about 42 $\mu$m. A limit on the size of the exit orifice is imposed by the viscosity of the fluid ink used by these systems. It is possible to lower the viscosity of the ink by diluting it in increasing amounts of liquid (e.g., water) with an aim to reducing the exit orifice width. However, the increased liquid content of the ink results in increased wicking, paper wrinkle, and slower drying time of the ejected ink droplet, which negatively affects resolution, image quality (e.g., minimum spot size, inter-color mixing, spot shape), etc. The effect of this orifice width limitation is to limit resolution of TIJ printing, for example to well below 900 spi, because spot size is a function of the width of the exit orifice, and resolution is a function of spot size.

Another disadvantage of known ink jet technologies is the difficulty of producing greyscale printing. That is, it is very difficult for an ink jet system to produce varying size spots on a printed substrate. If one lowers the propulsive force (heat in a TIJ system) so as to eject less ink in an attempt to produce a smaller dot, or likewise increases the propulsive force to eject more ink and thereby to produce a larger dot, the trajectory of the ejected droplet is affected. This in turn renders precise dot placement difficult or impossible, and not only makes monochrome greyscale printing problematic, it makes multiple color greyscale ink jet printing impracticable. In addition, preferred greyscale printing is obtained not by varying the dot size, as is the case for TIJ, but by varying the dot density while keeping a constant dot size.

Still another disadvantage of common ink jet systems is rate of marking obtained. Approximately 80% of the time required to print a spot is taken by waiting for the ink jet channel to refill with ink by capillary action. To a certain degree, a more dilute ink flows faster, but raises the problem of wicking, substrate wrinkle, drying time, etc. discussed above.

One problem common to ejection printing systems is that the channels may become clogged. Systems such as TIJ which employ aqueous ink colorants are often sensitive to this problem, and routinely employ non-printing cycles for channel cleaning during operation. This is required since ink typically sits in an ejector waiting to be ejected during operation, and while sitting may begin to dry and lead to clogging.

Other technologies which may be relevant as background to the present invention include electrostatic grids, electrostatic ejection (so-called tone jet), acoustic ink printing, and certain aerosol and atomizing systems such as dye sublimation.

SUMMARY

The present invention is a novel system for applying a marking material to a substrate, directly or indirectly, which overcomes the disadvantages referred to above, as well as others discussed further herein. In particular, the present invention is a system of the type including a propellant which travels through a channel, and a marking material which is controllably (i.e., modifiable in use) introduced, or metered, into the channel such that energy from the propellant propels the marking material to a the substrate. The propellant is usually a dry gas which may continuously flow through the channel while the marking apparatus is in an operative configuration (i.e., in a power-on or similar state ready to mark). The system is referred to as "ballistic aerosol marking" in the sense that marking is achieved by in essence launching a non-colloidal, solid or semi-solid particulate, or alternatively a liquid, marking material at a substrate. The shape of the channel may result in a collimated (or focused) flight of the propellant and marking material onto the substrate.

The following summary and detailed description describe many of the general features of a ballistic aerosol marking apparatus, and method of employing same. The present invention is, however, a subset of the complete description contained herein as will be apparent from the claims hereof.

In our system, the propellant may be introduced at a propellant port into the channel to form a propellant stream. A marking material may then be introduced into the propellant stream from one or more marking material inlet ports. The propellant may enter the channel at a high velocity. Alternatively, the propellant may be introduced into the channel at a high pressure, and the channel may include a constriction (e.g., de Laval or similar converging/diverging type nozzle) for converting the high pressure of the propellant to high velocity. In such a case, the propellant is introduced at a port located at a proximal end of the channel (defined as the converging region), and the marking material ports are provided near the distal end of the channel (at or further down-stream of a region defined as the diverging region), allowing for introduction of marking material into the propellant stream.

In the case where multiple ports are provided, each port may provide for a different color (e.g., cyan, magenta, yellow, and black), pre-marking treatment material (such as a marking material adherent), post-marking treatment material (such as a substrate surface finish material, e.g., matte or gloss coating, etc.), marking material not otherwise visible to the unaided eye (e.g., magnetic particle-bearing material, ultra violet-fluorescent material, etc.) or other marking material to be applied to the substrate. The marking material is imparted with kinetic energy from the propellant stream, and ejected from the channel at an exit orifice located at the distal end of the channel in a direction toward a substrate.

One or more such channels may be provided in a structure which, in one embodiment, is referred to herein as a print head. The width of the exit (or ejection) orifice of a channel is generally on the order of 250 $\mu$m or smaller, preferably in the range of 100 $\mu$m or smaller. Where more than one channel is provided, the pitch, or spacing from edge to edge (or center to center) between adjacent channels may also be on the order of 250 $\mu$m or smaller, preferably in the range of 100 $\mu$m or smaller. Alternatively, the channels may be staggered, allowing reduced edge-to-edge spacing. The exit orifice and/or some or all of each channel may have a circular, semicircular, oval, square, rectangular, triangular or other cross sectional shape when viewed along the direction of flow of the propellant stream (the channel's longitudinal axis).

The material to be applied to the substrate may be transported to a port by one or more of a wide variety of ways, including simple gravity feed, hydrodynamic, electrostatic, or ultrasonic transport, etc. The material may be metered out of the port into the propellant stream also by one of a wide variety of ways, including control of the transport mechanism, or a separate system such as pressure balancing, electrostatics, acoustic energy, ink jet, etc.

The material to be applied to the substrate may be a solid or semi-solid particulate material such as a toner or variety of toners in different colors, a suspension of such a marking material in a carrier, a suspension of such a marking material in a carrier with a charge director, a phase change material, etc. One preferred embodiment employs a marking material which is particulate, solid or semi-solid, and dry or suspended in a liquid carrier. Such a marking material is referred to herein as a particulate marking material. This is to be distinguished from a liquid marking material, dissolved marking material, atomized marking material, or similar non-particulate material, which is generally referred to herein as a liquid marking material. However, the present invention is able to utilize such a liquid marking material in certain applications, as otherwise described herein.

In addition, the ability to use a wide variety of marking materials (e.g., not limited to aqueous marking material) allows the present invention to mark on a wide variety of substrates. For example, the present invention allows direct marking on non-porous substrates such as polymers, plastics, metals, glass, treated and finished surfaces, etc. The reduction in wicking and elimination of drying time also provides improved printing to porous substrates such as paper, textiles, ceramics, etc. In addition, the present invention may be configured for indirect marking, for example marking to an intermediate transfer roller or belt, marking to a viscous binder film and nip transfer system, etc.

The material to be deposited on a substrate may be subjected to post ejection modification, for example fusing or drying, overcoat, curing, etc. In the case of fusing, the kinetic energy of the material to be deposited may itself be sufficient to effectively either soften or melt (generically referred to herein as "melt") the marking material upon impact with the substrate and fuse it to the substrate. The substrate may be heated to enhance this process. Pressure rollers may be used to cold-fuse the marking material to the substrate. In-flight phase change (solid-liquid-solid) may alternatively be employed. A heated wire in the particle path is one way to accomplish the initial phase change. Alternatively, propellant temperature may accomplish this result. In one embodiment, a laser may be employed to heat and melt the particulate material in-flight to accomplish the initial phase change. The melting and fusing may also be electrostatically assisted (i.e., retaining the particulate material in a desired position to allow ample time for melting and fusing into a final desired position). The type of particulate may also dictate the post ejection modification. For example, UV curable materials may be cured by application of UV radiation, either in flight or when located on the material-bearing substrate.

Since propellant may continuously flow through a channel, channel clogging from the build-up of material is reduced or eliminated (the propellant effectively continuously cleans the channel). In addition, a closure may be provided which isolates the channels from the environment when the system is not in use. Alternatively, the print head and substrate support (e.g., platen) may be brought into physical contact to effect a closure of the channel. Initial and terminal cleaning cycles may be designed into operation of the printing system to optimize the cleaning of the channel (s). Waste material cleaned from the system may be deposited in a cleaning station. However, it is also possible to engage the closure against an orifice to redirect the propellant stream through the port and into the reservoir to thereby flush out the port.

Thus, the present invention and its various embodiments provide numerous advantages discussed above, as well as additional advantages which will be described in further detail below.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described, such as pressures, velocities, widths, lengths, etc. These recited ranges are to be treated as examples only, and are not intended to limit the scope of the claims hereof. In addition, a number of materials are identified as suitable for various facets of the embodiments, such as for marking materials, propellants, body structures, etc. These recited materials are also to be treated as. exemplary, and are not intended to limit the scope of the claims hereof.

Figure 1:
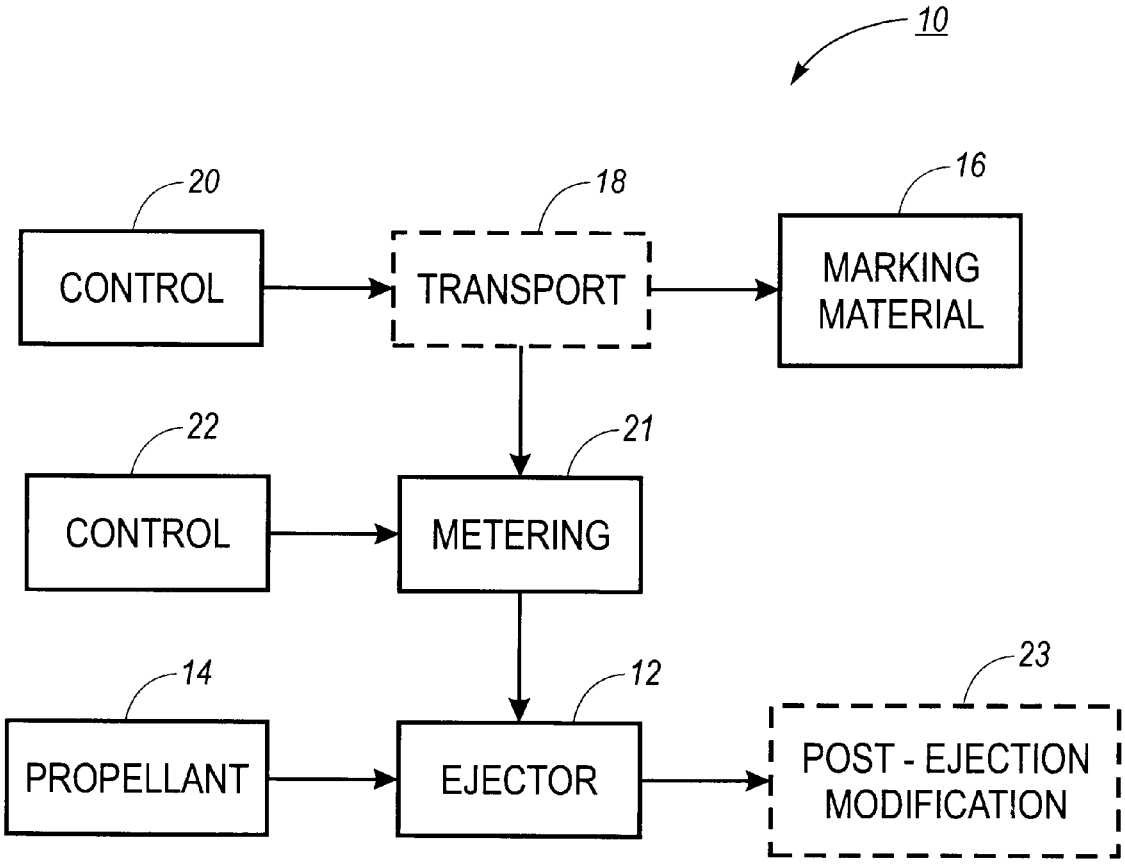
FIG. 1 is a schematic illustration of a system for marking a substrate according to the present invention.

With reference now to FIG. 1, shown therein is a schematic illustration of a ballistic aerosol marking device 10 according to one embodiment of the present invention. As shown therein, device 10 consists of one or more ejectors 12 to which a propellant 14 is fed. A marking material 16, which may be transported by a transport 18 under the control of control 20 is introduced into ejector 12. (Optional elements are indicated by dashed lines.) The marking material is metered (that is controllably introduced) into the ejector by metering means 21, under control of control 22. The marking material ejected by ejector 12 may be subject to post ejection modification 23, optionally also part of device 10. Each of these elements will be described in further detail below. It will be appreciated that device 10 may form a part of a printer, for example of the type commonly attached to a computer network, personal computer or the like, part of a facsimile machine, part of a document duplicator, part of a labeling apparatus, or part of any other of a wide variety of marking devices.

Figure 2:
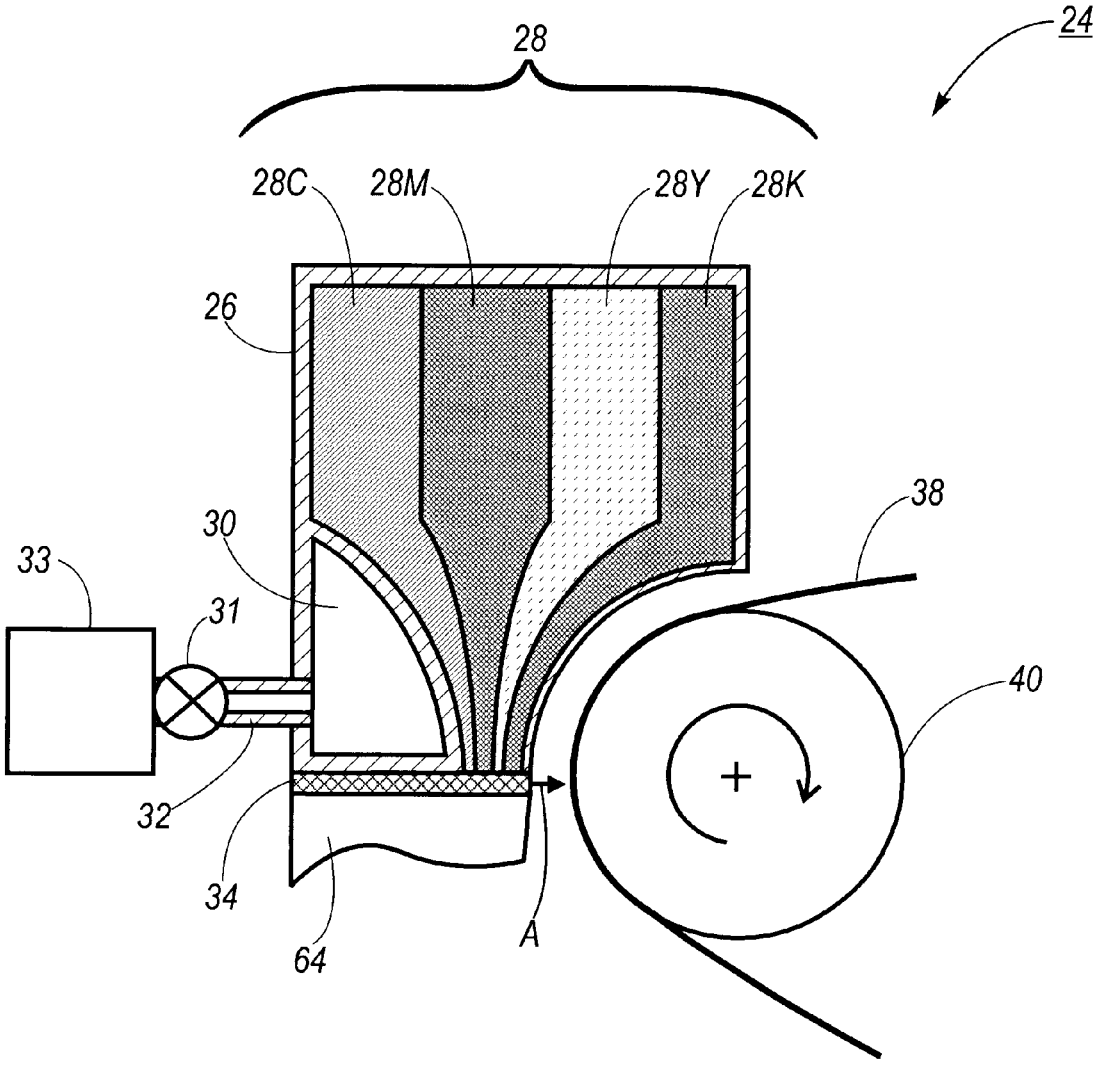
FIG. 2 is cross sectional illustration of a marking apparatus according to one embodiment of the present invention.

The embodiment illustrated in FIG. 1 may be realized by a ballistic aerosol marking device 24 of the type shown in the cut-away side view of FIG. 2. According to this embodiment, the materials to be deposited will be 4 colored toners, for example cyan (C), magenta (M), yellow (Y), and black (K), of a type described further herein, which may be deposited concomitantly, either mixed or unmixed, successively, or otherwise. While the illustration of FIG. 2 and the associated description contemplates a device for marking with four colors (either one color at a time or in mixtures thereof, a device for marking with a fewer or a greater number of colors, or other or additional materials such as materials creating a surface for adhering marking material particles (or other substrate surface pre-treatment), a desired substrate finish quality (such as a matte, satin or gloss finish or other substrate surface post-treatment), material not visible to the unaided eye (such as magnetic particles, ultra violet-fluorescent particles, etc.) or other material associated with a marked substrate, is clearly contemplated herein.

Device 24 consists of a body 26 within which is formed a plurality of cavities 28C, 28M, 28Y, and 28K (collectively referred to as cavities 28) for receiving materials to be deposited. Also formed in body 26 may be a propellant cavity 30. A fitting 32 may be provided for connecting propellant cavity 30 to a propellant source 33 such as a compressor, a propellant reservoir, or the like. Body 26 may be connected to a print head 34, comprised of among other layers, substrate 36 and channel layer 37 that will be discussed later.

Figure 3:
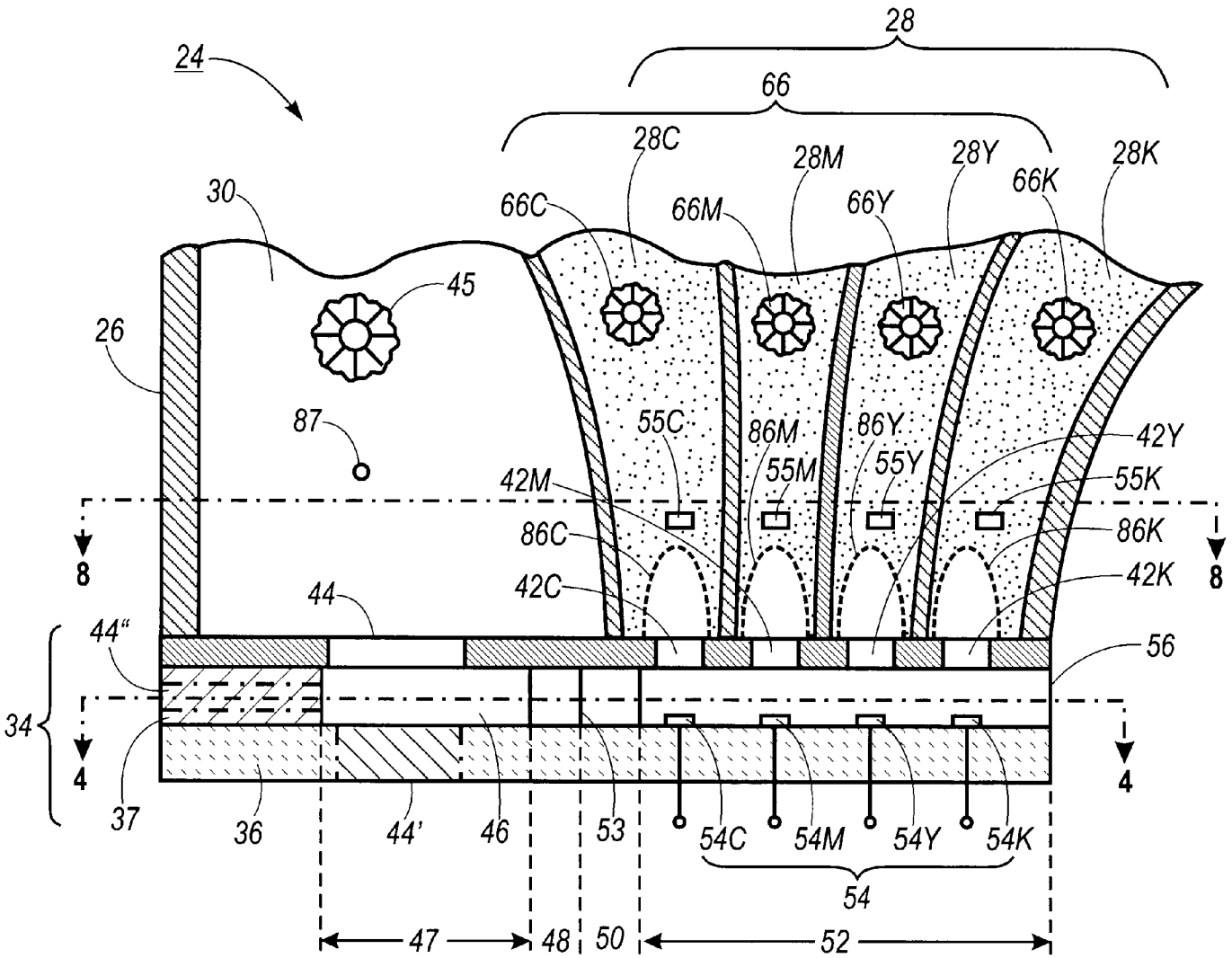
FIG. 3 is another cross sectional illustration of a marking apparatus according to one embodiment of the present invention.

With reference now to FIG. 3, shown therein is a cut-away cross section of a portion of device 24. Each of cavities 28 include a port 42C, 42M, 42Y, and 42K (collectively referred to as ports 42) respectively of circular, oval, rectangular or other cross-section, providing communication between said cavities and a channel 46 which adjoins body 26. Ports 42 are shown having a longitudinal axis roughly perpendicular to the longitudinal axis of channel 46. However, the angle between the longitudinal axes of ports 42 and channel 46 may be other than 90 degrees, as appropriate for the particular application of the present invention.

Likewise, propellant cavity 30 includes a port 44, of circular, oval, rectangular or other cross-section, between said cavity and channel 46 through which propellant may travel. Alternatively, print head 34 may be provided with a port 44' in substrate 36 or port 44" in channel layer 37, or combinations thereof, for the introduction of propellant into channel 46. As will be described further below, marking material is caused to flow out from cavities 28 through ports 42 and into a stream of propellant flowing through channel 46. The marking material and propellant are directed in the direction of arrow A toward a substrate 38, for example paper, supported by a platen 40, as shown in FIG. 2. We have experimentally demonstrated a propellant marking material flow pattern from a print head employing a number of the features described herein which remains relatively collimated for a distance of up to 10 millimeters, with an optimal printing spacing on the order of between one and several millimeters. For example, the print head produces a marking material stream which does not deviate by more than between 20 percent, and preferably by not more than 10 percent, from the width of the exit orifice for a distance of at least 4 times the exit orifice width. However, the appropriate spacing between the print head and the substrate is a function of many parameters, and does not itself form a part of the present invention.

Referring again to FIG. 3, according to one embodiment of the present invention, print head 34 consists of a substrate 36 and channel layer 37 in which is formed channel 46. Additional layers such as an insulating layer, capping layer, etc. (not shown) may also form a part of print head 34. Substrate 36 is formed of a suitable material such as glass, ceramic, etc., on which (directly or indirectly) is formed a relatively thick material, such as a thick permanent photoresist (e.g., a liquid photosensitive epoxy such as SU-8, from Microlithography Chemicals, Inc; see also U.S. Pat. Ser. No. 4,882,245) and/or a dry film-based photoresist such as the Riston photopolymer resist series, available from DuPont Printed Circuit Materials, Research Triangle Park, N.C. (see, www.dupont.com/pcm/) which may be etched, machined, or otherwise in which may be formed a channel with features described below.

Figure 4:
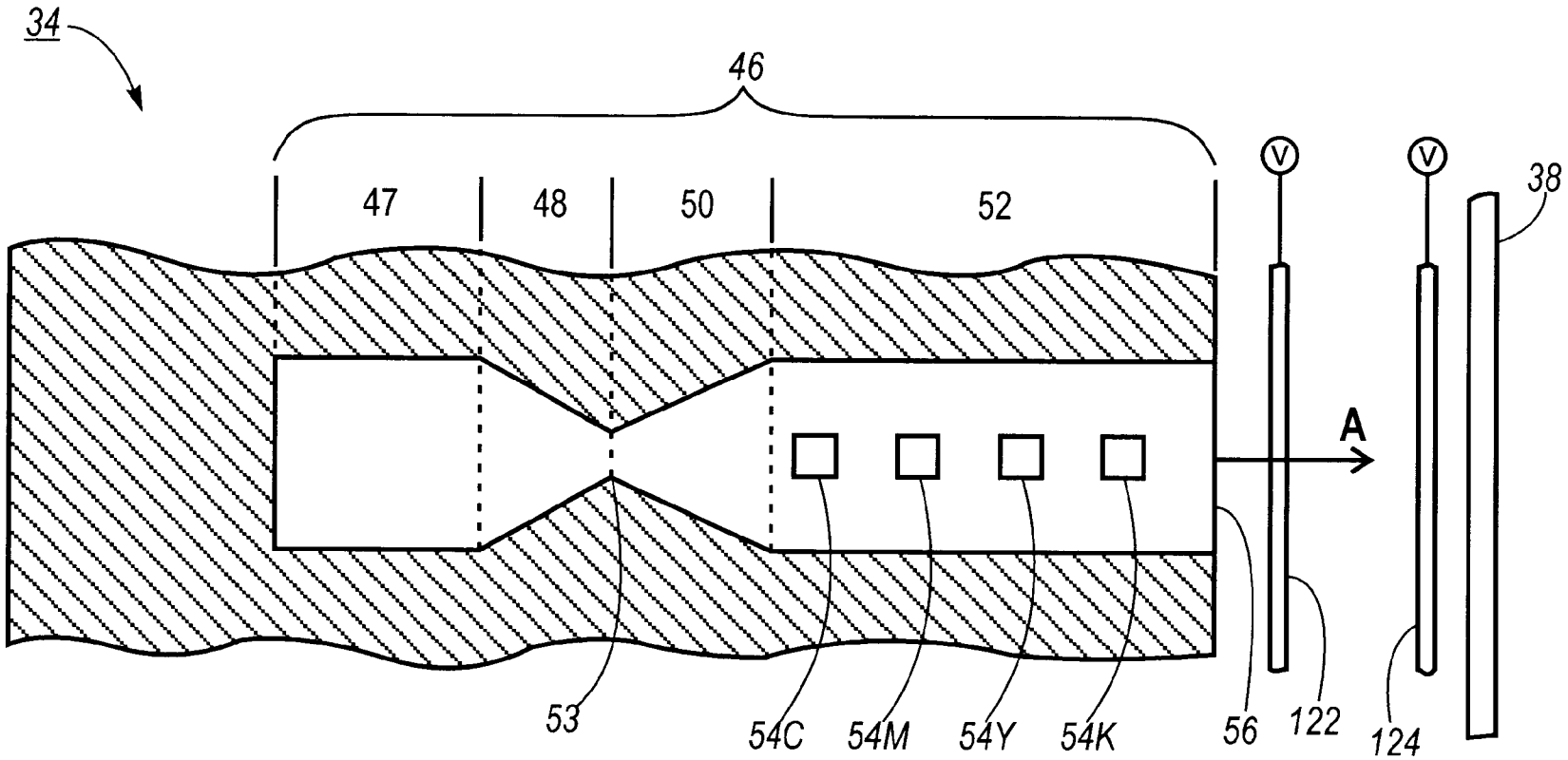
FIG. 4 is a plan view of one channel, with nozzle, of the marking apparatus shown in FIG. 3.

Referring now to FIG. 4, which is a cut-away plan view of print head 34, in one embodiment channel 46 is formed to have at a first, proximal end a propellant receiving region 47, an adjacent converging region 48, a diverging region 50, and a marking material injection region 52. The point of transition between the converging region 48 and diverging region 50 is referred to as throat 53, and the converging region 48, diverging region 50, and throat 53 are collectively referred to as a nozzle. The general shape of such a channel is sometimes referred to as a de Laval expansion pipe. An exit orifice 56 is located at the distal end of channel 46.

Figure 5A:
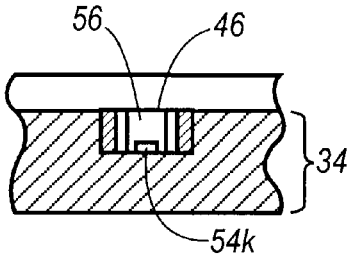
FIGS. 5A through 5F are cross sectional views, in the longitudinal direction, of several examples of channels according to the present invention.
Figure 5B:
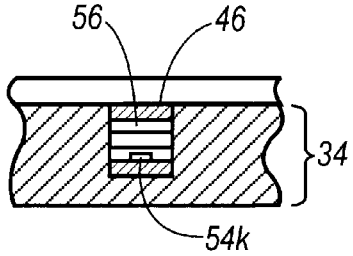
Figure 5C:
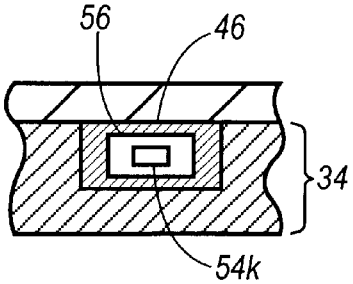
Figure 5D:
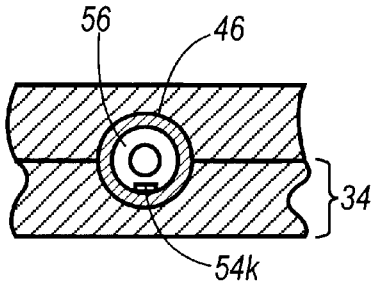
Figure 5E:
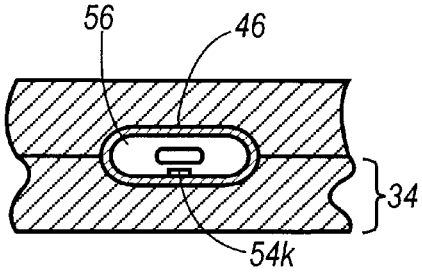
Figure 5F:
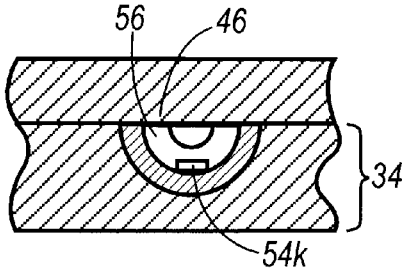

In the embodiment of the present invention shown in FIGS. 3 and 4, region 48 converges in the plane of FIG. 4, but not in the plane of FIG. 3, and likewise region 50 diverges in the plane of FIG. 4, but not in the plane of FIG. 3. Typically, this determines the cross-sectional shape of the exit orifice 56. For example, the shape of orifice 56 illustrated in FIG. 5A corresponds to the device shown in FIGS. 3 and 4. However, the channel may be fabricated such that these regions converge/diverge in the plane of FIG. 3, but not in the plane of FIG. 4 (illustrated in FIG. 5B), or in both the planes of FIGS. 3 and 4 (illustrated in FIG. 5C), or in some other plane or set of planes, or in all planes (examples illustrated in FIGS. 5D–5F) as may be determined by the manufacture and application of the present invention.

Figure 6:
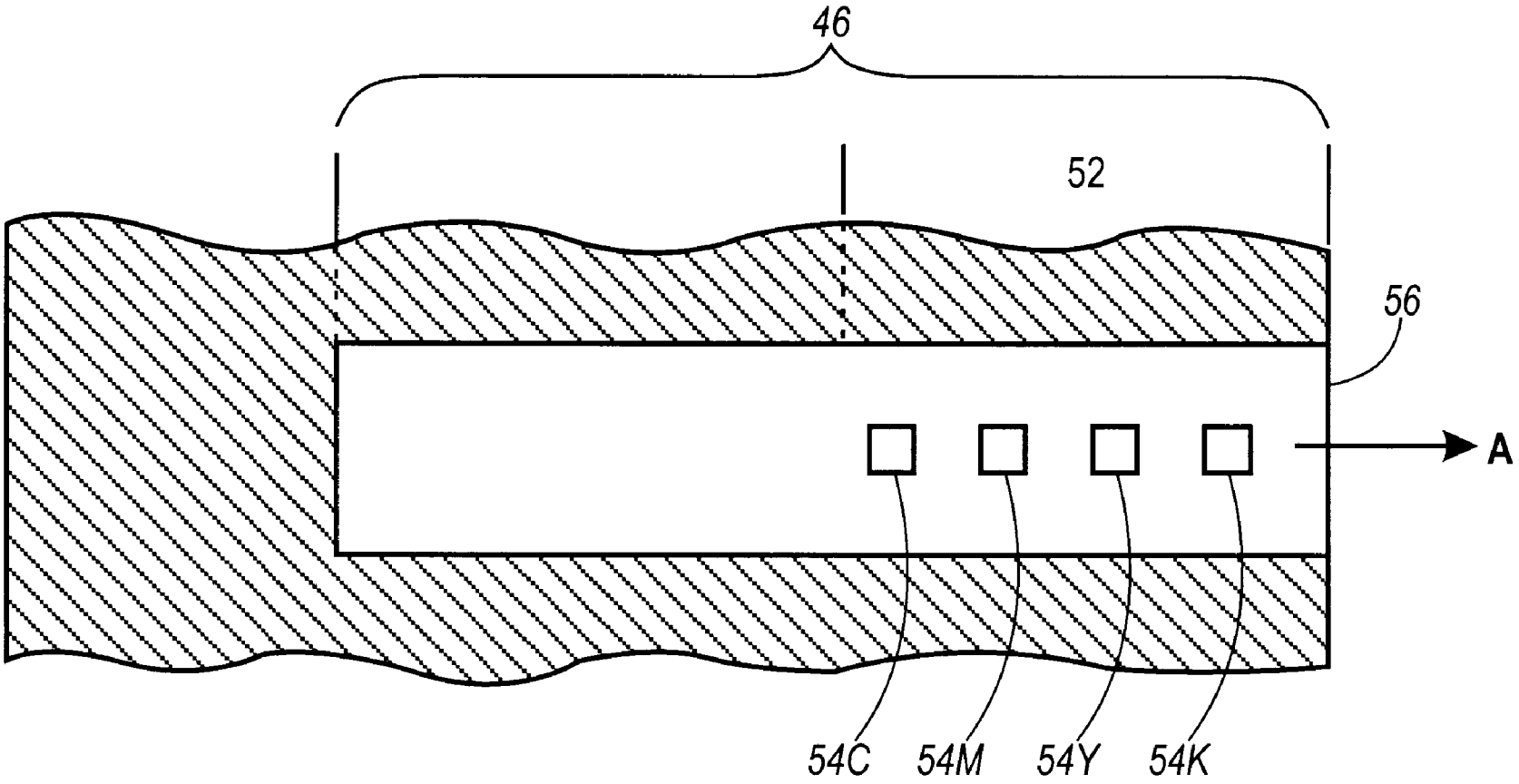
FIG. 6 is another plan view of one channel of a marking apparatus, without a nozzle, according to the present invention.
Figure 7A:
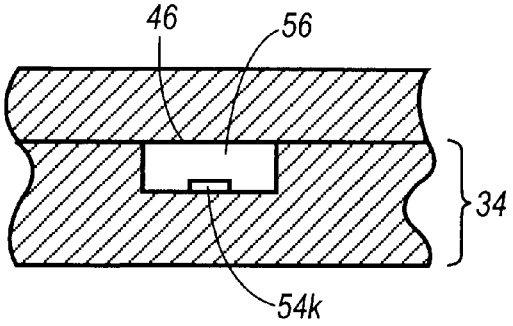
FIGS. 7A through 7D are cross sectional views, along the longitudinal axis, of several additional examples of channels according to the present invention.
Figure 7B:
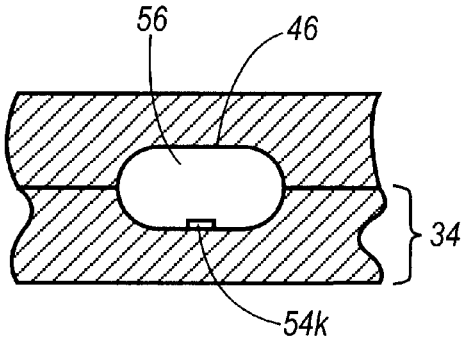
Figure 7C:
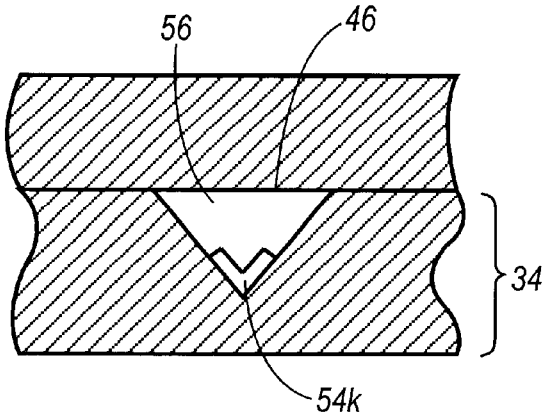
Figure 7D:
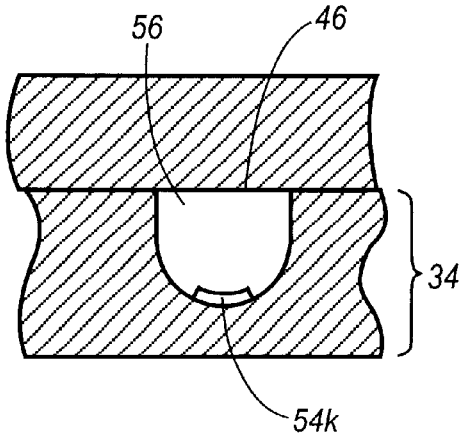

In another embodiment, shown in FIG. 6, channel 46 is not provided with a a converging and diverging region, but rather has a uniform cross section along its axis. This cross section may be rectangular or square (illustrated in FIG. 7A), oval or circular (illustrated in FIG. 7B), or other cross section (examples are illustrated in FIGS. 7C–7D), as may be determined by the manufacture and application of the present invention.

Referring again to FIG. 3, propellant enters channel 46 through port 44, from propellant cavity 30, roughly perpendicular to the long axis of channel 46. According to another embodiment, the propellant enters the channel parallel (or at some other angle) to the long axis of channel 46 by, for example, ports 44' or 44" or other manner not shown. The propellant may continuously flow through the channel while the marking apparatus is in an operative configuration (e.g., a "power on" or similar state ready to mark), or may be modulated such that propellant passes through the channel only when marking material is to be ejected, as dictated by the particular application of the present invention. Such propellant modulation may be accomplished by a valve 31 interposed between the propellant source 33 and the channel 46, by modulating the generation of the propellant for example by turning on and off a compressor or selectively initiating a chemical reaction designed to generate propellant, or by other means not shown.

Marking material may controllably enter the channel through one or more ports 42 located in the marking material injection region 52. That is, during use, the amount of marking material introduced into the propellant stream may be controlled from zero to a maximum per spot. The propellant and marking material travel from the proximal end to a distal end of channel 46 at which is located exit orifice 56.

Figure 40A:
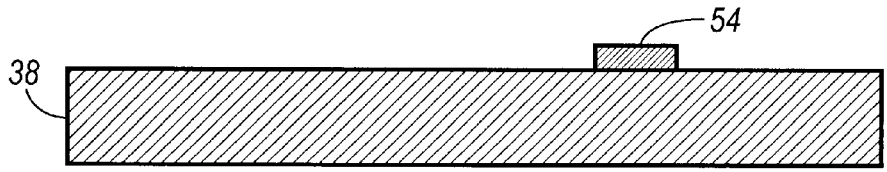
FIGS. 40A–F are illustrations of one process for producing a print head according to the present invention.

Print head 34 may be formed by one of a wide variety of methods. As an example, and with reference to FIGS. 40A–F, print head 34 may be manufactured as follows. Initially, a substrate 38, for example an insulating substrate such as glass or a semi-insulating substrate such as silicon, or alternatively an arbitrary substrate coated with an insulating layer, is cleaned and otherwise prepared for lithography. One or more metal electrodes 54 may be formed on (e.g., photolithographically) or applied to a first surface of substrate 38, which shall form the bottom of a channel 46. This is illustrated in FIG. 40A.

Figure 40B:
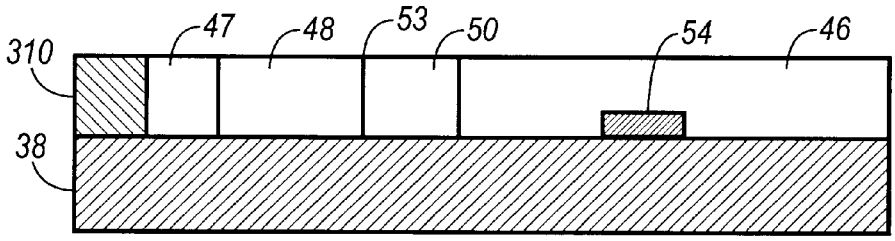
Figure 40C:
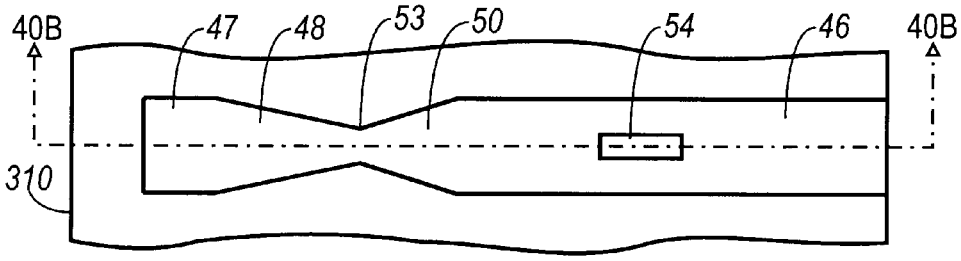

Next, a thick photoresist such as the aforementioned SU-8 is coated over substantially the entire substrate, typically by a spin-on process, although layer 310 may be laminated as an alternative. Layer 310 will be relatively quite thick, for example on the order of 100 $\mu$m or thicker. This is illustrated in FIG. 40B. Well known processes such as lithography, ion milling, etc., are next employed to form a channel 46 in layer 310, preferably with a converging region 48, diverging region 50, and throat 53. The structure at this point is shown in a plan view in FIG. 40C.

At this point, one alternative is to machine an inlet 44' (shown in FIG. 3) for propellant through the substrate in propellant receiving region 47. This may be accomplished by diamond drilling, ultrasonic drilling, or other technique well known in the art as a function of the selected substrate material. Alternatively, a propellant inlet 44" (shown in FIG. 3) may be formed in layer 310. However, a propellant inlet 44 may be formed in a subsequently applied layer, as described following.

Figure 40D:
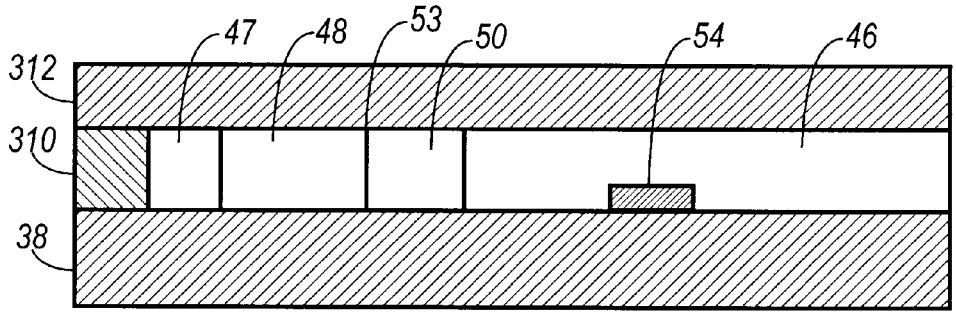

Applied directly on top of layer 310 is another relatively thick layer of photoresist 312, this preferably the aforementioned Riston or similar material. Layer 312 is preferably on the order of 100 $\mu$m thick or thicker, and is preferably applied by lamination, although it may alternatively be spun on or otherwise deposited. Layer 312 may alternatively be glass (such as Corning 7740) or other appropriate material bonded to layer 310. The structure at this point is illustrated in FIG. 40D.

Figure 40E:
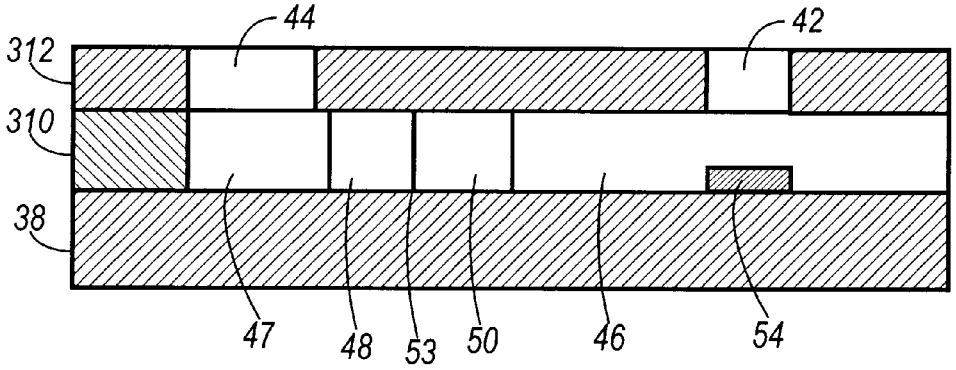

Layer 312 is then patterned, for example by photolithography, ion milling, etc. to form ports 42 and 44. Layer 312 may also be machined, or otherwise patterned by methods known in the art. The structure at this point is shown in FIG. 40E.

One alternative to the above is to form channel 46 directly in the substrate, for example by photolithography, ion milling, etc. Layer 312 may still be applied as described above. Still another alternative is to form the print head from acrylic, or similar moldable and/or machinable material with channel 46 molded or machined therein. In addition to the above, layer 312 may also be a similar material in this embodiment, bonded by appropriate means to the remainder of the structure.

Figure 40F:
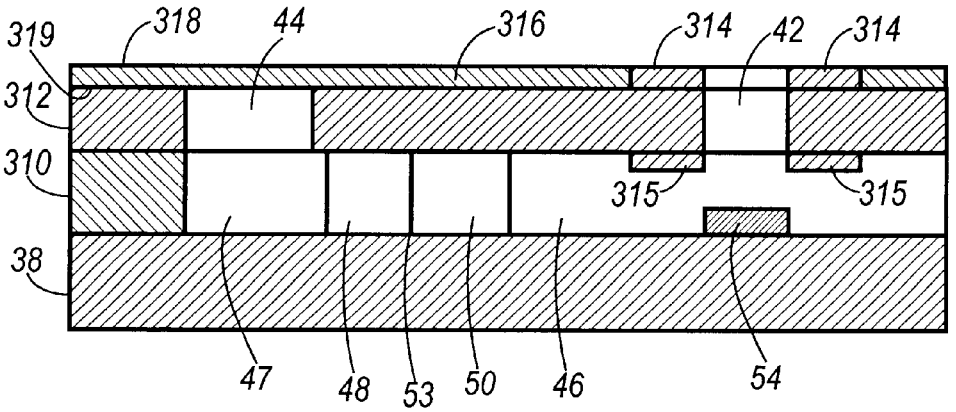

A supplement to the above is to preform electrodes 314 and 315, which may be rectangular, annular (shown), or other shape in plan form, on layer 312 prior to applying layer 312 over layer 310. In this embodiment, port 42, and possibly port 44, will also be preformed prior to application of layer 312. Electrodes 314 may be formed by sputtering, lift-off, or other techniques, and may be any appropriate metal such as aluminum or the like. A dielectric layer 316 may be applied to protect the electrodes 314 and provide a planarized upper surface 318. A second dielectric layer (not shown) may similarly be applied to a lower surface 319 of layer 312 to similarly protect electrode 315 and provide a planarized lower surface. The structure of this embodiment is shown in FIG. 40F.

Figure 8A:
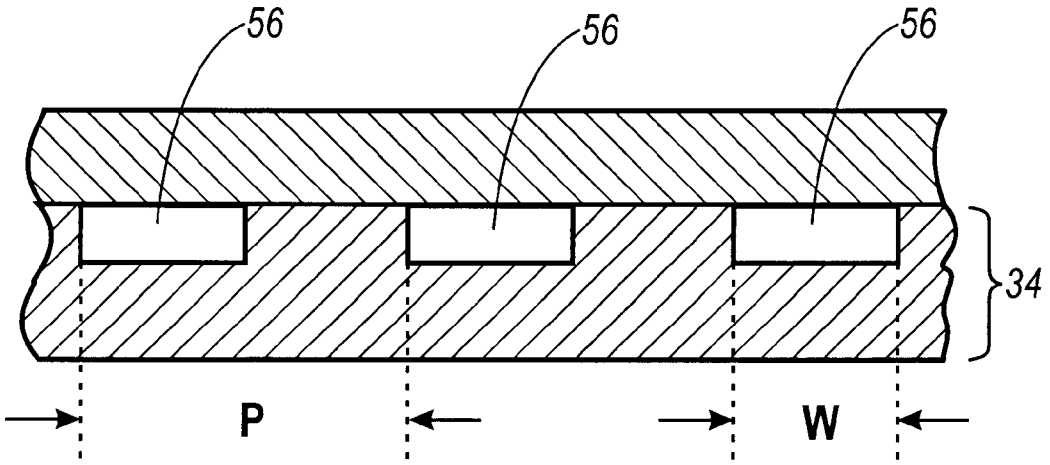
FIGS. 8A and 8B are end views of non-staggered and two-dimensionally staggered arrays of channels according to the present invention.
Figure 8B:
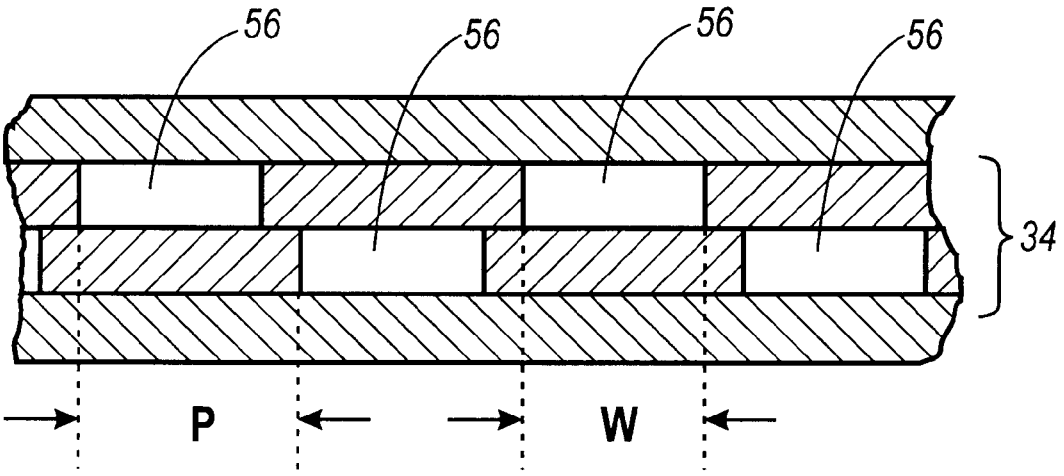

While FIGS. 4–7 illustrate a print head 34 having one channel therein, it will be appreciated that a print head according to the present invention may have an arbitrary number of channels, and range from several hundred micrometers across with one or several channels, to a page-width (e.g., 8.5 or more inches across) with thousands of channels. The width W of each exit orifice 56 may be on the order of 250 $\mu$m or smaller, preferably in the range of 100 $\mu$m or smaller. The pitch P, or spacing from edge to edge (or center to center) between adjacent exit orifices 56 may also be on the order of 250 $\mu$m or smaller, preferably in the range of 100 $\mu$m or smaller in non-staggered array, illustrated in end view in FIG. 8A. In a two-dimensionally staggered array, of the type shown in FIG. 8B, the pitch may be further reduced. For example, Table 1 illustrates typical pitch and width dimensions for different resolutions of a non-staggered array.

TABLE 1

| Resolution | Pitch | Width |
|---|---|---|
| 300 | 84 | 60 |
| 600 | 42 | 30 |
| 900 | 32 | 22 |
| 1200 | 21 | 15 |

Figure 9:
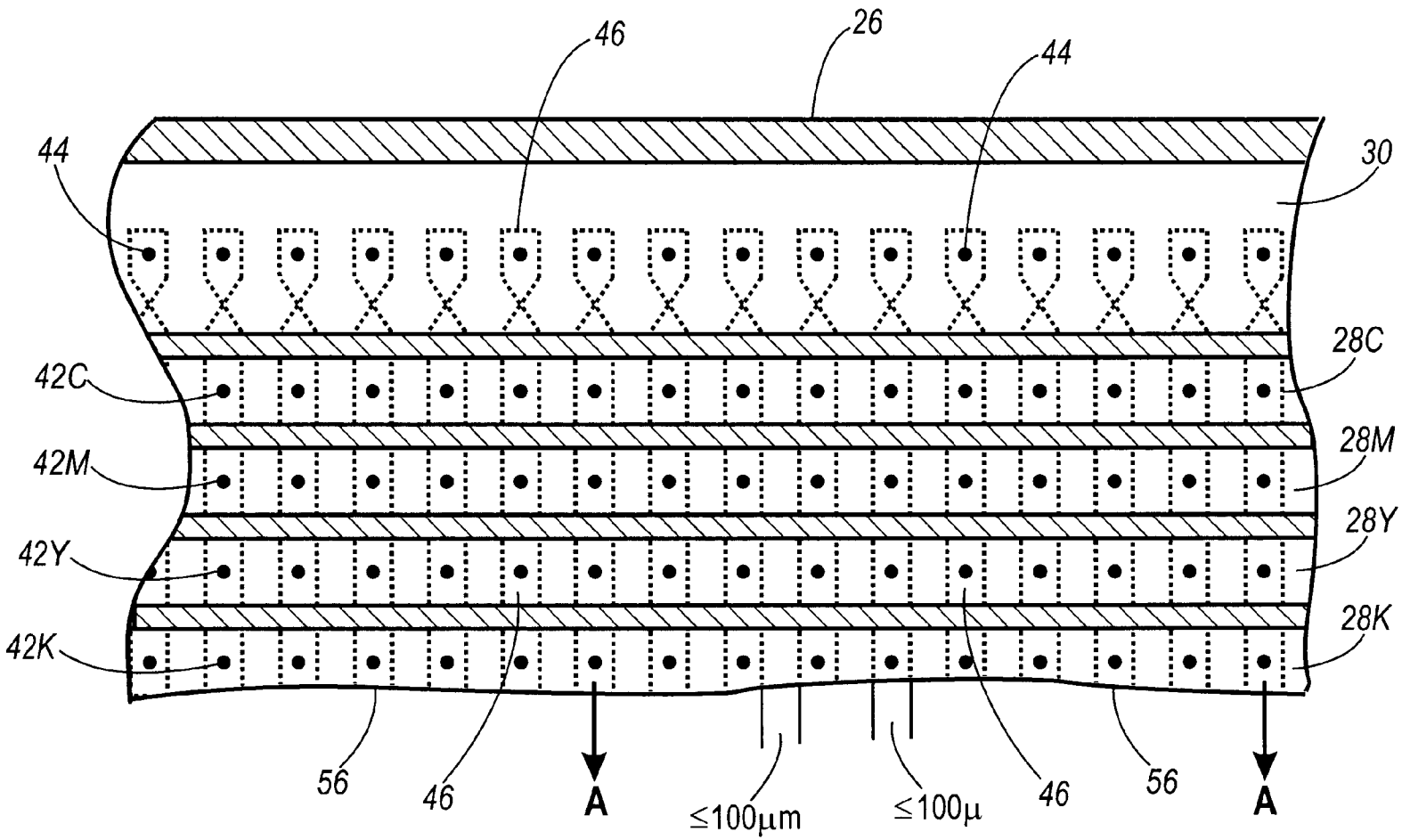
FIG. 9 is a plan view of an array of channels of an apparatus according to one embodiment of the present invention.
Figure 10A:
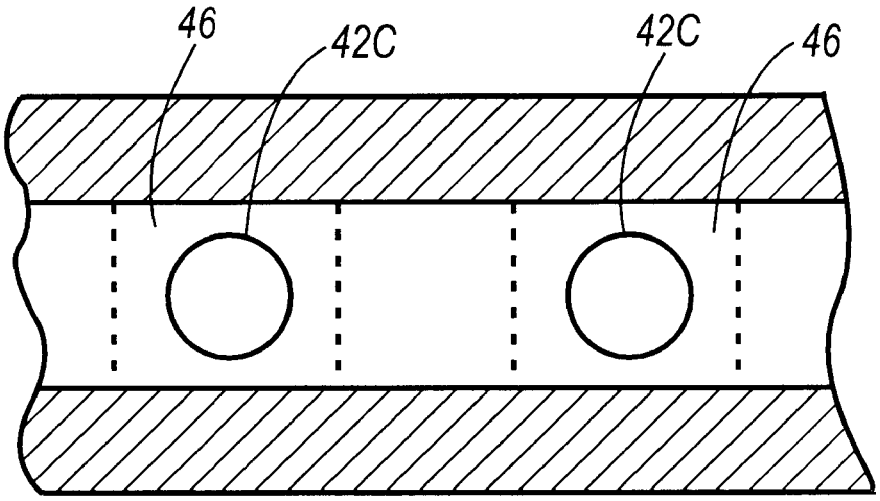
FIGS. 10A and 10B are plan views of a portion of the array of channels shown in FIG. 9, illustrating two embodiments of ports according to the present invention.
Figure 10B:
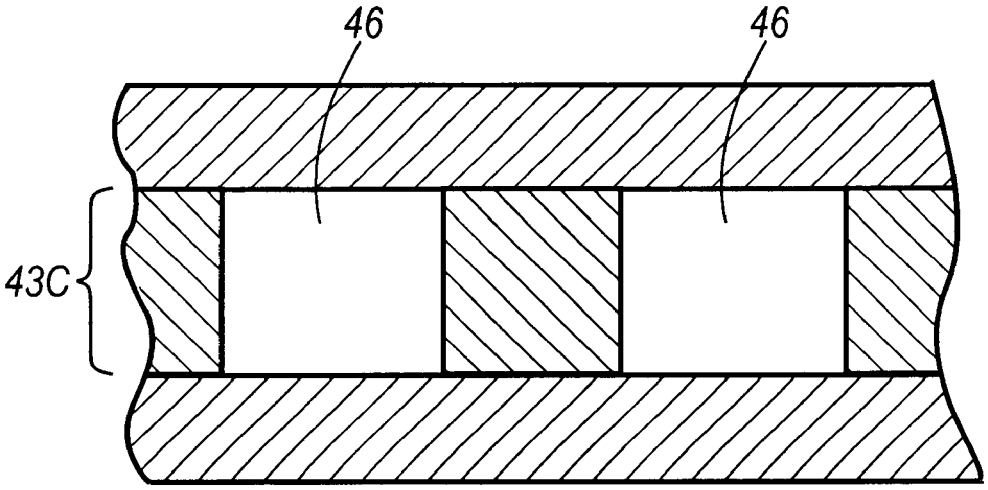

As illustrated in FIG. 9, a wide array of channels in a print head may be provided with marking material by continuous cavities 28, with ports 42 associated with each channel 46. Likewise, a continuous propellant cavity 30 may service each channel 46 through an associated port 44. Ports 42 may be discrete openings in the cavities, as illustrated in FIG. 10A, or may be formed by a continuous opening 43 (illustrated by one such opening 43C) extending across the entire array, as illustrated in FIG. 10B.

In an array of channels 46, each channel may have similar dimensions and cross-sectional profiles so as to obtain identical or nearly identical propellant velocities therethrough. Alternatively, other arrays of channels 46 arranged in tandem in the process direction may be made to have different dimensions and/or cross sectional profiles to (or by other means such as selectively applied coatings or the like) provide channels having different propellant velocities. This may prove advantageous when seeking to employ different marking materials having significantly different masses, when seeking to have different marking effects, in the co-application of marking materials and other substrate treatment, or as might otherwise prove appropriate in a particular application of the present invention.

Figure 11A:
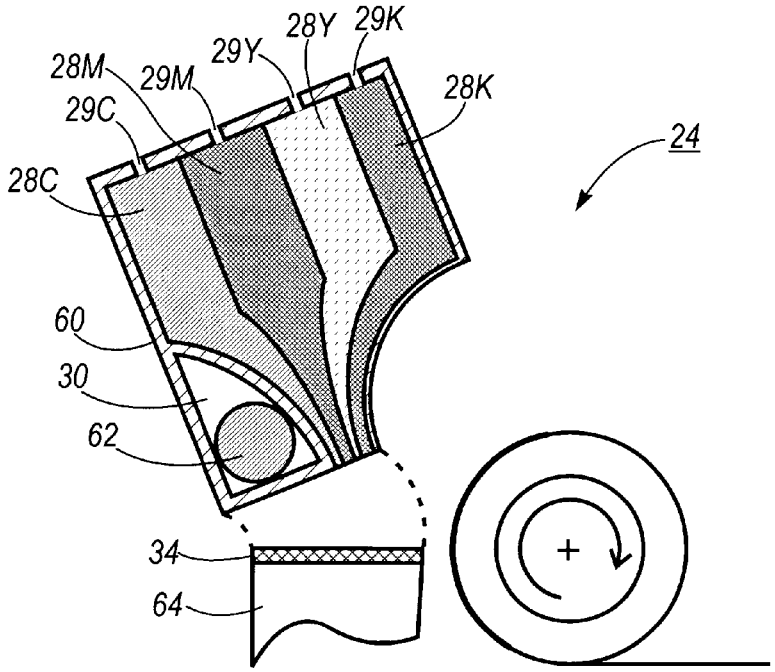
FIGS. 11A and 11B are cross sectional illustrations of a marking apparatus with a removable body according to two different embodiments of the present invention.
Figure 11B:
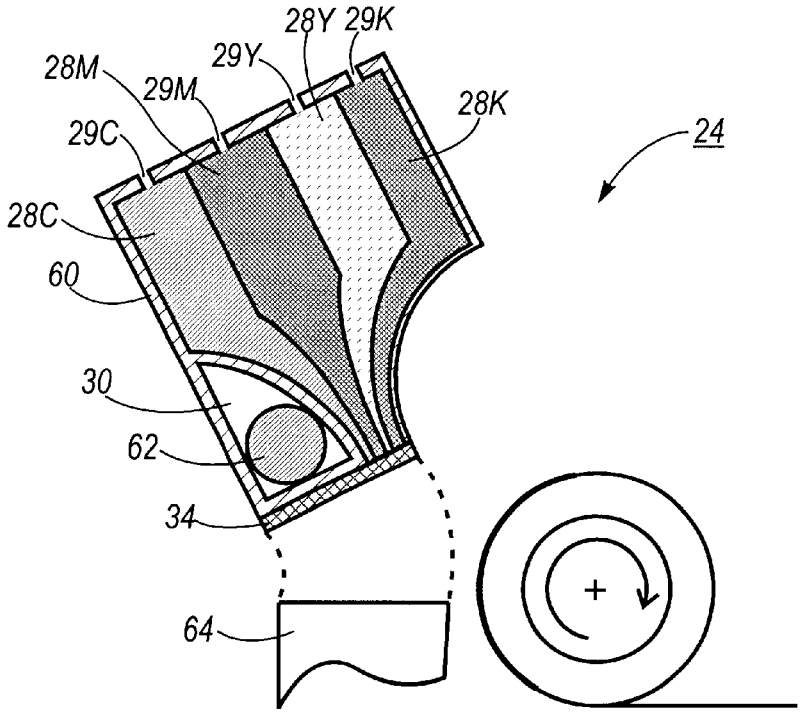

According to embodiments shown in FIGS. 11A and 11B, device 24 includes a replacably removable body 60, retained to device 24 by operable means such as clips, clasps, catches, or other retaining means well known in the art (not shown). In the w embodiment shown in FIG. 11A, body 60 is removable from print head 34 and the other components of device 24. In the embodiment shown in FIG. 11B, body 60 and print head 34 form a unit replaceable removable from a mounting region 64 of device 24. In either embodiment of FIGS. 11A or 11B, electrical contacts may be provided between body 60 and device 24 for control of electrodes and other apparatus carried by or associated with body 60.

In either case, body 60 may be a disposable cartridge carrying marking material and propellant, as described in the aforementioned application 09/163,765. Alternatively, the marking material and/or propellant cavities 28, 30 may be refillable. For example, openings 29C, 29M, 29Y, and 29K (collectively referred to as openings 29) may be provided for the introduction of marking material into respective cavities. Also, cavity 30 may carry a propellant source 62, such as solid carbon dioxide ($CO_2$), compressed gas cartridge (again such as $CO_2$), chemical reactants, etc. permanently, replacably removably, or refillably in body 60. Alternatively, cavity 30 may carry a compact compressor or similar means (not shown) for generating a pressurized propellant. As a still further alternative, the propellant source may be removable and replaceable separately and independently from body 60. Furthermore, device 24 may be provided with a means for generating propellant, such as a compressor, chemical reaction chamber, etc., in which case body 60 bears only cavities 28 and related components.

Device Operation

Figure 12:
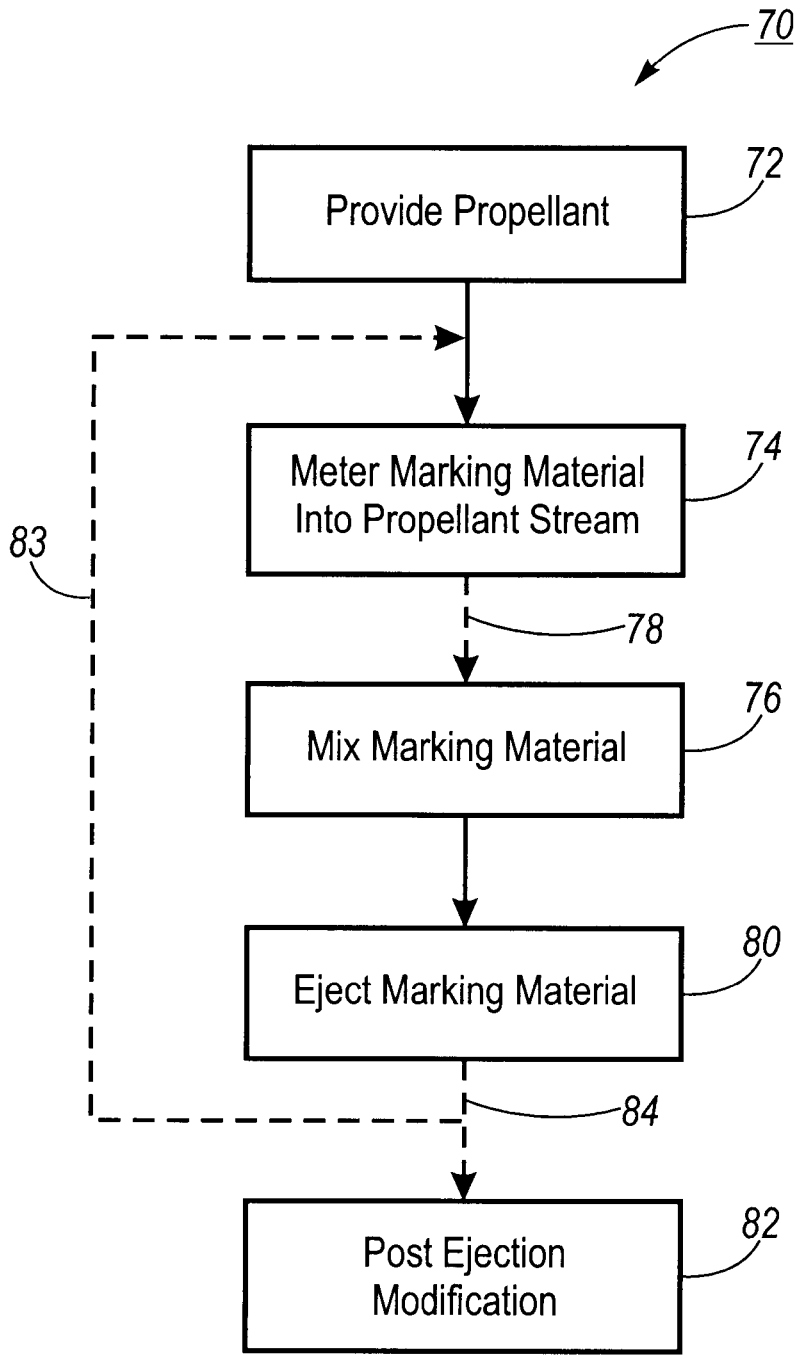
FIG. 12 is a process flow diagram for the marking of a substrate according to the present invention.

The process 70 involved in the marking of a substrate with marking material according to the present invention is illustrated by the steps shown in FIG. 12. According to step 72, a propellant is provided to a channel. A marking material is next metered into the channel at step 74. In the event that the channel is to provide multiple marking materials to the substrate, the marking materials may be mixed in the channel at step 76 so as to provide a marking material mixture to the substrate. By this process, one-pass color marking, without the need for color registration, may be obtained. An alternative for one-pass color marking is the sequential introduction of multiple marking materials while maintaining a constant registration between print head 34 and substrate 38. Since, not every marking will be composed of multiple marking materials, this step is optional as represented by the dashed arrow 78. At step 80, the marking material is ejected from an exit orifice at a distal end of the channel, in a direction toward, and with sufficient energy to reach a substrate. The process may be repeated with reregistering the print head, as indicated by arrow 83. Appropriate post ejection treatment, such as fusing, drying, etc. of the marking material is performed at step 82, again optional as indicated by the dashed arrow 84. Each of these steps will be discussed in further detail.

Providing Propellant

As previously mentioned, the role of the propellant is to impart the marking material with sufficient kinetic energy that the marking material at least impinges upon the substrate. The propellant may be provided by a compressor, refillable or non-refillable reservoir, material phase-change (e.g., solid to gaseous $CO_2$), chemical reaction, etc. associated with or separate from the print head, cartridge, or other elements of marking device 24. In any event, the propellant must be dry and free of contaminants, principally so as not to interfere with the marking of the substrate by the marking material and so as not to cause or induce clogging of the channel. Thus, an appropriate dryer and/or filter (not shown) may be provided between the propellant source and the channel.

In one embodiment, the propellant is provided by a compressor of a type well known. This compressor ideally rapidly turns on to provide a steady state pressure or propellant. It may, however, be advantageous to employ a valve between the compressor and the channel so as to permit only propellant at operating pressure and velocity to enter into channel 46.

While such an embodiment contemplates connecting the channel to an external compressor or similar external propellant source, there may be a need for the propellant to be generated by device 24 itself. Indeed, for a compact, desktop type device, a compact propellant source must be employed. One approach would be to employ commonly available replaceable $CO_2$ cartridges in the device. However, such cartridges provide a comparatively small volume of propellant, and would need frequent replacing. And while it may also be possible to provide larger pressurized propellant containers, the size of the device (e.g., a compact, desk-top printer) may limit the propellant container size. Thus, a self-contained, physically small propellant generation unit would be employed. According to this embodiment, it would also then be possible to provide a replaceable combined propellant and marking material cartridge.

In another embodiment, the propellant is provided by means of a reaction. One goal of this embodiment is to provide a compact propellant source, of the type, for example, which may be included within a propellant cavity 30. There are a great variety of spontaneous and non-spontaneous reactions of liquid or solid chemicals or compounds, thus being relatively compact, which produce gases. In the most simple, a reactant is heated to above its boiling point, producing a gas phase material. When the reaction or change occurs in a confined volume, a pressure change results within the volume. So, for a closed volume, one species of reaction is:

$$(R)_{P1} \xrightarrow[\Delta T^+]{} (R)_{P2}$$

where R is reactant, P1 and P2 are pressure, and P2 is much greater than P1. To accomplish this, a heating element (such as a filament 87 shown in FIG. 3) may be provided within propellant cavity 30 (or other reactant containing volume).

A variant of this is non-spontaneous multiple reactant systems which may be heat activated, such as:

$$(R_1 + R_2 + \ldots)_{P1} \xrightarrow[\Delta T^+]{} (R_3 + R_4 + \ldots)_{P2}$$

where $R_1$–$R_{\ldots}$ are reactants, and again P2 is much greater than P1.

However, to avoid the effects which providing a heated propellant may have on the marking material (e.g., melting within the channel, which could lead to clogging of the channels) it may be more desirable to employ a reaction less dependent on added heat (and not overly exothermic), such as:

$$(R)_{P1} \rightarrow (R)_{P2}$$

as might occur in a phase change at room temperature (e.g., solid to gaseous $CO_2$), or $$(R_1+R_2+\ldots)_{P1} \rightarrow (R_3+R_4+\ldots)_{P2}$$

There are many such reactions known in the art which may be employed to produce a gaseous propellant.

In general, the reaction may be moderatable, in that it may be possible to initiate and terminate the reaction at arbitrary times as a means for permitting the device to the turned on and off. Alternatively, the reaction may take place in a propellant cavity in communication with the channel 46 via a valve for modulating the flow of propellant. In general, in this embodiment it may also be necessary to provide a valve for regulating the propellant to a selected operating pressure.

The velocity and pressure at which the propellant must be provided depends on the embodiment of the marking device as explained below. In general, examples of appropriate propellants include $CO_2$, clean and dry air, $N_2$, gaseous reaction products, etc. Preferably, the propellant should be non-toxic (although in certain embodiments, such as devices enclosed in special chamber or the like, a broader range of propellants may be tolerated). Preferably, the propellant should be gaseous at room temperature, but gases at elevated temperatures may be used in appropriate embodiments.

However generated or provided, the propellant enters channel 46 and travels longitudinally through the channel so as to exit at exit orifice 56. Channel 46 is oriented such that the propellant stream exiting exit orifice 56 is directed toward the substrate.

Marking Material

According to one embodiment of the present invention a solid, particulate marking material is employed for marking a substrate. The marking material particles may be on the order of 0.5 to 10.0 $\mu$m, preferably in the range of 1 to 5 $\mu$m, although sizes outside of these ranges may function in specific applications (e.g., larger or smaller ports and channels through which the particles must travel).

There are several advantages provided by the use of solid, particulate marking material. First, clogging of the channel is minimized as compared, for example, to liquid inks. Second, wicking and running of the marking material (or its carrier) upor the substrate, as well as marking material/substrate interaction may be reduced or eliminated. Third, spot position problems encountered with liquid marking material caused by surface tension effects at the exit orifice are eliminated. Fourth, channels blocked by gas bubbles retained by surface tension are eliminated. Fifth, multiple marking materials (e.g., multiple colored toners) can be mixed upon introduction into a channel for single pass multiple material (e.g., multiple color) marking, without the risk of contaminating the channel for subsequent markings (e.g., pixels). Registration overhead (equipment, time, related print artifacts, etc.) is thereby eliminated. Sixth, the channel refill portion of the duty cycle (up to 80% of a TIJ duty cycle) is eliminated. Seventh, there is no need to limit the substrate throughput rate based on the need to allow a liquid marking material to dry.

However, despite any advantage of a dry, particulate marking material, there may be some applications where the use of a liquid marking material, or a combination of liquid and dry marking materials, may be beneficial. In such instances, the present invention may be employed, with simply a substitution of the liquid marking material for the solid marking material and appropriate process and device changes apparent to one skilled in the art or described herein, for example substitution of metering devices, etc.

In certain applications of the present invention, it may be desirable to apply a substrate surface pre-marking treatment. For example, in order to assist with the fusing of particulate marking material in the desired spot locations, it may be beneficial to first coat the substrate surface with an adherent layer tailored to retain the particulate marking material. Examples of such material include clear and/or colorless polymeric materials such as homopolymers, random copolymers or block copolymers that are applied to the substrate as a polymeric solution where the polymer is dissolved in a low boiling point solvent. The adherent layer is applied to the substrate ranging from 1 to 10 microns in thickness or preferably from about 5 to 10 microns thick. Examples of such materials are polyester resins either linear or branched, poly(styrenic) homopolymers, poly(acrylate) and poly (methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates and mixtures thereof and the like. This surface pre-treatment may be applied from channels of the type described herein located at the leading edge of a print head, and may thereby apply both the pre-treatment and the marking material in a single pass. Alternatively, the entire substrate may be coated with the pre-treatment material, then marked as otherwise described herein. See U.S. patent application Ser. No. 08/041,353, incorporated herein by reference. Furthermore, in certain applications it may be desirable to apply marking material and pre-treatment material simultaneously, such as by mixing the materials in flight, as described further herein.

Likewise, in certain applications of the present invention, it may be desirable to apply a substrate surface post-marking treatment. For example, it may be desirable to provide some or all of the marked substrate with a gloss finish. In one example, a substrate is provided with marking comprising both text and illustration, as otherwise described herein, and it is desired to selectively apply a gloss finish to the illustration region of the marked substrate, but not the text region. This may be accomplished by applying the post-marking treatment from channels at the trailing edge of the print head, to thereby allow for one-pass marking and post-marking treatment. Alternatively, the entire substrate may be marked as appropriate, then passed through a marking device according to the present invention for applying the post-marking treatment. Furthermore, in certain applications it may be desirable to apply marking material and post-treatment material simultaneously, such as by mixing the materials in flight, as described further herein. Examples of materials for obtaining a desired surface finish include polyester resins either linear or branched, poly (styrenic) homopolymers, poly(acrylate) and poly (methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates, and mixtures thereof and the like.

Other pre- and post-marking treatments include the underwriting/overwriting of markings with marking material not visible to the unaided eye, document tamper protection coatings, security encoding, for example with wavelength specific dyes or pigments that can only be detected at a specific wavelength (e.g., in the infrared or ultraviolet range) by a special decoder, and the like. See U.S. Pat. Nos. 5,208,630, 5,385,803, and 5,554,480, each incorporated herein by reference. Still other pre- and post-marking treatments include substrate or surface texture coatings (e.g. to create embossing effects, to simulate an arbitrarily rough or smooth substrate), materials designed to have a physical or chemical reaction at the substrate (e.g., two materials which, when combined at the substrate, cure or otherwise cause a reaction to affix the marking material to the substrate), etc. It should be noted, however, that references herein to apparatus and methods for transporting, metering, containing, etc. marking material should be equally applicable to pre- and post-marking treatment material (and in general, to other non-marking material) unless otherwise noted or as may be apparent to one skilled in the art.

Figure 33:
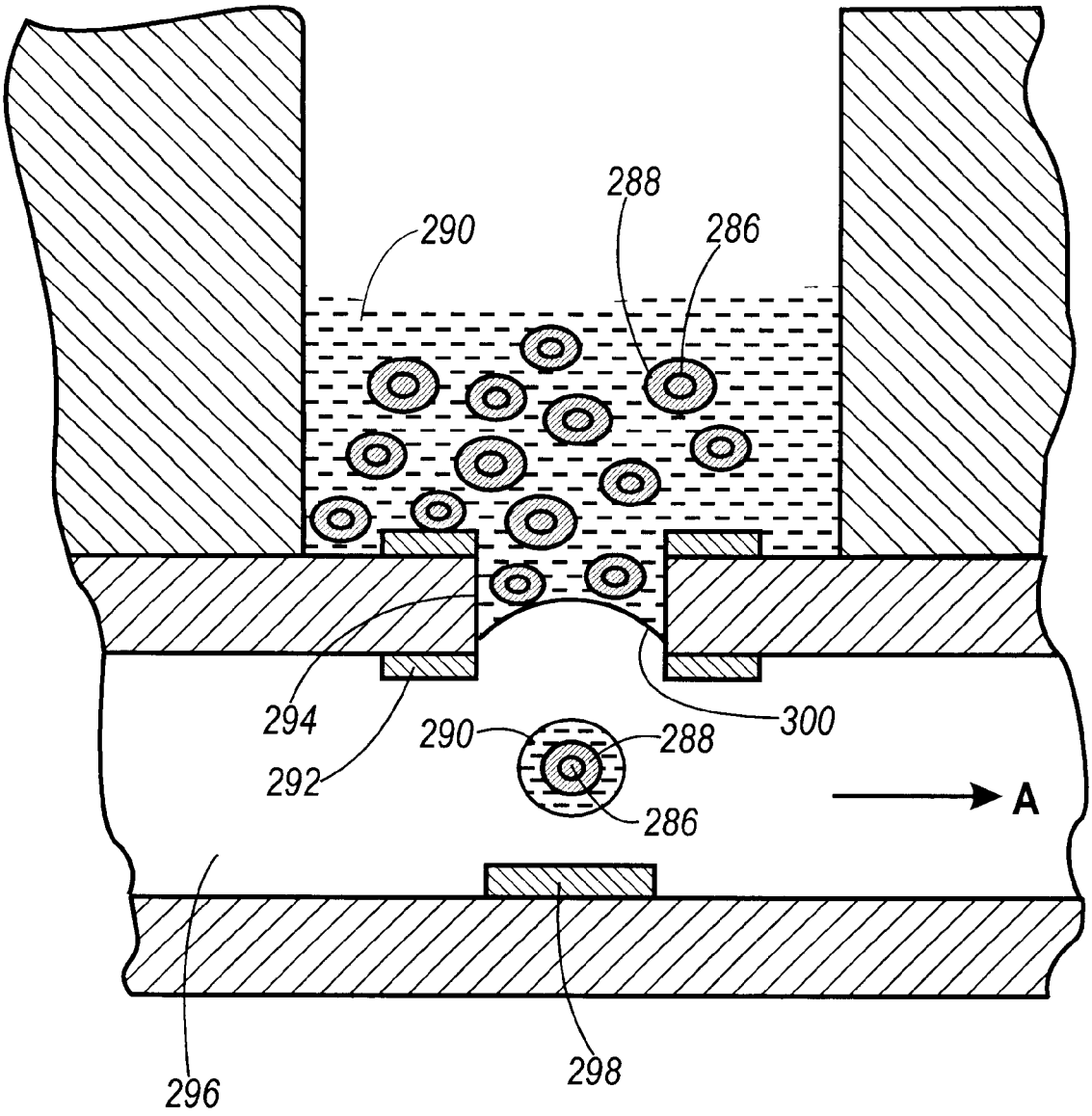
FIG. 33 is cross sectional illustration of one embodiment of the present invention employing solid marking material particles suspended in a liquid carrier medium.

As has been alluded to, marking material may be either solid particulate material or liquid. However, within this set there are several alternatives. For example, apart from a mere collection of solid particles, a solid marking material may be suspended in a gaseous (i.e., aerosol) or liquid carrier. Other examples include multi-phase materials. With reference to FIG. 33, in one such material, solid marking material particles 286 are suspended in discrete agglomerations of a liquid carrier medium 288. The combined particles and enveloping carrier may be located in a pool 290 of the carrier medium. The carrier medium may be a colorless dielectric which lends liquid flow properties to the marking material. The solid marking material particles 286 may be on the order of 1–2 $\mu$m, and provided with a net charge. By way of a process discussed further below, the charged marking material particles 286 may be attracted by the field generated by appropriate electrodes 292 located proximate the port 294, and directed into channel 296. A supplemental electrode 298 may assist with the extraction of the marking material particles 286. A meniscus 300 forms at the channel side of port 294. When the particle 286/carrier 288 combination is pulled through the meniscus 300, surface tension causes particle 286 to pull out of the carrier medium 288 leaving only a thin film of carrier medium on the surface of the particle. This thin film may be beneficially employed, in that it may cause adhesion of the particle 286 to most substrate types, especially at low velocity, allowing for particle position retention prior to post-ejection modification (e.g., fusing).

Metering Marking Material

The next step in the marking process typically is metering the marking material into the propellant stream. While the following specifically discusses the metering of marking material, it will be appreciated that the metering of other material such as the aforementioned pre- and post-marking treatment materials is also contemplated by this discussion, and references following which exclusively discuss marking material do so for simplicity of discussion only. Metering, then, may be accomplished by one of a variety of embodiments of the present invention.

According to a first embodiment for metering the marking material, the marking material includes material which may be imparted with an electrostatic charge. For example, the marking material may be comprised of a pigment suspended in a binder together with charge capture or control additives. The charge capture additives may be charged, for example by way of a corona 66C, 66M, 66Y, and 66K (collectively referred to as coronas 66), located in cavities 28, shown in FIG. 3. Another alternative is to initially charge the propellant gas, e.g., by way of a corona 45 in cavity 30 (or some other appropriate location such as port 44, etc.) The charged propellant may be made to enter into cavities 28 through ports 42, for the dual purposes of creating a fluidized bed 86C, 86M, 86Y, and 86K (collectively referred to as fluidized bed 86, and discussed further below), and imparting a charge to the marking material. Other alternatives include tribocharging, by other means external to cavities 28, or other mechanism.

Referring again to FIG. 3, formed at one surface of channel 46, opposite each of the ports 42 are electrodes 54C, 54M, 54Y, and 54K (collectively referred to as electrodes 54). Formed within cavities 28 (or some other location such as at or within ports 44) are corresponding counter-electrodes 55C, 55M, 55Y, and 55K (collectively referred to as counter-electrodes 55). When an electric field is generated by electrodes 54 and counter-electrodes 55, the charged marking material may be attracted to the field, and exits cavities 28 through ports 42 in a direction roughly perpendicular to the propellant stream in channel 46. The shape and location of the electrodes and the charge applied thereto, determine the strength of the electric field, and hence the force of the injection of the marking material into the propellant stream. In general, the force injecting the marking material into the propellant stream is chosen such that the momentum provided by the force of the propellant stream on the marking material overcomes the injecting force, and once into the propellant stream in channel 46, the marking material travels with the propellant stream out of exit orifice 56 in a direction towards the substrate.

Figure 13A:
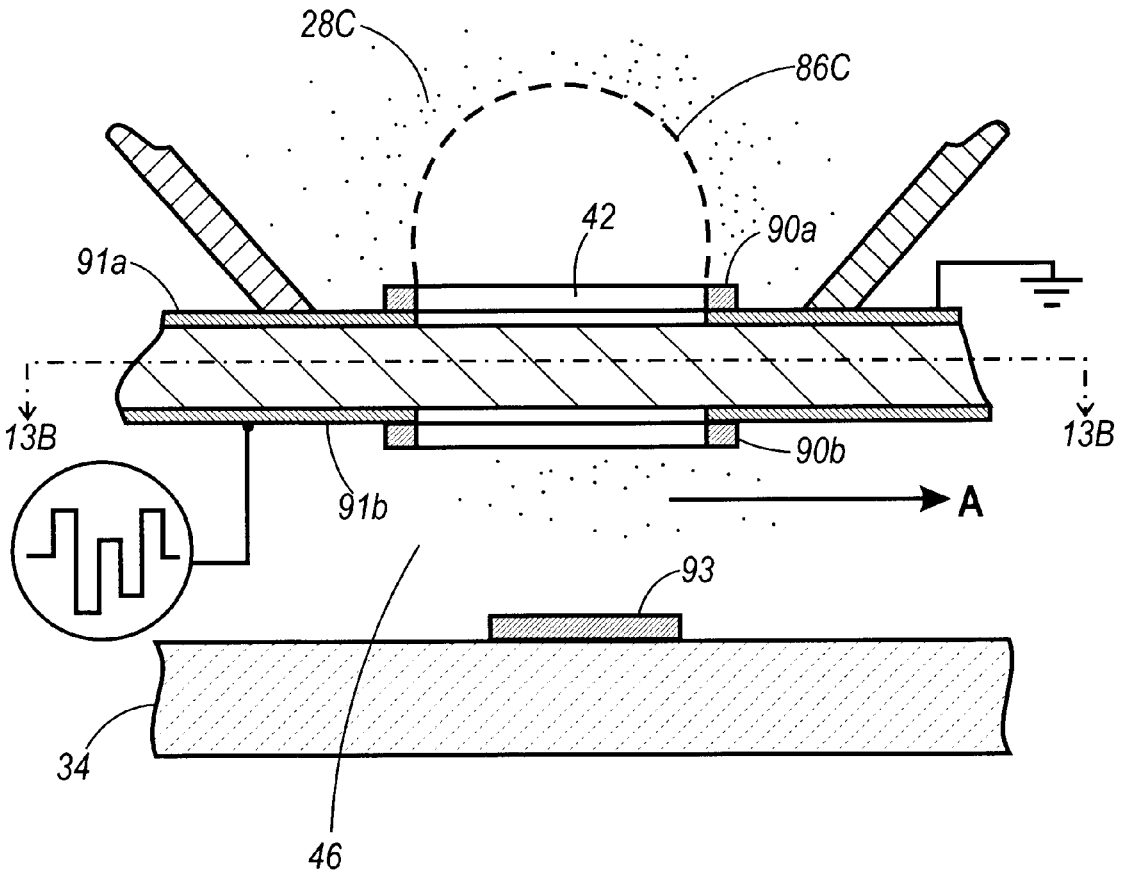
FIG. 13A is cross-sectional side view.
Figure 13B:
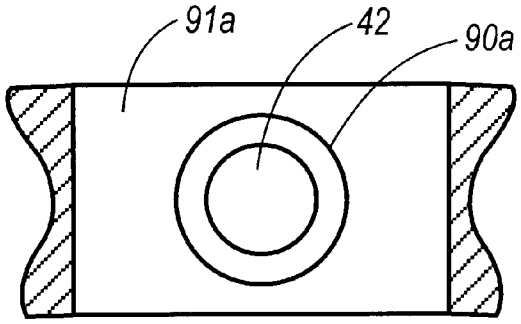
FIG. 13B is a top view, of a marking material metering device according to one embodiment of the present invention, employing an annular electrode.

As an alternative or supplement to electrodes 54 and counter-electrodes 55, each port 42 may be provided with an electrostatic gate. With reference to FIGS. 13A and 13B, this gate may take the form of a two-part ring or band electrode 90*a*, 90*b* at the inside diameter of the ports 42, connected via contact layers 91*a* and 91*b* to a controllably switchable power supply. The field generated by the ring electrode may attract or repel the, charged marking material. Layers 91*a* and 91*b* may be photolithographically, mechanically or otherwise patterned to allow matrix addressing of individual electrodes 90*a*, 90*b*.

Figure 14:
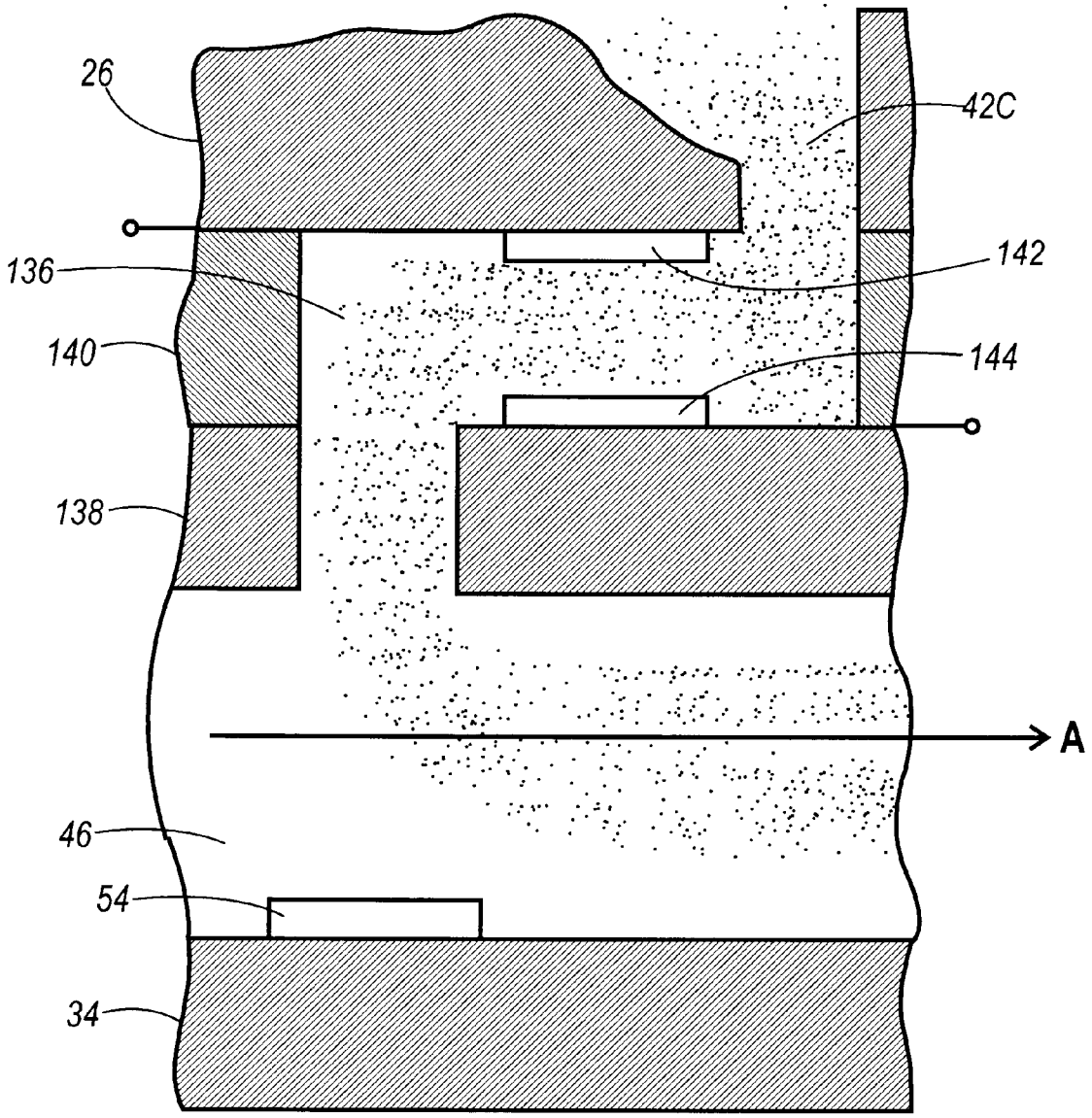
FIG. 14 is cross-sectional side view of a marking material metering device according to another embodiment of the present invention, employing two electrodes.

An alternate embodiment for providing marking material metering is shown in FIG. 14. This embodiment consists of one or more pass regions 136, extending roughly parallel to the direction of propellant flow in channel 46. Each pass region 136 is formed between body 26 (or suitable upper layer) and layer 138, with layer 140 serving as a spacing layer therebetween. Each layer may be a suitable, thick, etched photoresist, machine plastic or metal, or other material as may be dictated by the specific application of the present invention. Pass region 136 may be up to 100 $\mu$m or greater in length (in the direction of marking material travel). Facing each other, and formed in pass region 136 on the surface of body 26 and layer 138, are roughly parallel plate electrodes 142 and 144, respectively.

In the case of an array of such openings, the various electrodes are addressed by either a row or column line, allowing matrix addressing schemes to be used. The electrodes form one embodiment of an electrostatic gate for metering marking material.

In general, and specifically in the case of parallel plate electrodes such as are illustrated in FIG. 14, the marking material used may be uncharged or charged. In the case of uncharged marking material, the marking material should have a permitivity considerably higher than both air and the propellant. In such a case, the electrode pairs are provided with opposite (+/−) charge. The uncharged marking material is polarized by the field between the parallel plate electrodes, which act together to essentially form a capacitor. With a field thus established between electrodes, the marking material preferentially stays in that field (i.e., the energetically more favorable location is between the electrodes). Marking material is thus blocked from traveling through the port. When no charge is provided to the electrodes, marking material is allowed to travel through the port and into the propellant stream, typically by way of back pressure, pressure burst, etc. An alternating current may be applied to the electrodes to avoid the buildup of marking material.

In the case of charged marking material, when in the "on" state, one of the electrodes attracts the marking material (the other repels it), preventing the material from entering into the propellant stream. When in the "off" state, the electrodes allow marking material to pass by and into the propellant stream, for example by way of back pressure, pressure burst or a third electrode, such as electrode 54 provided with an charge polarity opposite that of the marking material. Either polarity charge (positive or negative) on the marking material can be accommodated.

Figure 15:
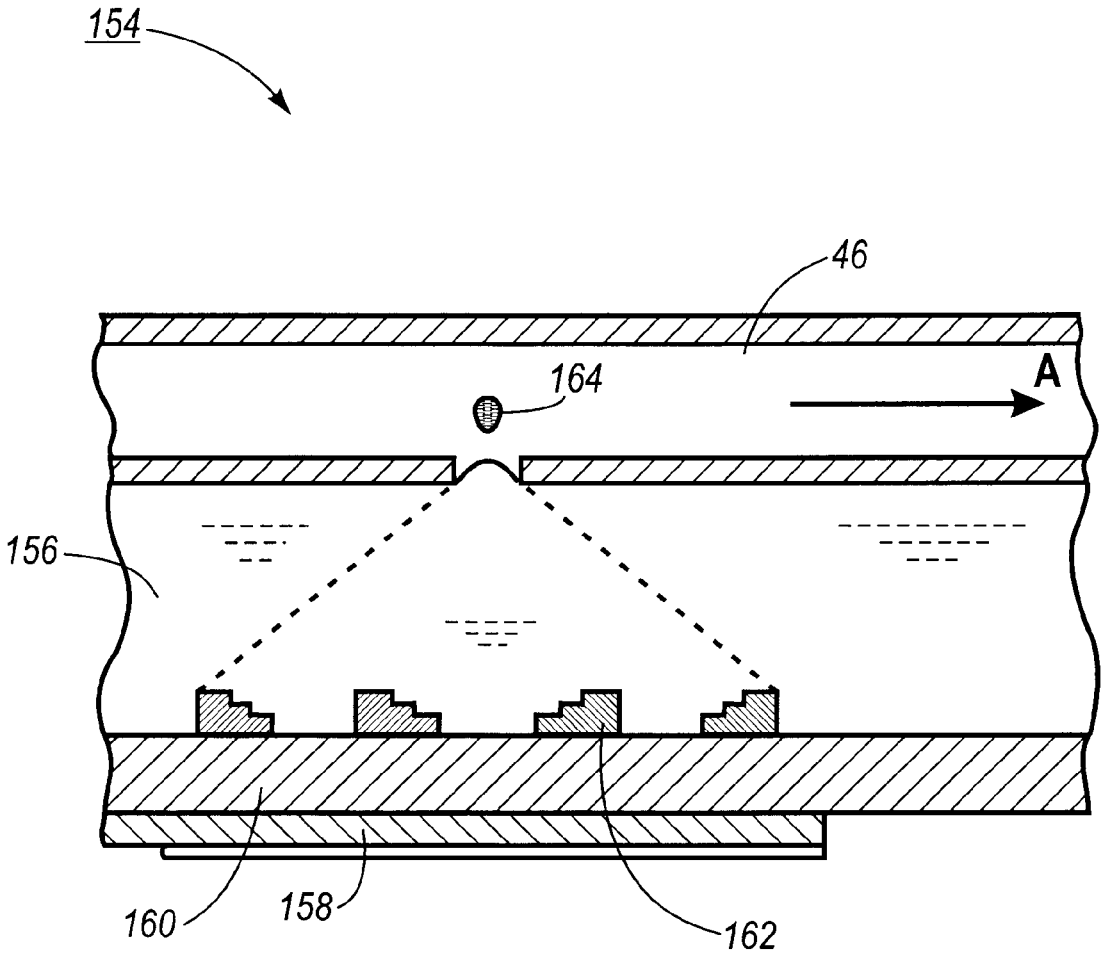
FIG. 15 is a cross-sectional side view of a marking material metering device according to yet another embodiment of the present invention, employing an acoustic ink ejector.

According to another embodiment of the present invention, liquid marking material may be metered into the propellant stream by ejecting it from a source, for example by an acoustic ink ejector, into the propellant stream. FIG. 15 shows an abbreviated illustration of this embodiment. According to the embodiment 154 shown in FIG. 15, channel 46 is located above a top surface of a pool of marking material 156, for example a liquid marking material such as liquid ink. Embodiment 154 comprises a planar piezoelectric transducer 158, such as a thin film ZnO transducer, which is deposited on or otherwise bonded to the rear face of a suitable acoustically conductive substrate, such as an acoustically flat plate of quartz, glass, silicon, etc. The opposite, or front face of substrate 160 has formed thereon or therein a concentric phase profile of Fresnel lenses, a spherical acoustic lens, or other focusing means 162. By applying an rf voltage across transducer 158, an acoustic beam is generated and focussed at the surface of pool 156, thereby ejecting a droplet 164 from the pool into the propellant stream. The amount of marking material injected into the propellant stream, for the purpose of greyscale control, may be controlled by controlling the size of droplet 164 (by controlling the intensity of the acoustic beam), the number of droplets injected in short succession, etc. For a more detailed description of an acoustic ink print head of the type that may be employed by this embodiment, see U.S. Pat. No. 5,041,849, which is hereby incorporated by reference.

Figure 16:
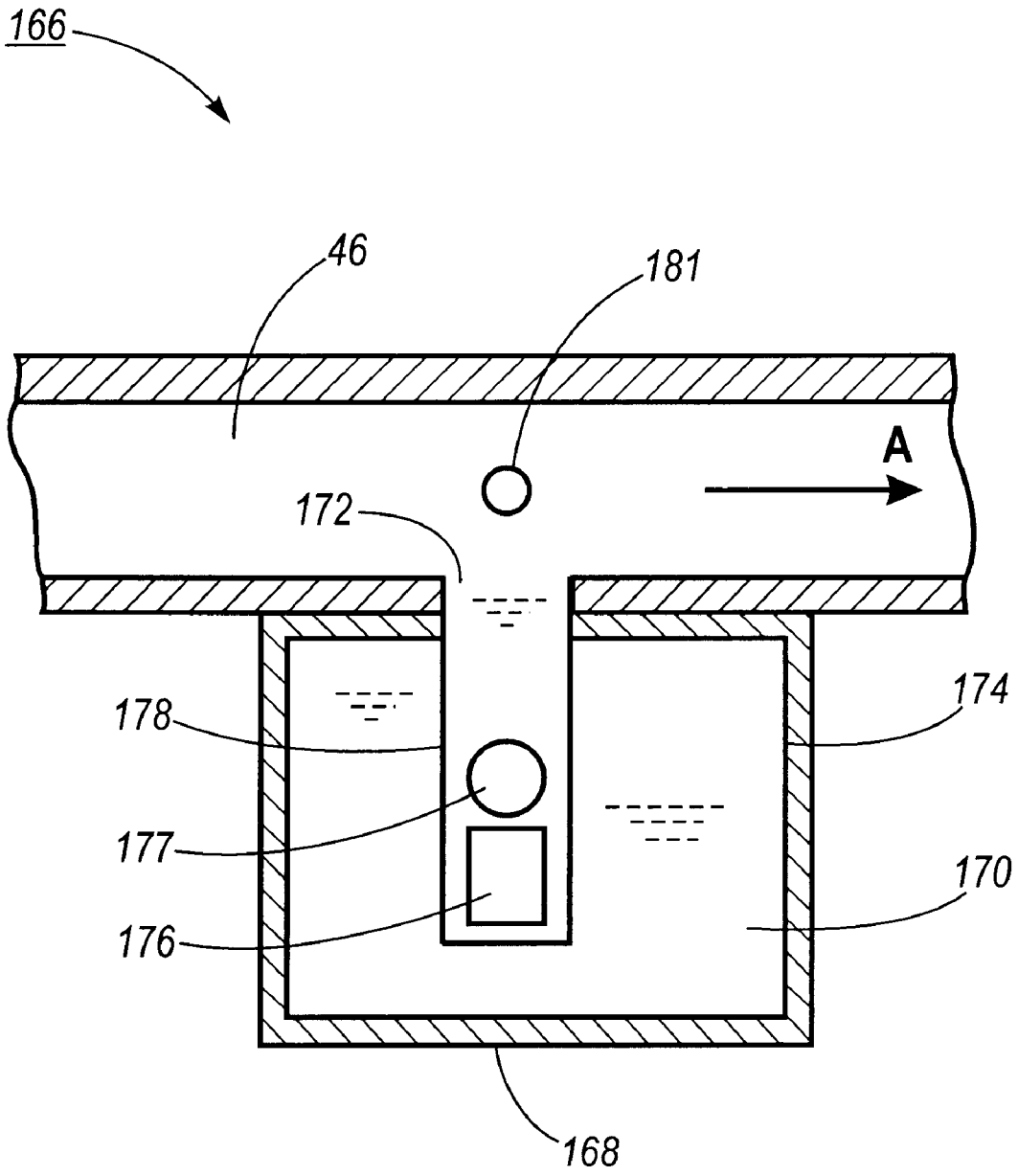
FIG. 16 is a cross-sectional side view of a marking material metering device according to still another embodiment of the present invention, employing a TIJ ejector.

In yet another embodiment 166 for metering a liquid marking material into the propellant stream, an ink jet apparatus such as a TIJ apparatus 168 is employed. FIG. 16 shows an abbreviated illustration of this embodiment. According to embodiment 166, TIJ ejector 168 is located proximate channel 46 such that ejection of marking material 170 from ejector 168 aligns with a port 172 located in channel 46. Marking material 170 is, again, a liquid material such as liquid ink, retained in a cavity 174. Marking material 170 is brought into contact with a heating element 176. When heated, the heating element generates a bubble 177 which is forced out of a channel 179 located within the TIJ apparatus 168. The motion of bubble 177 causes a controlled amount of marking material to be forced out of the channel (as otherwise well known) and into the propellant stream in the form of a droplet 181 of marking material. A plurality of such TIJ ejectors may be employed in conjunction with a single ballistic aerosol marking channel according to the present invention to provide a device and method for marking a substrate with improved speed, greyscale, and other advantages over the prior art. For a more detailed description of a TIJ apparatus of the type that may be employed by this embodiment, see U.S. Pat. No. 4,490,728, which is hereby incorporated by reference.

While there are many other possible embodiments for the ejection of liquid marking materials (such as pressurized injections, mechanical valving, etc.), it should be appreciated that previously described embodiments may also function well for such marking materials. For example, the apparatus shown in FIG. 3 may function well, with the ports 42 sized as a function of the viscosity of the marking material such that a liquid meniscus forms with the ports 42. This meniscus and the corresponding electrode 54 essentially form plates of a parallel capacitor. Given the proper charge on electrode 54, a droplet from the meniscus may be pulled into the channel 46. This approach works well for conducting (and to a certain degree non-conducting) liquids such as inks, substrate pre-treatment and post-treatment materials, etc. This is similar to the technology known as tone jet, which technology may also be employed as a metering device and method according to the present invention.

Figure 17:
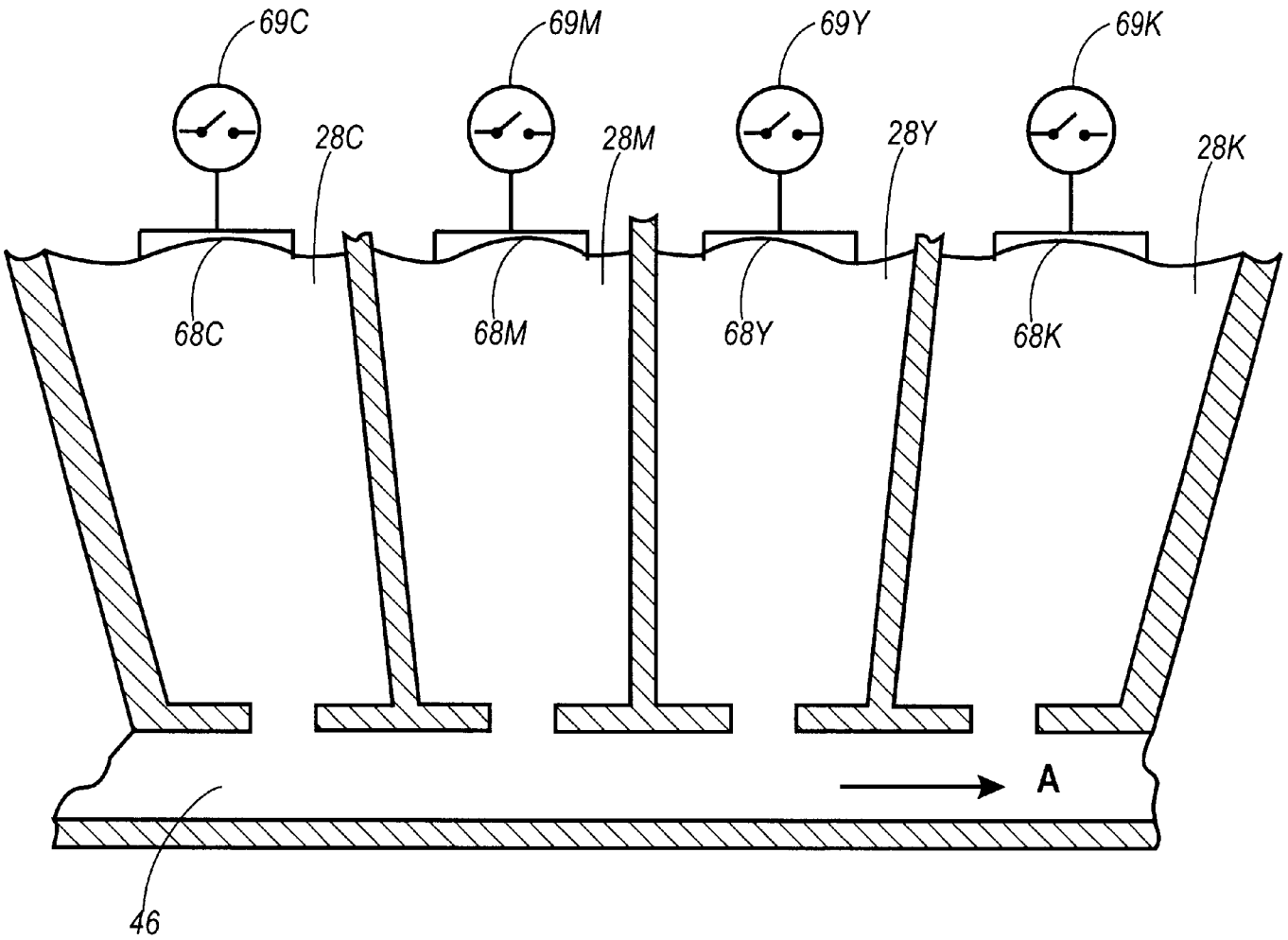
FIG. 17 is a cross-sectional side view of a marking material metering device according to a further embodiment of the present invention, employing a piezo-electric transducer/diaphragm.

As a further enhancement to the embodiments described herein, it may be desirable to provide a burst of pressure to urge or even force marking material out of cavities 28 and inject same into the propellant stream. This pressure burst may be provided by one of a variety of devices, such as piezo-electric transducer/diaphragms 68C, 68M, 68Y, and 68K (collectively referred to as transducer/diaphragm 68) located within each cavity 28, as shown in FIG. 17. One or more of transducer/diaphragm 68 may be separately addressable, either in conjunction with an adjunct metering device or independently, by addressing means 69C, 69M, 69Y, and 69K (collectively addressing means 69). Various alternatives may be employed, including gated pressure from the propellant source, etc.

Still other mechanisms may be employed for metering marking material into the propellant stream according to the present invention. For example, the technique previously referred to as toner jet may be employed, such technique being described for example in laid open patent application WO 97 27 058 (A1), incorporated herein by reference. Alternatively, a micromist apparatus may be employed, of the type described in U.S. Pat. No. 4,019,188, which is incorporated herein by reference.

In numerous of the embodiments for the metering of the marking material according to the present invention, no moving parts are involved. Metering may thus operate at very high switching rates, for example greater than 10 kHz. Additionally, the metering system is made more reliable by the avoidance of mechanical moving parts.

Figure 18:
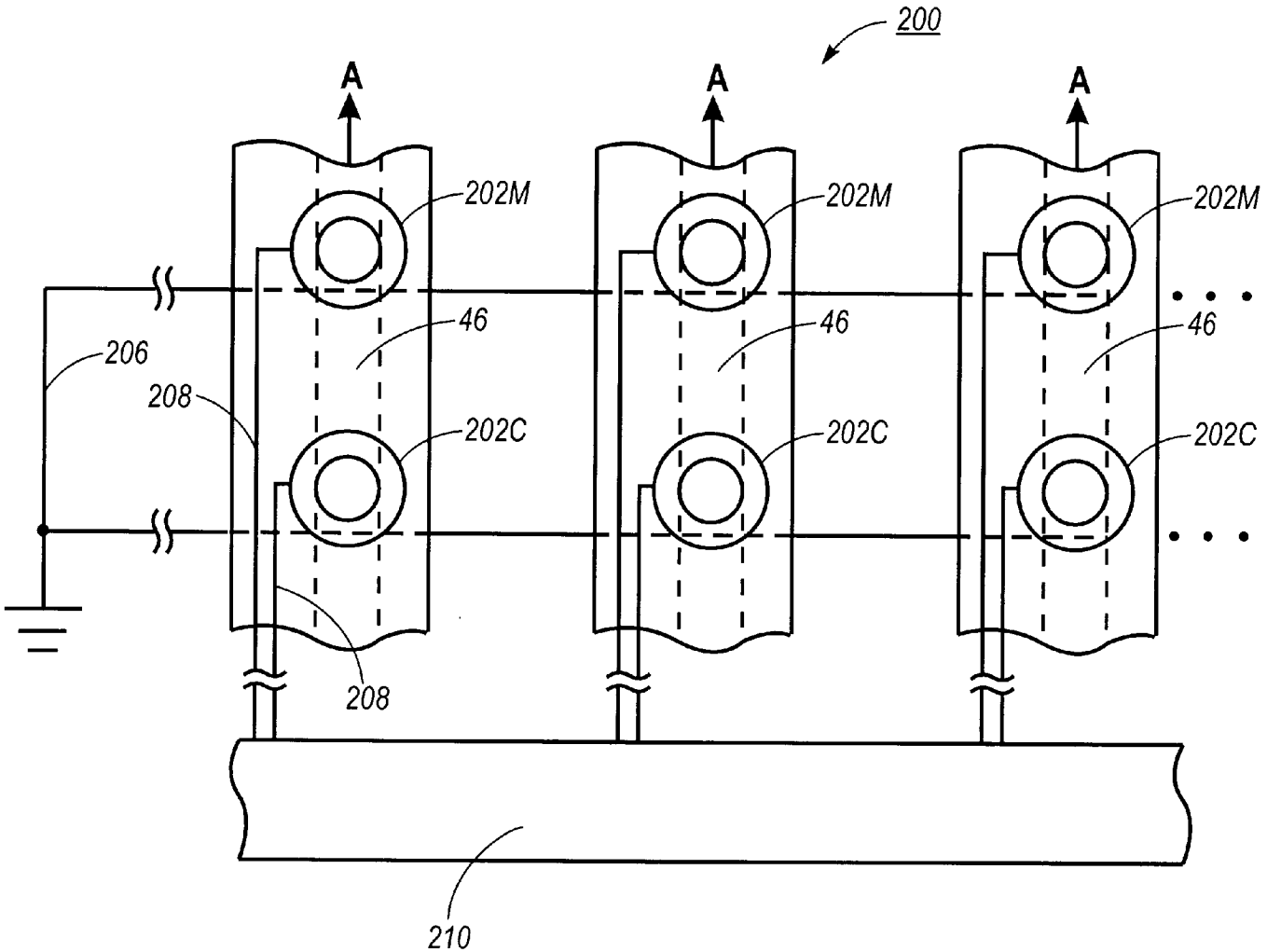
FIG. 18 is a schematic illustration of an array of marking material metering devices connected for matrix addressing.
Figure 19:
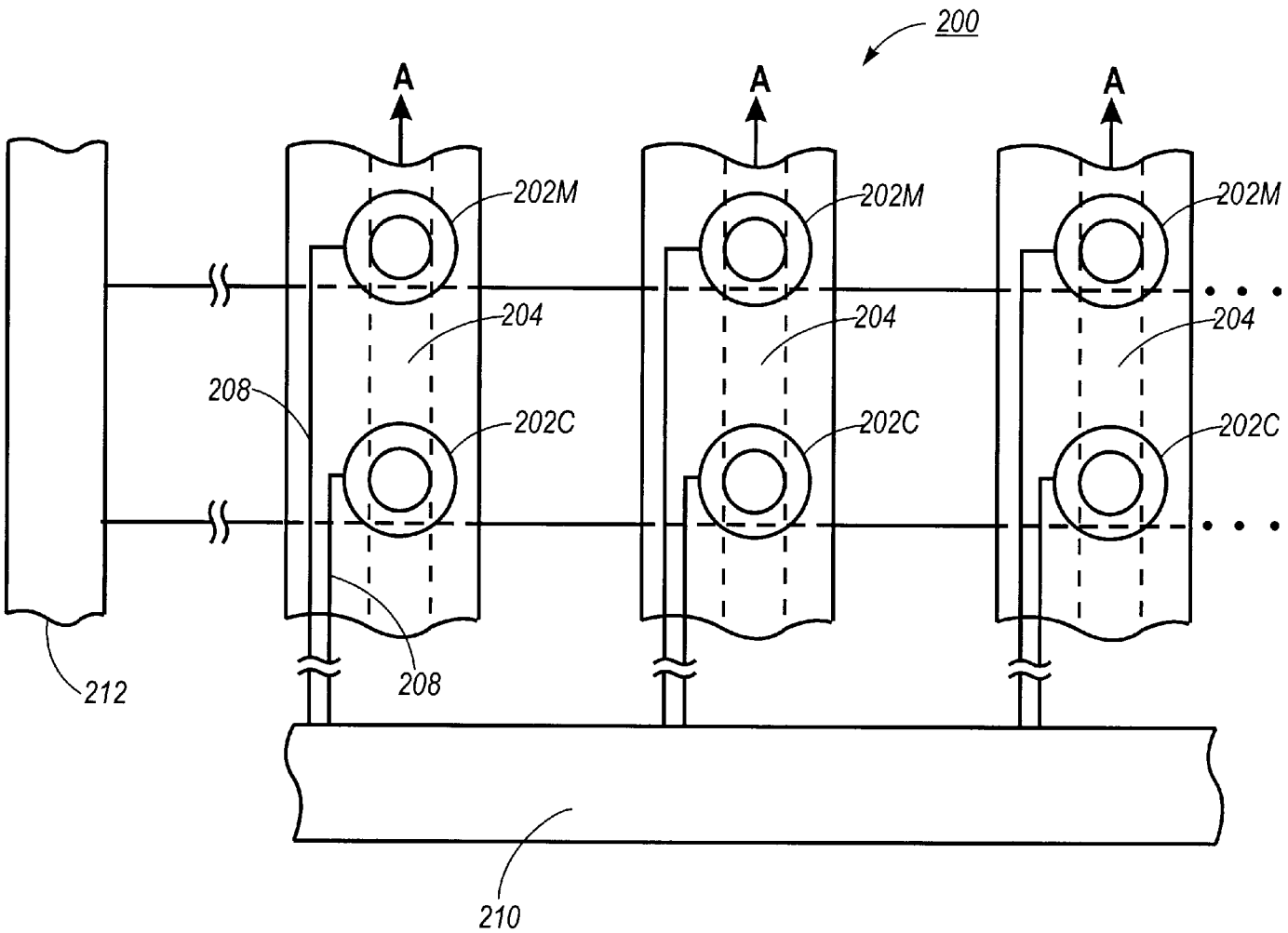
FIG. 19 is another schematic illustration of an array of marking material metering devices connected for matrix addressing.

One of many simple addressing schemes may be employed to control the metering system of choice. One such scheme is illustrated in FIG. 18, according to which, each "row" of an array 200 of metering devices 202C, 202M, 202Y, 202K, etc. (collectively referred to as metering devices 202) for metering marking material into channels 46 are interconnected via a common line 206, for example connected to ground. Each "column" comprises metering devices 202, which together control the introduction of marking material into a single channel 46. Each metering device of each column is individually addressed, for example by way of lines 208 connecting an associated metering device to a control mechanism, such as a multiplexer 210. It should be noted that each "column" is for example on the order of 84 $\mu$m wide, providing ample area to form lines 208, which may for example be on the order of 5 $\mu$m wide. An alternative embodiment is shown in FIG. 19, in which common line 206 is replaced by individual addressing of each "row" of metering devices 202, for example by multiplexer 212, to allow for pure matrix addressing of the metering devices.

Figure 20:
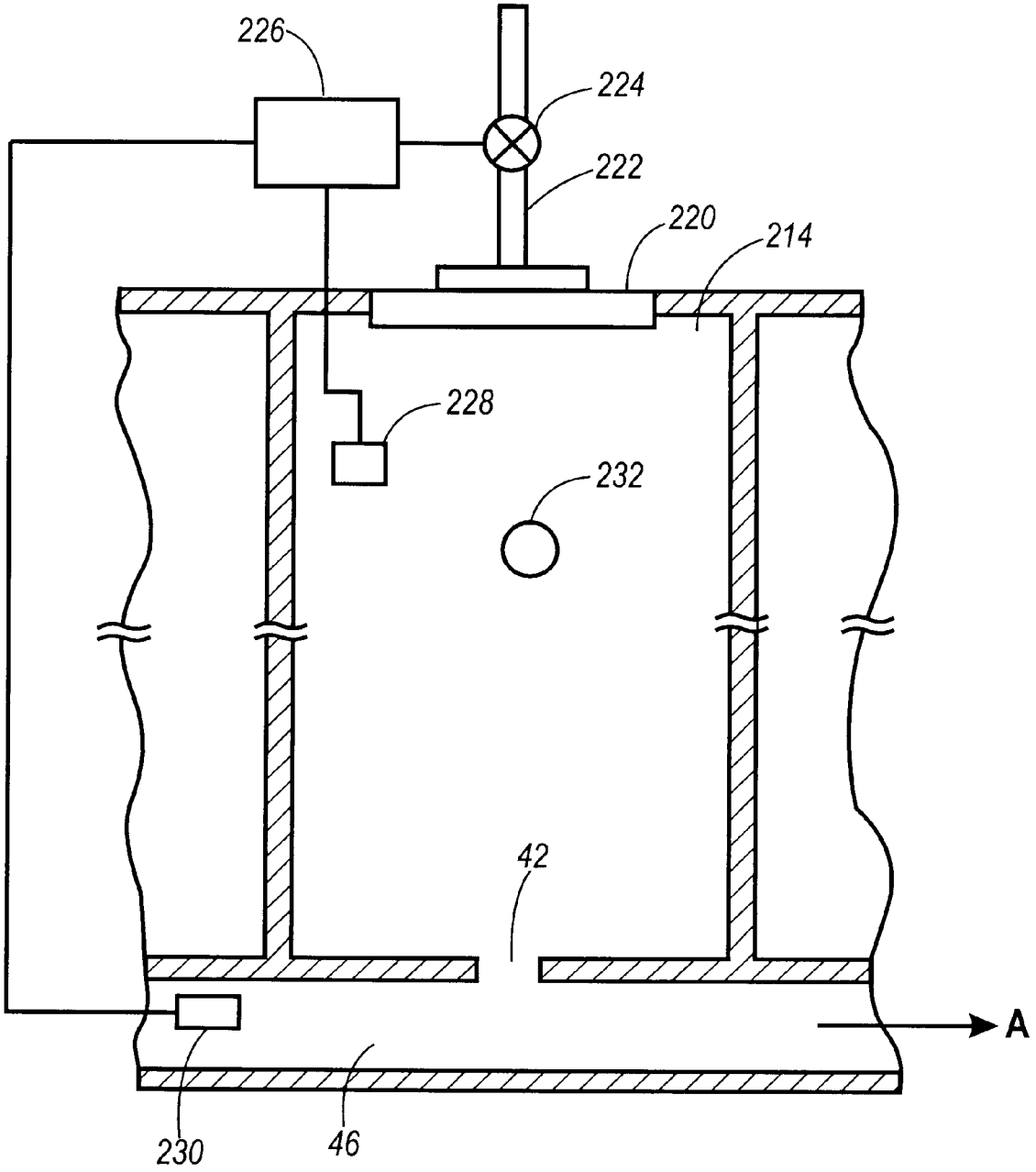
FIG. 20 is a cross-sectional view of an embodiment for generating a fluidized bed of marking material in a cavity.

Several mechanisms may prove advantageous or necessary for realization of certain embodiments of the present invention. For example, returning to FIG. 3, there is a need to provide a smooth flow of marking material from cavities 28 into channel 46, and a need to avoid clogging of ports 42. These needs may be addressed by diverting a small amount of the propellant into the cavities 28. This may be accomplished by balancing the pressure in the channel and the pressure in the cavity such that the pressure in the cavity is just below that of the channel. FIG. 20 illustrates one arrangement for accomplishing pressure balance. One embodiment 214 of a cavity 28 is illustrated in FIG. 20, having an associated port 42 located in one wall thereof which is in communication with channel 46 so as to allow marking material contained in cavity 214 to enter channel 46 (under control of a metering device not shown). In one wall of cavity 214, an opening is provided with a filter 220 of a coarseness sufficient to prevent marking material from passing therethrough. Filter 220 is connected via piping 222 to a valve 224 which is controlled by circuitry 226. Also connected to circuitry 226 is a pressure sensor 228, located in cavity 214, and a pressure sensor 230 located within the channel 46, for example just before the converging region thereof (not shown). Pressure within cavity 214 is monitored by pressure sensor 228, and compared with the pressure in the channel monitored by pressure sensor 230. At system start-up, valve 224 is closed while the pressure in channel 46 increases. Upon reaching steady-state operating pressure, valve 224 is then controllably opened. Circuitry 226 maintains the pressure in cavity 214 just below that of the channel 46 by controllably modulating valve 224. This pressure differential results in an amount of propellant being diverted from the channel into the cavity.

Returning to FIG. 3, the propellant entering the cavities 28 through ports 42 as described above (or by other means) causes a local disruption of the marking material near ports 42. When employing a marking material having an appropriately sized and shaped particle, with a proper plasticity, packing density, magnetization, etc., the frictional and other binding forces between the particles may be sufficiently reduced by the disruption (i.e., due to the propellant passing through marking material) such that the marking material takes on certain fluid-like properties in the area of disruption. (See Fuchs, "The Mechanics of Aerosols", §58, pp. 367–373 (Pergamon Press, 1964), incorporated herein by reference, for specifics on the parameters for creating fluidization.) Under these conditions, regions 86C, 86M, 86Y, and 86K of fluidized marking material may be generated (collectively, they are referred to as fluidized beds 86). By providing a fluidized bed 86 in the manner described herein, the marking material is made to flow evenly both by creating a fluid-like material with reduced viscosity and by effectively continuously cleaning ports 42 with the propellant diverted therethrough. Accurate spot size, position, color, etc., are thereby obtained.

Figure 21:
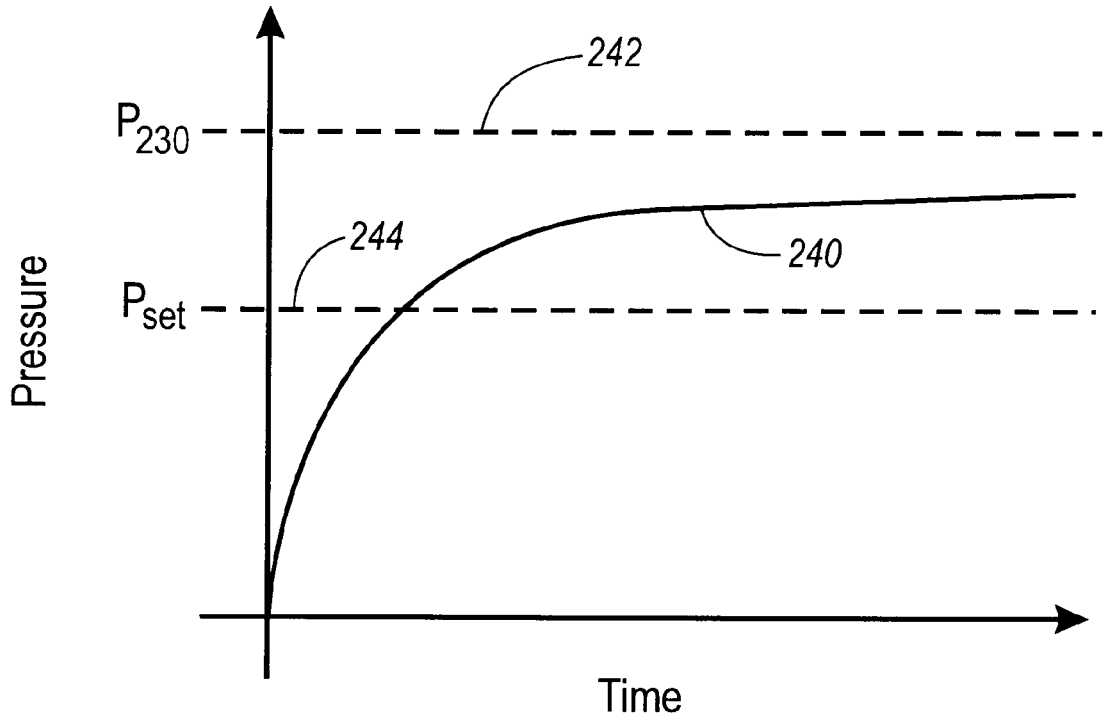
FIG. 21 is a plot of pressure versus time for a pressure balanced cavity embodiment.

With reference now to FIG. 21, line 240 represents a plot of pressure versus time at a point in the channel 46 proximate the port 42 of FIG. 20. Line 242 represents the pressure ($P_{230}$) at sensor 230 of FIG. 20 (i.e., pressure prior to the nozzle portion of channel 46). Line 244 represents the set point ($P_{set}$) at which the pressure within cavity 214 is maintained. Since it takes some period of time to reach steady-state pressure in the channel, and hence the desired pressure balance between channel 46 and cavity 214, it may be desirable to accelerate the pressure balancing to avoid clogging, leaking of marking material, etc. This may be accomplished by introducing pressurized propellant into the cavity (or otherwise pressurizing cavity 214), for example from the propellant source by way of an opening 232 located in cavity 214 shown in FIG. 20.

Figure 22:
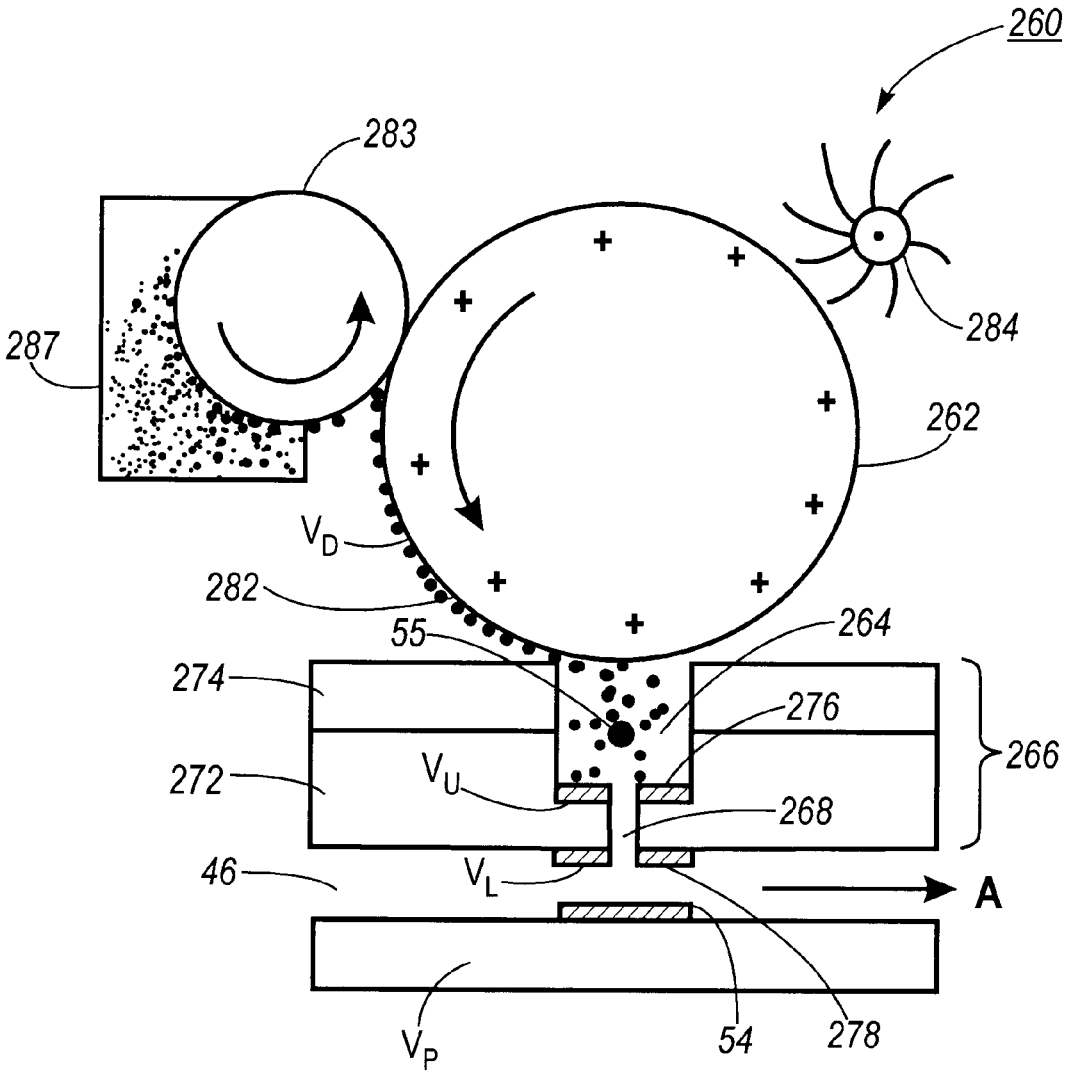
FIG. 22 illustrates an embodiment of the present invention employing an alternative marking material delivery system.

An alternative arrangement 260 for the provision of a fluidized bed is illustrated in FIG. 22. In this embodiment, a system of electrodes and voltages are employed to provide not only a fluidized bed, but also a metering function. Conceptually, this embodiment may be divided into three separate and complementary functions: marking material "bouncing", marking material metering, and marking material "projection". A marking material carrier 262 such as a donor roll, belt, drum or the like (which is fed with marking material by a conventional magnetic brush 283) is held a small distance away from one embodiment 264 of cavity 28 formed in body 266. Port 268 is formed in the base of body 266 for example as a cylindrical opening communicatively coupling cavity 264 and channel 46. Body 266 may be a monolithic structure or a laminated structure, for example formed of a semiconducting layer 272 (such as silicon) and an insulating layer 274 (such as Plexiglas). The walls of cavity 264 may optionally be coated with a dielectric (such as Teflon) to provide a moderately smooth insulating boundary. Of course, this coating may also be applied to any of the other embodiments described herein.

Formed at the cavity-side of port 268 is first electrode 276, which may be a continuous metal layer deposited within the structure, or may be patterned to correspond to each port 268 of an array of such ports. Formed at the channel-side of port 268 is second electrode 278, which will typically be patterned into an annular planform, concentric with port 268. An optional supplemental electrode 54 may be formed within the channel to assist with extraction of marking material from the cavity 264.

By properly selecting the voltages at each of several points in arrangement 260, the desired three functions can be achieved. For example, Table 2 illustrates one possible choice of voltages for negatively charged making material.

TABLE 2

| Reference Point | Voltage | Example values |
|---|---|---|
| $V_U$ | 0 (ground) | 0 v |
| $V_L$ (off) | $V_{off}$ ("off") | −300 v |
| $V_L$ (on) | $V_{on}$ ("on") | +100 v |
| $V_{DC}$ | $V_{DC}$ | −40 v |
| $V_{AC}$ | $V_{AC}$ | 500 v |
| $V_D$ | $V_{DC} + v_{AC}\sin 2\pi ft$ | varies |
| AC frequency | n/a | 2 kHz |
| $V_P$ | $V_P$ | +170 v |

In arrangement 260, the marking material 282 is charged, for example by trib-charging or ion charging, and is thereby retained by carrier 262. The AC voltage within cavity 264 causes the charged toner to "bounce" between the carrier and first electrode 276. The DC bias is the voltage difference maintained between the carrier 262 and upper electrode 276 to maintain a continuous marking material supply from marking material sump 287. For marking material with narrow size and charge-diameter ratio (Q/d) distributions, the bounce is synchronized with the AC frequency. The optimal AC frequency is determined by the transit time of the marking material between the carrier 262 and the first electrode 276. Specifically, the period T should be twice the transit time $\tau$.

The gating voltage acts to open (turn "on") and close (turn "off") port 268. For the "on" condition, the polarity of the voltage is directly opposite to the polarity of the charged marking material, thus attracting the marking material into the field between the first and second electrodes 276 and 278, respectively. Finally, a projection voltage may be established by supplemental electrode 54 to further attract the charged marking material particles into the channel 46 where the propellant stream causes them to travel toward a substrate.

Material Transport

It may be desirable to controllably move marking material towards ports 42, especially with speed, precision, and correct timing. This process is referred to as marking material transport, and may be accomplished by one of a variety of techniques.

Figure 23:
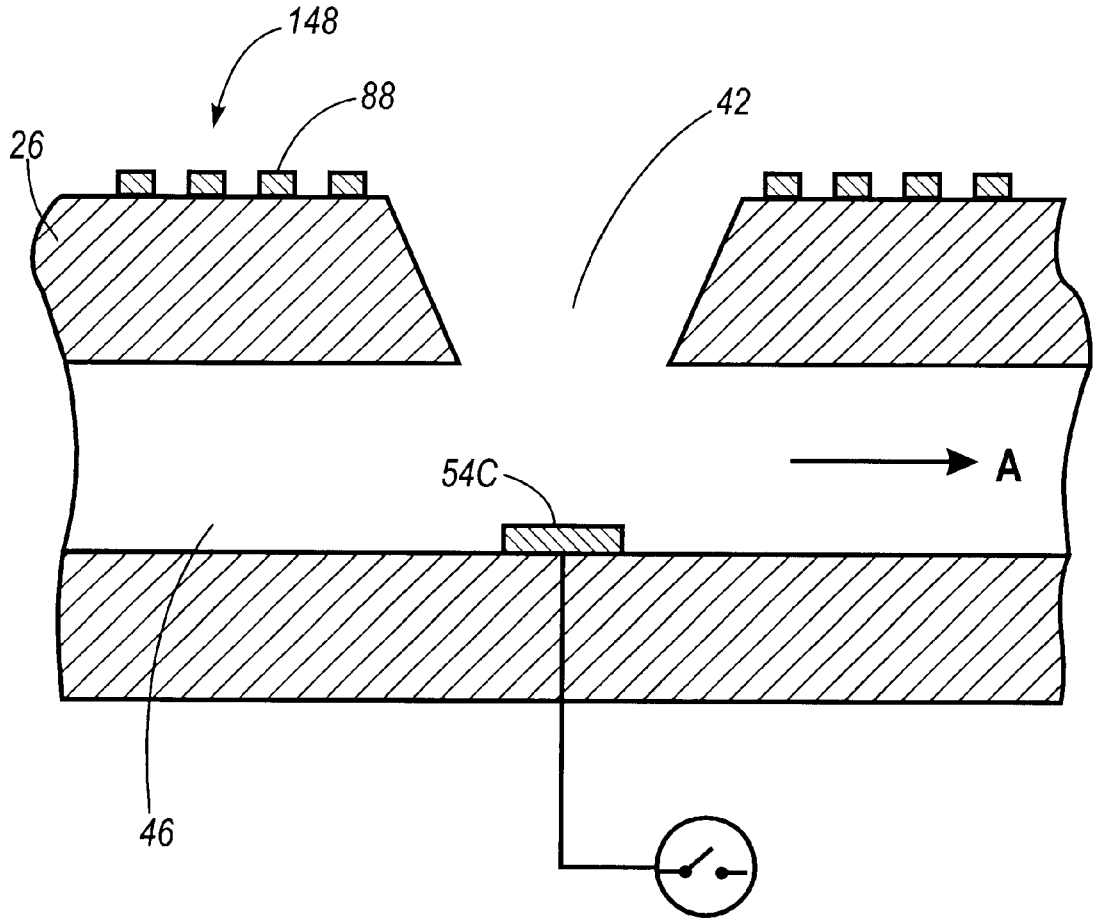
FIG. 23 is a cross-sectional side view of a marking material transport device according to one embodiment of the present invention, employing an electrode grid and electrostatic traveling wave.

One such technique uses an electrostatic travelling wave to move individual marking material particles. With reference to FIG. 23, according to this technique, a phased DC high voltage waveform is applied to a grid 148 of equally spaced electrodes 88 that are formed proximate each port 42.

Grid 148 may be photolithographically formed of aluminum inside the cavities, or may be formed on a lift-off carrier which may be applied within the cavities. Grid 148, and the methods of operating same, are discussed in further detail in patent application Ser. No. 09/163,839, which is incorporated by reference herein.

Figure 24:
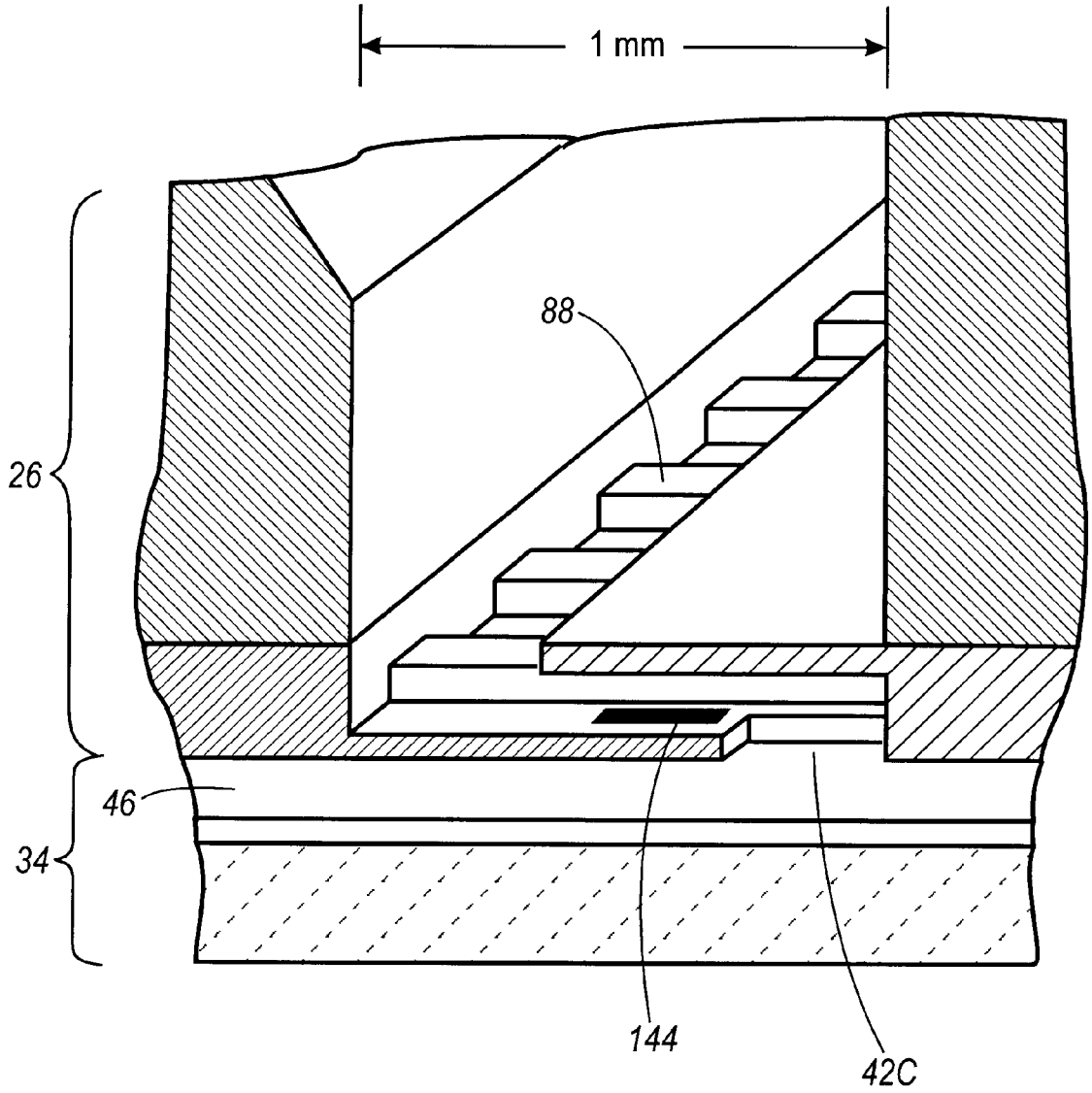
FIG. 24 is a cross sectional illustration of a combined marking material transport and metering assembly according to a further embodiment of the present invention.

FIG. 24 illustrates an embodiment in which electrodes 88 for an electrostatic travelling wave are provided in conjunction with electrodes 142 (not shown) and 144 for metering the marking material. However, it will be understood that various other transport and metering combinations are within the scope of the present invention.

A protection and relaxation layer may be deposited over electrodes 88 to protect their surfaces and also to provide rapid charge dissipation at a known time constant to move the marking material along grid 148. Also, a proper coating will assist with controlling the direction of the marking material movement, reduce marking material being trapped between electrodes, minimize oxidation and corrosion of the electrodes, and reduce arcing between electrodes. Such a coating is described in patent application Ser. Nos. 09/163,664 and 09/163,518, each of which are incorporated by reference herein.

It should be appreciated that the transport and metering functions taught herein may be performed by a single device, and combined into a single step. However, separate or combined, the transport and/or metering of marking material according to the present invention addresses many of the problems identified with the prior art. For example, marking material is available for injection into the propellant stream almost instantaneously. This solves the problem of needing to wait for a channel to refill as common in ink jet systems. Furthermore, the rate at which marking material may be moved into the propellant stream and thereafter deposited onto a substrate is significantly higher than available from the prior art; indeed, in some embodiments it may be continuously provided.

By way of example, consider a page-wide (8.5 inch) array print head with channels spaced at 600 spi. Assume a spot size equal to 1.5 times the diameter of the exit orifice (assume for simplicity that the exit orifice has a round cross section). Thus, the spot area is 2.25 times the orifice area. Assume also that the marking material is a solid particulate toner 1 $\mu$m in diameter which we want to deposit on a paper substrate with monochrome, full coverage 5 particles thick. This means that a feed length of 2.25×5 particles×2×1$\mu$m, or 22.5 $\mu$m is required to be fed into the propellant stream. To be conservative, we will assume a length of 25 $\mu$m.

To avoid clogging, further assume that the marking material feed velocity is more than an order of magnitude below the propellant velocity. With a propellant velocity of about 300 meters/second (m/s), we assume a marking material feed velocity of 1 m/s (10 m/s is roughly the velocity of a TIJ droplet ejection). At 1 m/s, it takes 25 $\mu$s to feed a 25 $\mu$m length of marking material. In other words, spot deposition time is about 25 $\mu$s per spot.

For this array, it takes 11 inches×600 spi×25 $\mu$s per spot, or 165 milliseconds (ms) to mark the entirety of an 8.5×11 inch paper page. In the absolute, this corresponds to about 360 pages per minute. This must be compared to a maximum of about 20 pages per minute from a TIJ system. One reason for this improvement in throughput is the ability to provide continuous feed of the marking material. That is, the proportion of the printing time to the duty cycle is nearly 100%, as compared to a TIJ system, where the printing time (marking material ejection time) is just 20% of the duty cycle (up to 80% of the TIJ duty cycle is spent waiting for the channel to refill with ink).

Figure 25A:
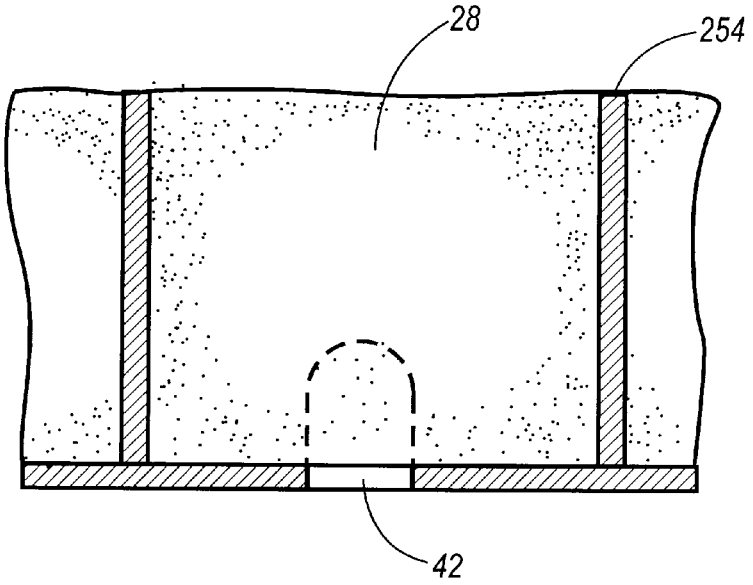
FIGS. 25A and 25B illustrate one embodiment for replenishing a fluidized bed of marking material according to the present invention.
Figure 25B:
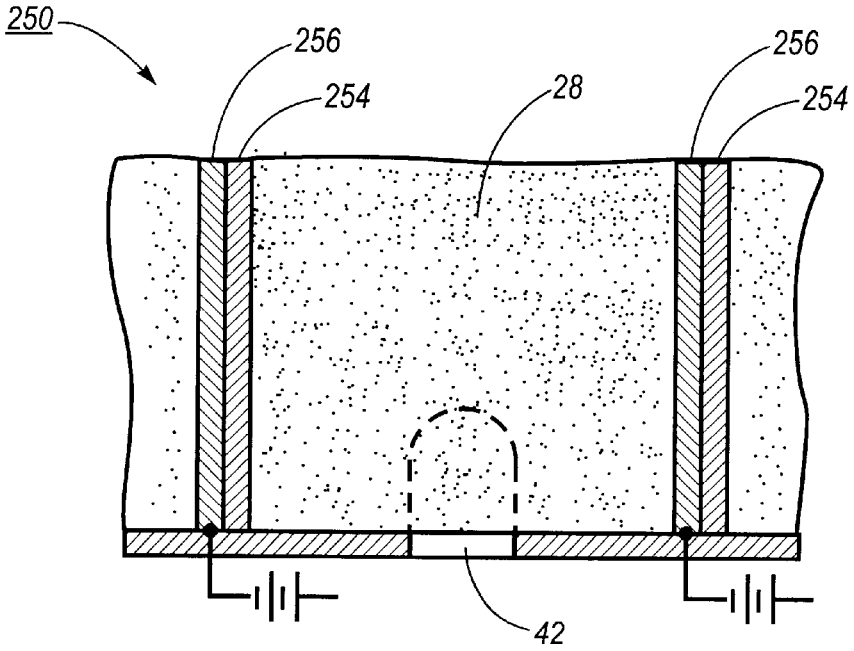

In certain embodiments, it is possible that despite generating a fluidized bed within the cavity, marking material may tend to congregate in stagnant regions within the cavity, such as the corners thereof, starving the fluidized bed and negatively affecting the injection of marking material into the channel. An example of this is illustrated in FIG. 25A. To address this problem, and further assist with the transport of marking material within the cavity, the bulk marking material within the cavity may be agitated. FIG. 25B illustrates one embodiment 250 for creating such agitation. On at least one wall 254 forming cavity 28 is a piezo-electric material 256, which causes mechanical and pressure agitation within cavity 28. This agitation maintains marking material located in cavity 28 in a dynamic state, avoiding stagnation points within cavity 252.

Mixing of Marking Material

Figure 26:
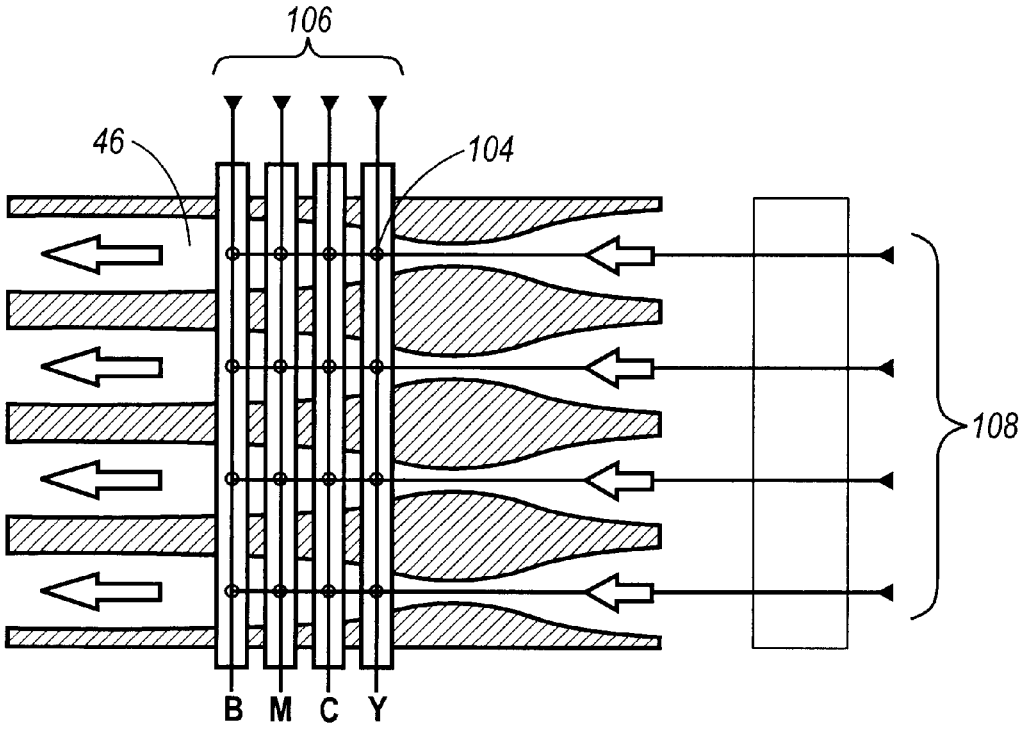
FIG. 26 is a plan view of an array of channels and addressing circuitry according to one embodiment of the present invention.

In a multiple marking material regime, such as a full color printer, two or more marking materials may be mixed in-channel prior to deposition on the substrate (again, the following discussion is also relevant to other materials such as pre- and post-marking treatment materials, etc.) In such a case, each of the marking materials are individually metered into a channel. This requires independent control of the metering of each marking material, and imposes limits on the throughput rates by the required addressing and other aspects of metering. For example, with regard to FIG. 26, there is shown therein a multiple color marking system in which each channel 46 may be provided with one or more colors of marking material. To control the flow of marking material into a channel 46, a metering device 104, for example of a type previously described, is addressed in a matrix fashion via column address leads 106 and row address leads 108 in a manner also previously discussed. The RC time constant associated with an 8-inch long set of passively addressed column address leads 106 will limit the minimum achievable signal rise times on these lines to a few microseconds—we will assume 2 $\mu$s at 500 kHz. The minimum metering device "on" time is thus on the order of about 5 $\mu$s. For n-bit greyscale printing, full coverage for each color takes $5\times2^n$ $\mu$s per spot. It therefore takes 11 inches×600 spi×($5\times2^n$) $\mu$s/spot, or about $33\times2^n$ ms to print a full coverage 600 spi page. This corresponds to about $1800\times2^{-n}$ pages per minute. For 5-bit greyscale per channel (n=5), the system may handle up to 56 full color pages per minute, full color (when using the CMYK spectra) being available to each spot in a single pass. (It should be noted that it is an aspect of the present invention to provide relatively high spot density, e.g., 300 spi or greater, at two or more bits of greyscale, and that the various levels of greyscale may be obtained without significantly altering the diameter of the spot. That is, spot size is maintained constant, e.g., 120 $\mu$m, while the density of marking material is varied to obtained different levels of grey, or color, for a spot.)

Other addressing schemes are known which permit faster addressing and hence faster possible printing. For example, by employing a parallel addressing scheme (i.e., no column addressing lines), the signal rise time may be shortened by an order of magnitude. A system with a 1 $\mu$s minimum metering device "on" time is thus capable of full color greyscale marking at about 280 pages per minute.

As there is a tradeoff between throughput and color depth/greyscale, it is Li possible to tailor a system to optimize for either or both of these characteristics. Table 3 summarizes a throughput and color depth/greyscale matrix based on the above assumptions and the required marking material feed velocities.

TABLE 3

| "n" (no. of greyscale bits per color) | No. of colors (# of distinct colors) | No. of spot sizes | Throughput (pages per minute) | | Marking Material Feed Velocity (meters/second) | |
|---|---|---|---|---|---|---|
| | | | Matrix | Parallel | Matrix | Parallel |
| 2 | 256 | 13 | 450 | 2250 | 1.25 | 6.25 |
| 3 | 4,096 | 29 | 225 | 1125 | 0.62 | 3.12 |
| 4 | 65,536 | 61 | 112 | 562 | 0.31 | 1.56 |
| 5 | 1,048,576 | 125 | 56 | 281 | 0.16 | 0.78 |
| 6 | 16,777,216 | 253 | 28 | 141 | 0.078 | 0.39 |

It should be noted that the color depth and throughput need not be fixed for a system. These values can be adjusted by a user during the setup process for the marking device.

Figure 27:
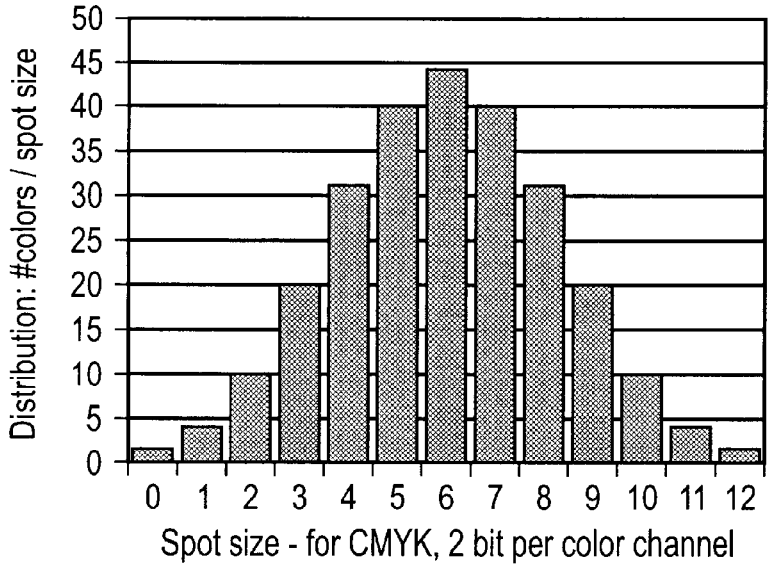
FIG. 27 is an illustration of the distribution of colors per spot size or (spot density) obtained by one embodiment of a ballistic aerosol marking apparatus of the present invention.

It should also be noted that the marking of increasing numbers of colors is distributed in a roughly Gaussian distribution over spot size/density. This is illustrated in FIG. 27 for a system with four colors and 2 bit greyscale.

Marking Material Placement and Spot Size

Figure 28:
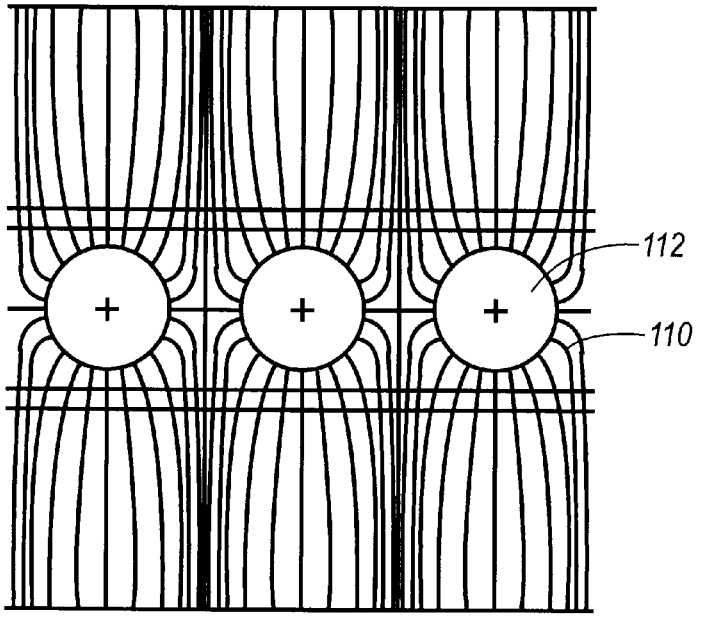
FIG. 28 is an illustration of one example of the propellant flow patterns upon their interfacing with a substrate, viewed perpendicular to the substrate.

The ability to accurately control the placement of a spot of marking material is in part a function of the velocity of the propellant. The spot size and shape are also a function of this velocity. In turn, selecting the propellant velocity is in part a function of w the size and mass of the marking material particles. In addition, spot position, size and shape are a function of how well (i.e., over how many exit orifice diameters) the fully expanded propellant stays collimated. FIG. 28 shows an idealized case of a propellant/substrate interaction, viewed roughly perpendicular to the substrate. The streamlines 110 show that the cylindrical propellant streams form a flow pattern at the substrate surface away from the circular disk of marking material spot 112.

Figure 29:
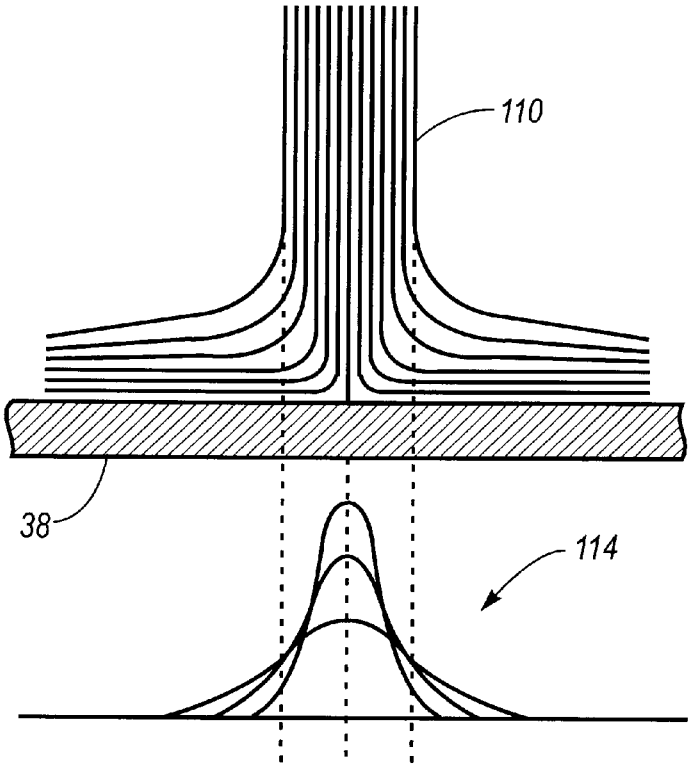
FIG. 29 is a side view of one of the propellant flow patterns of FIG. 28, and also an illustration of the marking material particle distribution as a function of position within the propellant stream.

Typically, the marking material particles are deposited onto the substrate due to their inertia (normal momentum) imparted by the propellant. However, their position on the substrate is diverted from the centroid by the lateral hydrodynamic force components that occur at the propellant/substrate interface, illustrated in FIG. 29. The smaller the mass of the particles (in relation to propellant velocity), and the further such particles are from the center of the propellant stream, the further they are diverted from the spot centroid. The result is a spot with a Gaussian density distribution 114, also illustrated in FIG. 29.

Figure 30:
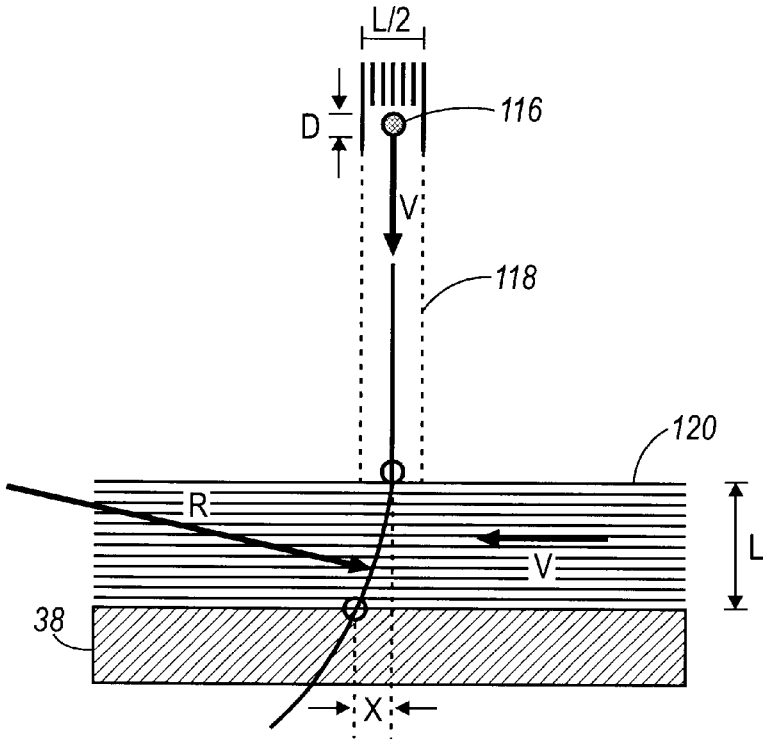
FIG. 30 is a model used for the derivation of a worst case scenario for marking material lateral offset from a spot centroid.

With reference to FIG. 30, as an example of a worst case estimate of marking material particle deviation due to propellant/substrate interface effects (namely, lateral drag at the substrate surface), assume that a particle 116 with a density $\rho_p$ is directed at perfectly flat substrate 38 with a velocity v normal to the substrate and in a propellant stream 118 of width L/2 (i.e., exit orifice 56 shown in FIG. 3 is of width L/2). Assume that at the surface of the substrate there is a lateral propellant flow 120 of thickness L, also with a velocity v caused by the propellant striking the substrate. That is, the worst case assumption that the propellant velocity is entirely converted to lateral flow upon interacting with the substrate.

The lateral deviation x of the marking material particle 116 due to the lateral drag force is calculated for different particle diameters D. From the Reynolds number equation, $$Re = \frac{\rho_g \cdot v \cdot D}{\mu_g} = 7.65 \times 10^4 \cdot v \cdot D$$

where $\rho_g$=1.3 kg/m$^3$, and $\mu_g$=1.7×10$^{-5}$ kg-s/m$^2$. For a particle size of 3 $\mu$m and a flow velocity of v=300 m/s, the Reynolds number is 70. This corresponds to a drag coefficient (CD) of 2.8. See for example Fuchs "The Mechanics of Aerosols," p. 79 (Pergamon Press Ltd., 1964), which is incorporated by reference herein. The drag force FD is then given by $$FD = CD \cdot \frac{\rho_g}{2} \cdot v \cdot g^2 \cdot A = 1.4 v^2 \cdot D^2$$

This lateral drag force deflects the normal incident trajectory of the particle 116 and sends it on a trajectory with radius of curvature R, determined from the equation for inertial centripetal force $F_i$ $$F_i = \frac{\rho_p \cdot V \cdot v^2}{R} \text{ where } V = \frac{\pi \cdot D^3}{6}$$

giving R as $$R = \frac{\rho_g \cdot D}{CD} \text{ where } A = \frac{\pi \cdot D^2}{4}$$

The resulting deviation x is given by $$x = R \cdot [1 - \cos(\arcsin(L/R))]$$

Or, if the normal propellant stream diameter L/2 is chosen to be one-half the array pitch, $$x = R \cdot [1 - \cos(\arcsin(\text{pitch}/R))]$$

For a flow velocity v, a particle size D, a given array density, and a particle density of 1000 kg/m$^3$, the resulting deviation x is shown in Table 4 for various conditions.

TABLE 4

| Array density | Flow velocity (v) | Particle size (D) | Deviation (x) |
|---|---|---|---|
| 600 spi | 300 m/s | 1 $\mu$m | 2.5 $\mu$m |
| 600 spi | 500 m/s | 2 $\mu$m | 0.6 $\mu$m |
| 600 spi | 300 m/s | 1 $\mu$m | 2.5 $\mu$m |
| 600 spi | 100 m/s | 1 $\mu$m | 5.0 $\mu$m |
| 900 spi | 300 m/s | 1 $\mu$m | 1.1 $\mu$m |
| 900 spi | 100 m/s | 1 $\mu$m | 2.2 $\mu$m |

Thus, for a worst case scenario of a 300 m/s flow velocity, a 1 $\mu$m marking material particle size, and 600 spi resolution, a propellant stream (i.e., exit orifice size) of 21 $\mu$m would produce a spot of size $$21\ \mu\text{m} + (2 \times 2.5\ \mu\text{m}) = 26\ \mu\text{m},$$

the spot size expansion due to lateral drag at the propellant stream/substrate interface. Note that this corresponds to a worst case scenario for every condition, i.e., (1) no stagnation point, and fully developed cross flow, (2) cross flow velocity equal to full propellant stream velocity, thus ignoring frictional loss and substrate topology, (3) the full drag force is applied abruptly and two jet diameters away from the substrate. It should also be noted that the Reynolds number is very low due to the scale of the characteristic lengths and that turbulence cannot develop, per microfluidic flow theory. Finally, it should be noted that as particle size decreases, R increases such that at some point R approaches the lateral propellant flow of thickness 2L. When this happens, the marking material particles are significantly deflected from the spot centroid, and at the extreme never contact the substrate. It can be shown from the above that this occurs (based on the assumptions made herein) for marking material particle sizes in the range of around 100 nm or less.

This demonstrates not only acceptable spot size and position control, but illustrates that under the assumed conditions, no special mechanism is required to extract the marking material particle from the propellant stream and deposit it on the substrate.

Figure 32:
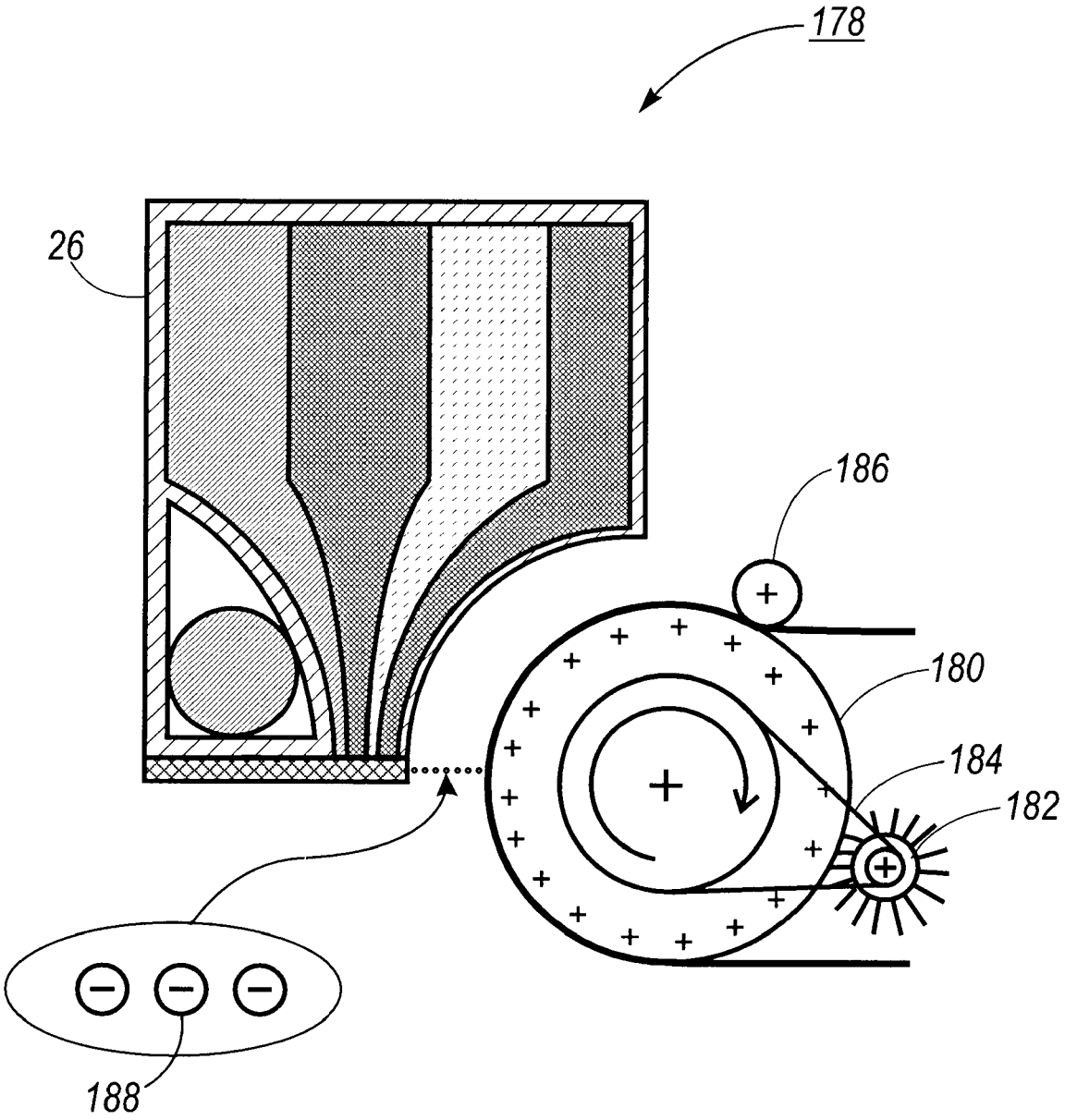
FIG. 32 is an illustration of a ballistic aerosol marking apparatus having electrostatically assisted marking material extraction and/or pre-fusing retention.

However, in the event that it is desirable to further increase the extraction of the marking material particle from the propellant stream at the substrate surface (e.g., at low flow velocities/particle sizes, etc.) electrostaticly enhanced particle extraction may be employed. By charging the substrate or the platen (where employed) opposite the charge of the marking material particle, the attraction between particle and substrate/platen enhances the particle extraction. Such an embodiment 178 is illustrated in FIG. 32, in which body 26 is located proximate a platen 180 capable of accepting and retaining a net charge. The charge on platen 180 may be applied by a donor roller 182 moved in conjunction with platen 180 by a belt 184 or other means, or by other methods known in the art (such as by a tribo-brush, piezo-electric coating, etc.)

In one example, platen 180 is provided a net positive charge by donor roller 182. Marking material particles 188 may be given a net negative charge, for example by the corona illustrated in FIG. 3, or by other means. A mark-receiving substrate (e.g., paper) is placed between the marking material source and the platen, proximate the platen. The attraction between the marking material 188 and the platen accelerates the marking material toward the platen, and if such attraction is sufficiently strong, especially in embodiments having a relatively slow propellant velocity, it can overcome the tendency of the propellant to be deviated from the spot centroid by lateral drag of the propellant. In addition, this attraction may help eliminate the problem of marking materials bouncing off of the substrate and either coming to rest at an unintended position on the substrate or coming to rest in a position off of the substrate prior to post-ejection modification (e.g., fusing by a heat and/or pressure roller 186), a problem referred to as "bounce back". This is especially beneficial when kinetic fusing (discussed below) cannot be employed.

Post-Ejection Modification

Once the marking material has been delivered to the substrate, it must be adhered, or fused, to the substrate. While there are multiple approaches for fusing according to the present invention, one simple approach is to employ the kinetic energy. of the marking material particle. For this approach, the marking material particle must have a velocity v. at impact with the substrate sufficient to kinetically melt the particle by plastic deformation from the collision with the substrate (assuming the substrate is infinitely stiff). Following melting (complete transition to liquid or glass phase, or similar reversible temporary phase transition), the particle resolidifies (or otherwise returns to its original phase) and is thereby fused to the substrate.

Figure 34:
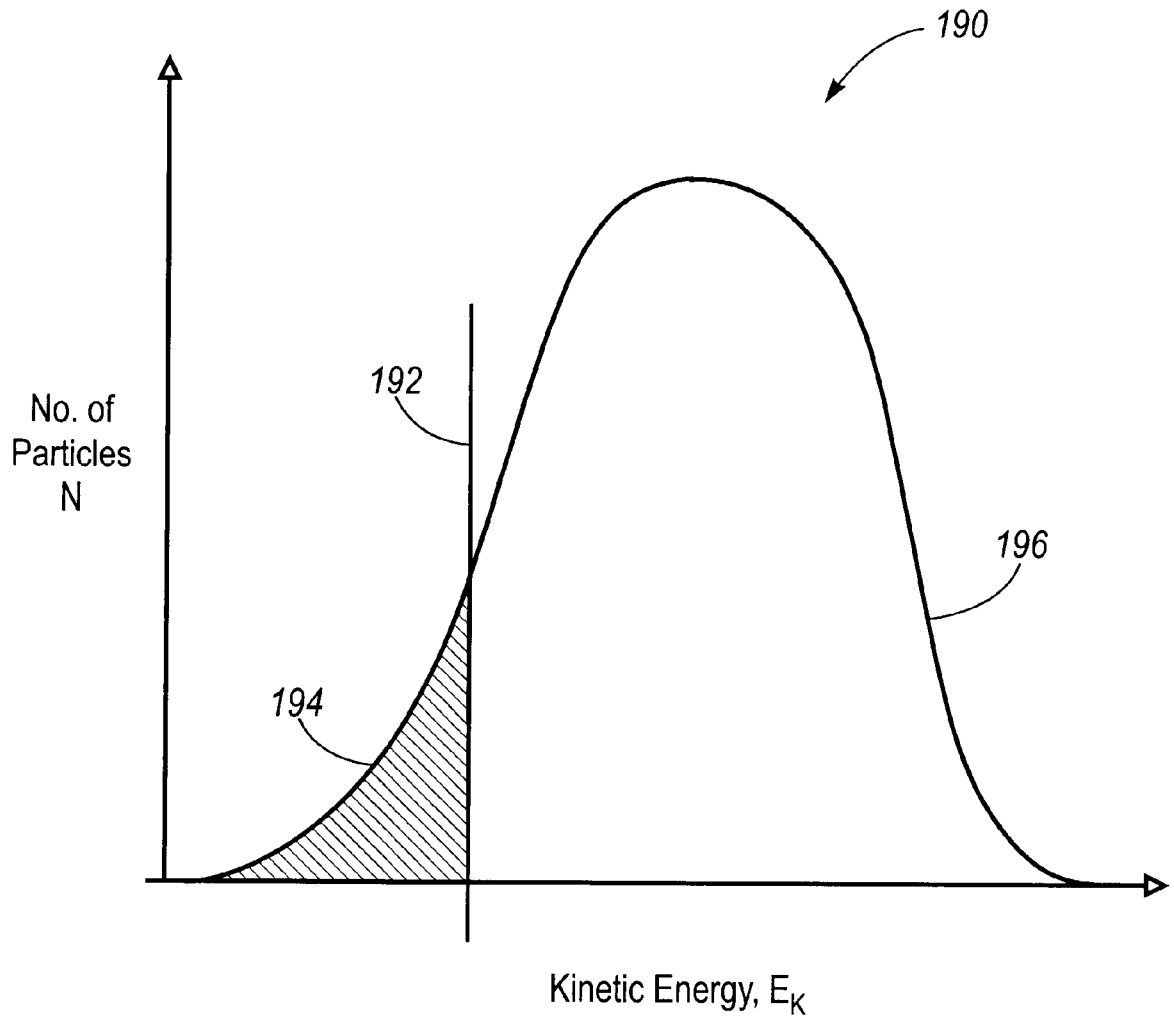
FIG. 34 is a plot of the number of particles versus kinetic energy, illustrating the kinetic fusion threshold for one embodiment of the present invention.

To accomplish kinetic fusing, it is required that: (1) the kinetic energy of the particle be large enough to bring the particle beyond its elasticity limit; and (2) the kinetic energy is larger than the heat required to bring the particle beyond its softening temperature to cause a phase change. FIG. 34 is a plot 190 of the number of marking material particles versus kinetic energy for a typical embodiment of the present invention. Below a certain kinetic energy value, the particles have insufficient energy to fuse to a substrate, while above this certain kinetic energy value the particles will have sufficient kinetic energy to fuse. That certain kinetic energy value is referred to as the kinetic fusing energy threshold, and is illustrated by the boundary 192 shown in FIG. 34. Essentially, particles whose kinetic energy falls into region 194 will not fuse due to insufficient heating, whereas particles with energies in region 196 will fuse. There are essentially two ways to increase the percentage of fused marking material particles. First, the kinetic fusing energy threshold may be shifted down. This is essentially a function of the qualities of the marking material. Second, the average kinetic energy of the particles may be shifted by, for example, increasing the propellant velocity.

The kinetic energy $E_k$ of a spherical particle with velocity v, density ρ, and diameter d is given by $$E_k = \frac{\pi \cdot \rho \cdot d^3 \cdot v^2}{12}$$

The energy $E_m$ required to heat a spherical particle with diameter d, heat capacity $C_p$, and density ρ from room temperature $T_0$ to beyond its softening temperature $T_s$ is given by $$E_m = \frac{\pi \cdot \rho \cdot d^3 \cdot C_p \cdot (T_s - T_0)}{6}$$

The energy $E_p$ required to deform a particle with diameter d and Young's modulus E beyond its elasticity limit $\phi_e$ and into the plastic deformation regime is given by $$E_p = \frac{d^3 \cdot \sigma_e^2}{2E}$$

The critical velocity $v_{cp}$ for obtain plastic deformation is then given by $$v_{cp} = \sqrt{\frac{6}{\pi \cdot \rho \cdot E}} \cdot \sigma_e$$

Finally, the critical velocity $v_{cm}$ to obtain kinetic melt is given by $$v_{cm} = \sqrt{2 \cdot C_p \cdot (T_s - T_0)}$$

For a thermoplastic with $C_p$=1000 J/kg·K, $T_s$=60° C., and $T_0$20° C., the critical velocity required to achieve kinetic melt is 280 m/s. This is consistent with the assumptions made above. It should be noted that this result is independent of particle size and density.

Attaining such a propellant flow of 280 m/s or greater may be accomplished in several ways. One method is to provide propellant at a relatively high pressure, depending on the device geometry (e.g., on the order of several atmospheres in one example), to the converging region of a channel having converging region 48 and diverging region 50, for example a so-called de Laval nozzle, illustrated in FIG. 4, converting the propellant pressure to velocity. In one example, the propellant is subsonic (e.g., less than 331 m/s) in all regions of the channel. In another example, the propellant will be subsonic in converging region 48, supersonic in diverging region 50, and at or very near the speed of sound at the throat 53 between the converging and diverging regions.

Figure 35:
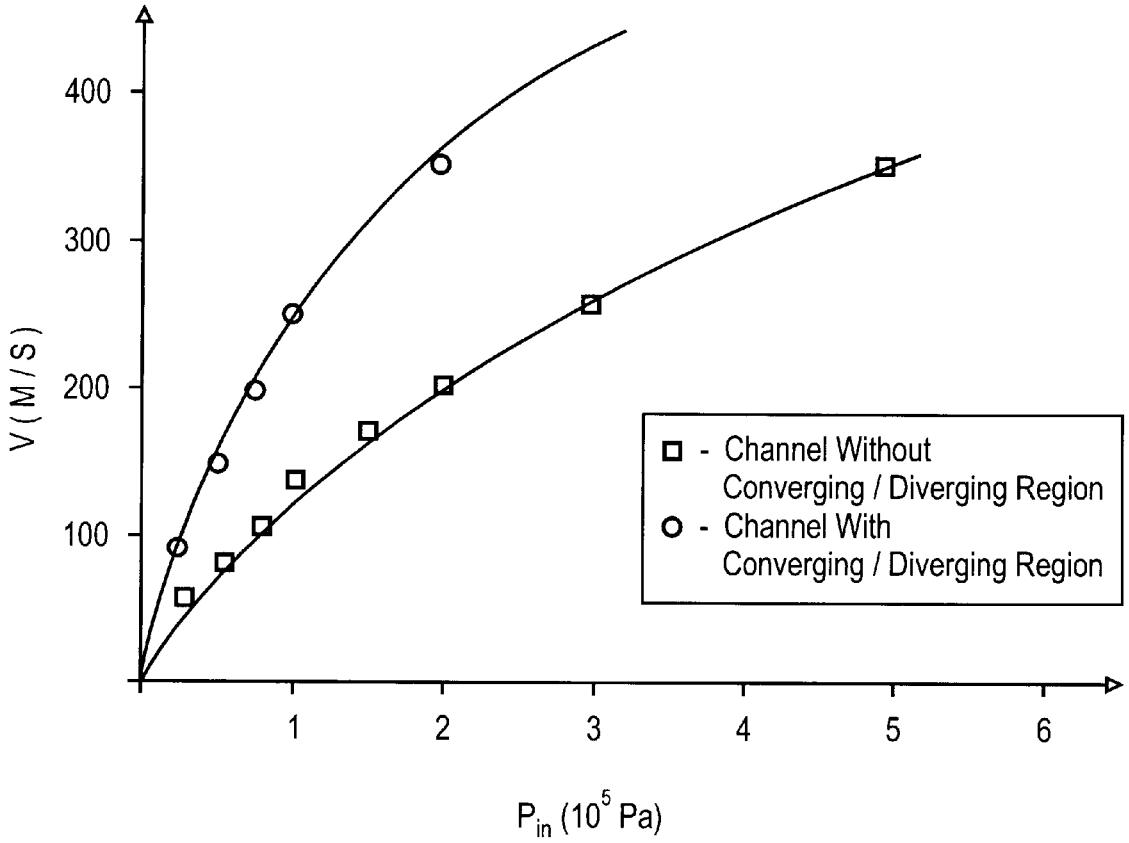
FIG. 35 is a plot of propellant velocity at an exit orifice versus propellant pressure for channels with and without converging/diverging regions according to the present invention.

FIG. 35 is an illustration of propellant velocity v at exit orifice 56 versus propellant pressure for a channel 46 of square cross-section 84 $\mu$m on each side (corresponding to about 300 spots per inch). As can be seen, 280 m/s is readily attainable at moderate pressures for channels both with and without a nozzle.

The above has assumed that the substrate is infinitely stiff, which in most cases it is not. The effect of elasticity of the substrate is to decrease the apparent E-modulus of the material without reducing its yield strength (i.e., more energy is required to attain the yield stress in the material, more energy is required to achieve plastic deformation, and $v_{cp}$ increases). That is, even though the kinetic energy may be larger than the energy required to melt the particle, the collision will be elastic, causing bounce of the particle and potentially insufficient heating. Thus, in some systems (depending on the elasticity of the substrate) marking material particles must attain a higher pre-impact velocity, or fusing assistance must be provided by the system.

In the event that fusing assistance is required (i.e., elastic substrate, low marking material particle velocity, etc.), a number of approaches may be employed. For example, one or more heated filaments 122 may be provided proximate the ejection port 56 (shown in FIG. 4), which either reduces the kinetic energy needed to melt the marking material particle or in fact at least partly melts the marking material particle in flight. Alternatively, or in addition to filament 122, a heated filament 124 may be located proximate substrate 38 (also shown in FIG. 4) to have a similar effect.

Figure 36:
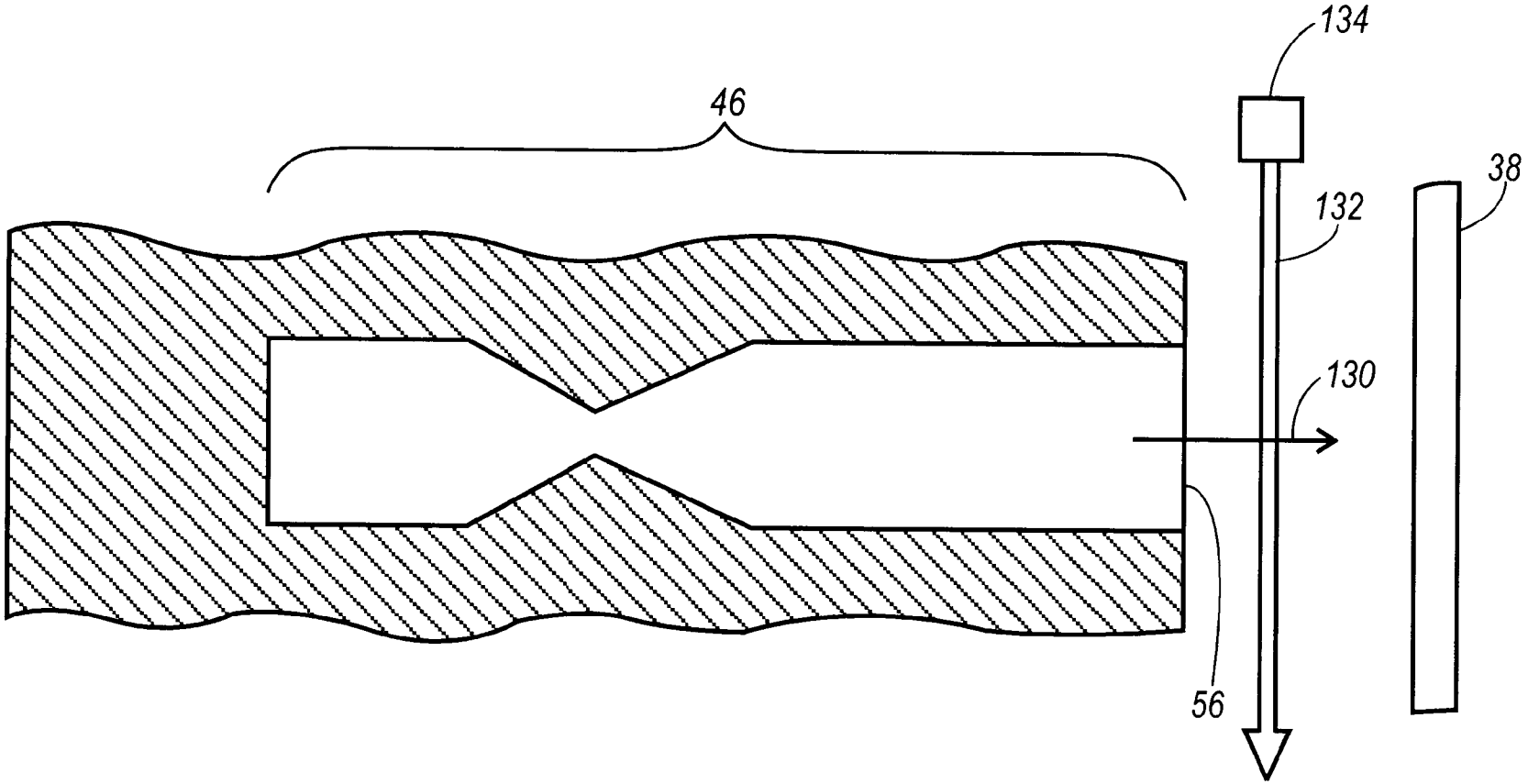
FIG. 36 is a cut-away plan view of a channel and beam of light, arranged to provide light-assisted post-ejection marking material modification.

Still another approach to assisting the fusing process is to pass the marking material particle through an intense, collimated beam of light, such as a laser beam, thereby imparting energy to the particle sufficient either to reduce the kinetic energy needed to melt the marking material particle or at least partially melt the particle in flight. This embodiment is shown in FIG. 36, wherein a stream 130 of particles of marking material pass through an intense, collimated light source 132, such as a laser beam generated by a laser 134, on their way toward substrate 38. Of course a light source other than laser 134 may provide similar results.

Figure 31:
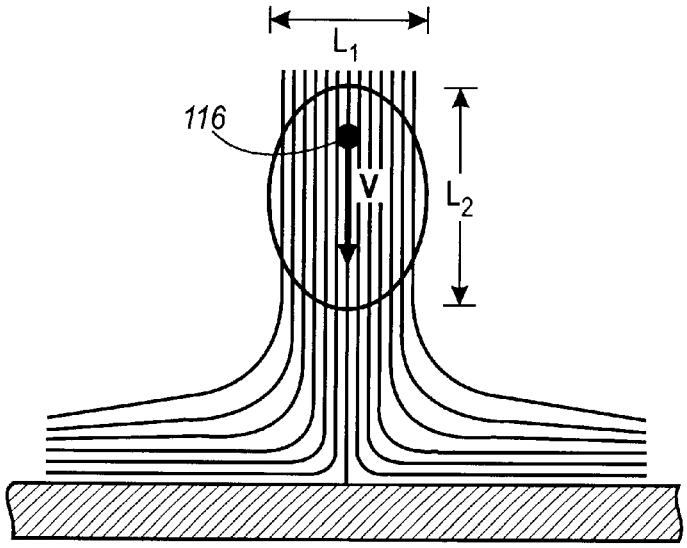
FIG. 31 is a model used for the derivation of an example of laser power required for laser-assisted post-ejection marking material modification, such as assisted fusing.

Assume that a particle with density ρ, mass m, diameter d, heat capacity $C_p$, and softening temperature $T_s$, travels with velocity v through a laser beam with a width $L_1$ and a height $L_2$, as shown in FIG. 31. The temperature change ΔT for such a particle for a give heat input ΔQ is given by $$\Delta T = \frac{\Delta Q}{m \cdot C_p} = \frac{6\Delta Q}{C_p \cdot \rho \cdot \pi \cdot d^3}$$

where $$m = \rho \cdot \text{volume} = \rho \cdot \frac{\pi d^3}{6}$$

The laser power density p is given by the laser power P divided by the area of the ellipse as $$p = \frac{P}{\pi \cdot L_1 \cdot L_2 / 4}$$

The energy absorbed by the particle per unit of time is given by the laser power density multiplied by the projected area of the particle ($\pi d^2/4$) multiplied by the absorption fraction α

$$\frac{\Delta Q}{\Delta t} = \alpha \cdot \frac{4 \cdot P}{\pi \cdot L_1 \cdot L_2} \cdot \frac{\pi \cdot d^2}{4} = \alpha \cdot \frac{P \cdot d^2}{L_1 \cdot L_2}$$

The energy absorbed by the particle during its travel through the beam is thus given by $$\Delta t = L_2 / v$$

$$\Delta Q = \alpha \cdot \frac{P \cdot d^2}{L_1 \cdot v}$$

The temperature change is thus given by $$\Delta T = \frac{6 \cdot \alpha \cdot P}{\pi \cdot \rho \cdot C_p \cdot d \cdot L_1 \cdot v}$$

When the initial temperature of the particle is $T_0$, the laser power required to heat the particle beyond its glass transition temperature is hence given by $$P = \frac{\pi \cdot \rho \cdot C_p \cdot d \cdot L_1 \cdot v \cdot (T_s - T_0)}{6 \cdot \alpha}$$

As an example, we assume the following values:

TABLE 5

| | | |
|---|---|---|
| α | 0.7 | absorption fraction |
| ρ | 900 kg/m$^3$ | marking material particle density |
| $C_p$ | 1200 J/kgK | marking material particle heat capacity |
| d | $1.0 \times 10^{-6}$ m | marking material particle diameter |
| $L_1$ | $0.2 \times 10^{-3}$ m | laser beam width |
| v | 300 m/s | marking material particle velocity |
| $T_s$ | 60° C. | marking material particle softening temperature |
| $T_0$ | 20° C. | initial marking material particle temperature |

Accordingly, the laser power required to melt the marking material particle of this example is 1.9 watts. This is well within the range of commercially available laser systems, such as continuous beam, fiber-coupled laser diode arrays produced by Spectra Diode Labs (Mountain View, Calif.).

Figure 37:
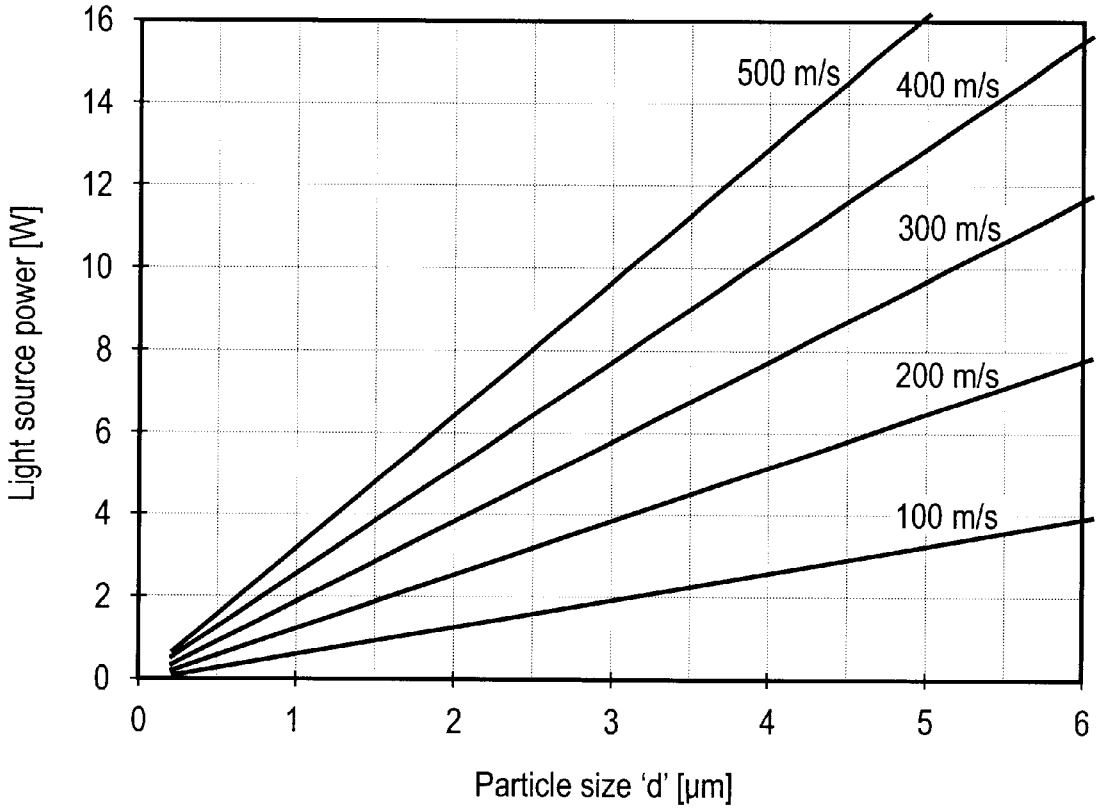
FIG. 37 is a plot of light source power versus marking material particle size, demonstrating the feasibility of employing light-assisted post-ejection marking material modification.

FIG. 37 is a plot of the light source power required for particle melt versus particle size for various particle velocities, and indicates that in-flight melting with, e.g., laser diodes should be feasible for the particle sizes and velocities of interest. The advantage provided by in-flight melting is that no bulk material is heated (neither the bulk marking material nor the substrate). Therefore, in-flight melt can accommodate a wide variety of marking material delivery packages (e.g., both fixedly mounted and removable marking material reservoirs, etc.), and can serve a wide variety of substrates due to low marking material heat content despite a relatively high particle temperature (i.e., low thermal mass).

Finally, other systems for assisting the fusing process may be employed, depending on the particular application of the present invention. For example, the propellant itself may be heated. While this may be undesirable in the event that the heat of the propellant melts the marking material particles, since this may lead to contamination and clogging of the channels, sufficient heat energy may be imparted to the particles short of melting to reduce the kinetic energy required for impact fusing. The substrate (or substrate carrier such as a platen) may be heated sufficiently to assist with the kinetic fusing or in fact sufficiently to melt the marking material particles. Or, fusing may take place at a separate station of the device, by heat, pressure or a combination of the two, similar to the fusing process employed in modem xerographic equipment. UV curable materials used as a marking material may be fused or cured by application of UV radiation, either in flight or to the material-bearing substrate.

It should be appreciated, however, that an important aspect of the present invention is the ability to provide phase change and fusing on a pixel-by-pixel basis. That is, much of the prior art has been limited to liquid phase bulk printing material, such as liquid ink or toner in a liquid carrier. Thus, the present invention can enable significant resolution improvements and pixel level multiple-material, or multiple-color single pass marking.

Closure Structure

During operation of one embodiment of the marking apparatus of the present invention, propellant may continuously flow through the channel(s). This serves several purposes, including maximizing the speed at which the system can mark a substrate (a constant ready state), continuously purging the channels of accumulations of marking material, and preventing the entry of contaminants (such as paper fibers, dust, moisture from the ambient humidity, etc.) into the channels.

Figure 38:
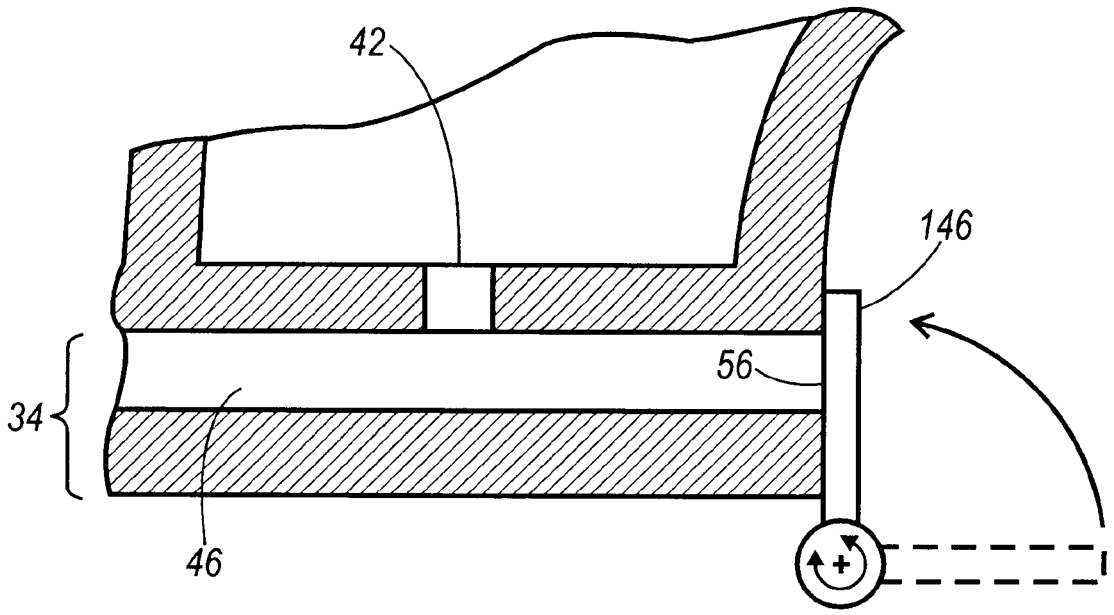
FIG. 38 is an illustration of a ballistic aerosol marking apparatus employing a closure structure for reducing or preventing clogging, humidity effects, etc. according to one embodiment of the present invention.
Figure 39:
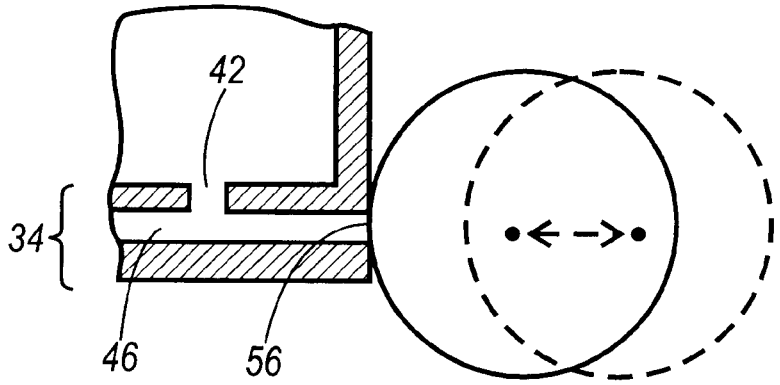
FIG. 39 is an illustration of a channel closure obtained by moving a platen into contact with an exit orifice according to one embodiment of the present invention.

In a non-operative state, such as a system power off, no propellant flows through the channels. To avoid entry of contaminants in this state, a closure structure 146, illustrated in FIG. 38, may be brought into contact with a face of the print head 34, specifically at exit orifices 56. Closure structure 146 may be a rubber plate, or other material capable of impermeably sealing off the channel from the environment. As an alternative, in the case where print head 34 is movable within the marking system, it may be moved into a maintenance station within the marking system as is commonly employed in TIJ and other printing systems. As another alternative, in the case where the marking system is designed to mark to sheet media supported by a platen, roller or the like, and in addition, where the platen, roller, etc. is formed of a suitable material such as rubber, print head 34 may be moved into contact with the platen, roller, etc. to seal off the channels. Alternatively, the platen, roller, etc. may be moved into contact with print head 34, as illustrated in FIG. 39.

Cleaning of the ports 42 and any associated openings 136 and electrodes 142, 144 may be accomplished by the propellant flow used to establish the fluidized bed, discussed above, or by otherwise controlling the pressure balance between the channel and marking material cavities such that, when marking material is not being injected into the channel, there is a flow of propellant through said ports et al.

Figure 41:
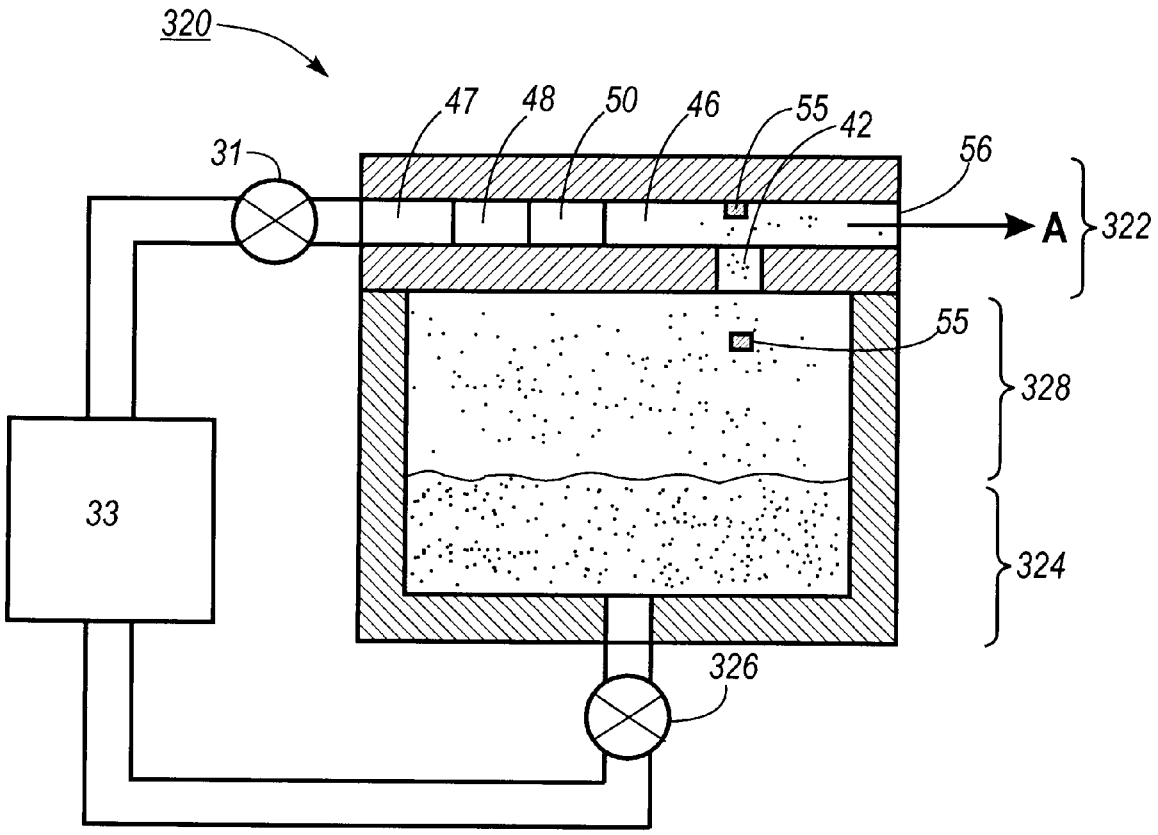
FIG. 41 is an illustration of selected portions of another embodiment of a ballistic aerosol marking apparatus according to the present invention

An alternative embodiment 320 is illustrated in FIG. 41. In embodiment 320, print head 322 is essentially inverted. Much of the description herein applies equally to this embodiment, with the exception that a fluidized bed 324 is established by an appropriate gas, such as propellant from propellant source 33 under control of valve 326, or similar means. An aerosol region 328 is established over the fluidized bed 324, again by the gas or other means creating fluidized bed 324. Marking material from the aerosol region 328 may then be metered into the propellant stream.

It will now be appreciated that various embodiments of a ballistic aerosol marking apparatus, and components thereof have been disclosed herein. These embodiments encompass large scale systems, which may include integrated reservoirs and compressors for providing pressurized propellant, refillable or even remote marking material reservoirs, high propellant speed (even supersonic) for kinetic fusing, designed for very high throughput or rapid very large area marking for marking on one or more of a wide variety of substrates, to small scale systems (e.g., desk-top, home office, etc.) with replaceable cartridges bearing both marking material and propellant, designed for improved quality and throughput printing (color or monochrome) on paper. The embodiments described and alluded to herein are capable of applying a single marking material, one-pass full-color marking material, applying a material not visible to the unaided eye, applying a pre-marking treatment material, a post-marking treatment material, etc., with the ability to mix virtually any marking material within the channel of the device prior to application of the marking material to a substrate, or on a substrate without re-registration. However, it should also be appreciated that the description herein is merely illustrative, and should not be read to limit the scope of the invention nor the claims hereof.

What is claimed is:

1. An apparatus for ejecting a liquid marking material, comprising;

a structure having at least two adjacent channels therein, said channel having an exit orifice with a width no larger than 250 $\mu$m; and a marking material reservoir communicatively connected to said channel; and a metering device interposed between and communicatively coupled to at least one of said channels and said marking material reservoir, capable of selectively introducing said liquid marking material from said reservoir into said at least one channel; and a propellant source coupled to said channel such that propellant provided by said propellant source may flow through said channel to form a continuous propellant stream having kinetic energy, and further wherein said marking material may be introduced into said propellant stream such that the kinetic energy of said propellant stream causes transport of marking material.

2. The apparatus of claim 1, wherein each of said at least two adjacent channels are no more than 250 $\mu$m apart from any other adjacent channel.

3. The apparatus of claim 1, further including a plurality of marking material reservoirs, each reservoir communicatively connected to at least one of said channels, and further including a plurality of metering devices, each said metering device interposed between one of said marking material reservoirs and one of said channels.

4. The apparatus of claim 3, wherein each of said plurality of metering devices are independently addressable such that each metering device may individually control the introduction of said liquid marking material from one of said reservoirs into one of said channels.

5. The apparatus of claim 1, wherein said metering device comprises a thermal ink jet ejector.

6. The apparatus of claim 1, wherein said metering device comprises an acoustic ink ejector.

7. The apparatus of claim 1 wherein the propellant is a gas.

8. The apparatus of claim 7 wherein the gas is a dry gas.

9. The apparatus of claim 1 wherein the propellant exits the exit orifice in a liquid colorant stream, the liquid colorant stream having a width which does not deviate by more that 10 percent from the width of the exit orifice of a distance, in a direction of travel of the marking stream, of at least four times the exit orifice width.

10. An apparatus for depositing a liquid marking material onto a substrate, comprising;

a print head having at least two adjacent channels therein, each said channel having an exit orifice with a width no larger than 250 $\mu$m;

a propellant source connected to each said channel such that propellant provided by said propellant source may flow through said channels to form continuous propellant streams therein, said propellant streams having kinetic energy, each said channel directing said propellant stream through said exit orifice toward said substrate; and a marking material reservoir communicatively connected to each said channel such that liquid marking material from said reservoir may be controllably introduced into said propellant stream in each said channel so that the kinetic energy of said propellant stream may cause said liquid marking material to impact said substrate.

11. The apparatus of claim 10, wherein each of said at least two adjacent channels are no more than 250 $\mu$m apart from any other adjacent channel.

12. The apparatus of claim 10, further including a plurality of marking material reservoirs, each reservoir communicatively connected to at least one of said channels such that marking material from each of said reservoirs may be controllably introduced into said propellant streams.

13. The apparatus of claim 12, wherein each marking material reservoir contains a different marking material.

14. The apparatus of claim 13, wherein each different marking material is a liquid colorant of a different color than each other different marking material.

15. The apparatus of claim 13, wherein at least one of said marking materials is a finish material.

16. The apparatus of claim 12, further comprising a plurality of metering devices, each metering device interposed between one of said marking material reservoirs and one of said channels, said metering devices capable of independently regulating the introduction of marking material from said reservoir into said propellant streams.

17. The apparatus of claim 16, wherein each of said metering devices comprises an electrostatic gate.

18. The apparatus of claim 17, wherein each said marking material reservoir is communicatively connected to each said channel by way of a port defined in said reservoir, and further wherein said electrostatic gate comprises an electrode pair, located in said port, said electrode pair connected to selectively generate an electric field, such that when said electric field is generated said marking material is attracted in a direction toward and into said propellant stream.

19. The apparatus of claim 12, further comprising a plurality of metering devices, each metering device comprising a pair of electrodes, a first electrode of said pair located within said marking material reservoir, a second electrode of said pair located within said channel.

20. The apparatus of claim 19, wherein said reservoir is provided with a port through which said liquid marking material may pass from said reservoir to said channel, and further wherein said second electrode of said pair is located on an inner surface of said channel across said channel from said port.

21. The apparatus of claim 10, wherein each said channel has a converging region and a diverging region, and wherein said propellant is introduced in said converging region and flows into said diverging region, whereby said propellant is at a first velocity and first pressure in said converging region and a second velocity and a second pressure in said diverging region, said first pressure greater than said second pressure and said first velocity less than said second velocity.

22. The apparatus of claim 10, wherein said marking material reservoir is removably and replacably located adjacent said print head.

23. The apparatus of claim 10, wherein said marking material reservoir includes a port through which the reservoir may be refilled.

24. The apparatus of claim 10, wherein said propellant source is removably and replacably located adjacent said print head.

25. The apparatus of claim 10, wherein said marking material reservoir and said propellant source are housed together is a body removably and replacably located adjacent said print head.

26. The apparatus of claim 10, wherein said propellant may flow through one or more of said exit orifices at a velocity greater than the speed of sound.

27. The apparatus of claim 10, further comprising a plurality of metering devices, each metering device interposed between said marking material reservoir and one of said channels, said metering devices capable of independently regulating the introduction of marking material from said reservoir into said propellant streams.

28. The device apparatus of claim 27, wherein each of said metering devices comprises an electrostatic gate.

29. The apparatus of claim 21, wherein said marking material reservoir is communicatively connected to each said channel by way of a port defined in said reservoir, and further wherein said electrostatic gate comprises an electrode pair, located in said port, said electrode pair connected to selectively generate an electric field, such that when said electric field is generated said marking material is attracted in a direction toward and into said propellant stream.

30. The apparatus of claim 10, further comprising a plurality of metering devices, each metering device comprising a pair of electrodes, a first electrode of said pair located within said marking material reservoir, a second electrode of said pair located within said channel.

31. The apparatus of claim 30, wherein said reservoir is provided with a port through which said liquid marking material may pass from said reservoir to said channel, and further wherein said second electrode of said pair is located on an inner surface of said channel across said channel from said port.

32. The apparatus of claim 10, wherein said print head is moveably mounted such that said print head may be selectively positioned to deposit marking material onto selectively spaced apart regions of said substrate.

33. The apparatus of claim 10 further including a closure device for closing said channel off from an ambient environment when said device is in a non-operative condition.

34. The apparatus of claim 33, wherein said closure device includes a surface which may selectively be positioned at said exit orifice to isolate said channel from said ambient.

35. The apparatus of claim 33, further including a substrate support surface, and further wherein said print head is selectively moveable into physical contact with said substrate support surface such that said channel is closed off from said ambient environment when said device is in a non-operative condition.

36. The apparatus of claim 10, further comprising a thermal ink jet ejector communicatively interposed between said marking material reservoir and said channel such that said liquid marking material is introduced into said propellant stream by said thermal ink jet ejector.

37. The apparatus of claim 10, further comprising a thermal ink jet ejector communicatively interposed between said marking material reservoir and said channel such that said liquid marking material is introduced into said propellant stream by said acoustic ink jet ejector.

38. The apparatus of claim 10 wherein the propellant is a gas.

39. The apparatus of claim 38 wherein the gas is a dry gas.

40. The apparatus of claim 10 wherein the propellant exits the exit orifice in a liquid colorant stream, the liquid colorant stream having a width which does not deviate by more that 10 percent from the width of the exit orifice for a distance, in a direction of travel of the marking stream, of at least four times the exit orifice width.

41. A color printer capable of printing a pixel in one of a range of colors in a single pass onto a substrate, comprising:

a print head defining therein a channel, said print head further including a propellant introduction port and a plurality of liquid colorant introduction ports, each said port in communication with said channel, said channel including a propellant introduction region, a liquid colorant introduction region, a liquid colorant mixing region, and an ejection orifice;

a propellant source, in communication with said propellant introduction port, capable of providing propellant to said propellant introduction region such that propellant from said propellant source forms a continuous propellant stream in said channel;

a plurality of liquid colorant material sources, each liquid colorant material source in communication with one of said liquid colorant introduction ports, each said liquid colorant introduction port being located downstream in the propellant stream from said propellant introduction port, such that a different liquid colorant material from each said liquid colorant material source may be introduced into the propellant stream and mixed in said liquid colorant mixing region to form a liquid colorant mixture;

a plurality of metering devices, each metering device located between one of said liquid colorant material sources and said liquid colorant introduction region, for metering the introduction of the liquid colorant material from said liquid colorant material source into the propellant stream;

whereby said liquid colorant mixture may be imparted with sufficient kinetic energy to exit said channel at said exit orifice and impact said substrate.

42. The color printer of claim 41, wherein each liquid colorant material is of a different, selected color than each of the other liquid colorant materials, and said liquid colorant mixture is of a color different than the color of any one of the liquid colorants.

43. The color printer of claim 41, wherein said printer produces colored pixels on said substrate at a density of at least 300 pixels per inch.

44. The color printer of claim 41, wherein when said liquid colorant exits an exit orifice in a liquid colorant stream, said liquid colorant stream having a width which does not deviate by more than 10 percent from the width of the exit orifice for a distance, in a direction of travel of the marking material stream, of at least 4 times the exit orifice width.

45. The color printer of claim 41 wherein the propellant is a gas.

46. The color printer of claim 45 wherein the gas is a dry gas.

* * * * *